US009267196B2

(12) United States Patent
Okamoto et al.

(10) Patent No.: US 9,267,196 B2
(45) Date of Patent: Feb. 23, 2016

(54) METHOD OF PRODUCING A HOT ROLLED STEEL SHEET

(75) Inventors: Riki Okamoto, Tokyo (JP); Nobuhiro Fujita, Tokyo (JP); Manabu Takahashi, Tokyo (JP); Kunio Hayashi, Tokyo (JP); Tetsuo Kishimoto, Tokyo (JP); Kazuaki Nakano, Tokyo (JP); Takeshi Yamamoto, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 284 days.

(21) Appl. No.: 14/000,143

(22) PCT Filed: Mar. 5, 2012

(86) PCT No.: PCT/JP2012/055586

§ 371 (c)(1),
(2), (4) Date: Aug. 16, 2013

(87) PCT Pub. No.: WO2012/121219

PCT Pub. Date: Sep. 13, 2012

(65) Prior Publication Data

US 2013/0323112 A1 Dec. 5, 2013

(30) Foreign Application Priority Data

Mar. 4, 2011 (JP) ..... 2011-047720
Mar. 4, 2011 (JP) ..... 2011-048231

(51) Int. Cl.
*C21D 8/04* (2006.01)
*C22C 38/04* (2006.01)
(Continued)

(52) U.S. Cl.
CPC . *C22C 38/38* (2013.01); *B21B 1/26* (2013.01); *C21D 8/0226* (2013.01); *C21D 8/0263* (2013.01); *C21D 9/46* (2013.01); *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/06* (2013.01);
(Continued)

(58) Field of Classification Search
None
See application file for complete search history.

(56) References Cited

U.S. PATENT DOCUMENTS 5,304,259 A 4/1994 Miyakusu et al.

FOREIGN PATENT DOCUMENTS

CN 1462317 A 12/2003
CN 101535519 A 9/2009
(Continued)

OTHER PUBLICATIONS

JIS Z 2241, "Metallic materials—Tensile testing—Method of test at room temperature", pp. 477-548, (2011).
(Continued)

*Primary Examiner* — Deborah Yee
(74) *Attorney, Agent, or Firm* — Birch, Stewart, Kolasch & Birch, LLP

(57) ABSTRACT

In a hot-rolled sheet, an average value of pole densities of an orientation group {100}<011> to {223}<110>, which is represented by an arithmetic mean of pole densities of orientations {100}<011>, {116}<110>, {114}<110>, {112}<110>, and {223}<110> in a thickness center portion of a thickness range of 5/8 to 3/8 from a surface of the steel sheet, is 1.0 to 6.5 and a pole density of a crystal orientation {332}<113> is 1.0 to 5.0; and a Lankford value rC in a direction perpendicular to a rolling direction is 0.70 to 1.10 and a Lankford value r30 in a direction that forms 30° with respect to the rolling direction is 0.70 to 1.10.

9 Claims, 5 Drawing Sheets

(51) Int. Cl.

| | |
|---|---|
| ***C22C 38/02*** | (2006.01) |
| ***C22C 38/38*** | (2006.01) |
| ***C22C 38/00*** | (2006.01) |
| ***C22C 38/06*** | (2006.01) |
| ***B21B 1/26*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/34*** | (2006.01) |
| ***C21D 9/46*** | (2006.01) |
| ***C21D 8/02*** | (2006.01) |
| ***C22C 38/18*** | (2006.01) |
| *C21D 6/00* | (2006.01) |

(52) U.S. Cl.

CPC ..... *C22C 38/08* (2013.01); *C22C 38/10* (2013.01); *C22C 38/12* (2013.01); *C22C 38/14* (2013.01); *C22C 38/16* (2013.01); *C22C 38/18* (2013.01); *C22C 38/34* (2013.01); *C21D 6/005* (2013.01); *C21D 6/008* (2013.01); *C21D 2211/005* (2013.01)

(56) References Cited

FOREIGN PATENT DOCUMENTS

| | | | |
|---|---|---|---|
| EP | 1 327 695 | A1 | 7/2003 |
| JP | 5-271758 | A | 10/1993 |
| JP | 2000-119804 | A | 4/2000 |
| JP | 2000-144314 | A | 5/2000 |
| JP | 2003-160836 | A | 6/2003 |
| JP | 2007-231347 | A | 9/2007 |
| JP | 2007-291514 | A | 11/2007 |
| JP | 2009-132988 | A | 6/2009 |
| JP | 2009-249733 | A | 10/2009 |
| JP | 2009-263718 | A | 11/2009 |
| JP | 2009-270191 | A | 11/2009 |
| JP | 2010-53387 | A | 3/2010 |
| JP | 2010-090476 | A | 4/2010 |
| JP | 2011-12308 | A | 1/2011 |
| WO | WO 2012/014926 | A1 | 2/2012 |

OTHER PUBLICATIONS

JIS Z 2248, "Metallic materials—Bend test", pp. 733-748, (2006).

Katoh et al., "Developement of New High-Strength Hot-Rolled Steel Sheets", Steel-manufacturing studies (seitetu kenkyu), vol. 312, pp. 41-50, 1984.

Kishida, "High Strength Steel Sheets for Light Weight Vehicle", Nippon Steel Corporation Technical Report, No. 371, pp. 13-17, 1999.

Matsumura et al., "Enhancement of Elongation by Retained Austenite in Intercritical Annealed 0.4C—1.5Si—0.8Mn Steel", Transactions ISIJ, vol. 27, pp. 570-579, 1987.

NFG Catalog, Nakayama Steel Works, Ltd. 10 pages, Sep. 5, 2012.

PCT/ISA/210—International Search Report mailed on May 29, 2012, issued in PCT/JP2012/055586.

Sugimoto et al., Stretch-flangeablitiy of High-strength TRIP Type Bainitic Sheet Steel, ISIJ International, vol. 40, No. 9, pp. 920-926, 2000.

Extended European Search Report, issued Feb. 4, 2015 for European Application No. 12754891.5.

Taiwanese Office Action dated Dec. 17, 2013 for Taiwanese Application No. 101107410 with English translation.

Chinese Office Action and Search Report, issued Nov. 4, 2014, for Chinese Application No. 201280011272.0, with English translations.

Ma et al., "Tensile Behavior of AA3104 Aluminum Sheets at Low Deformation Degree", Journal of University of Science and Technology Beijing, vol. 12, No. 5, Oct. 2005, pp. 422-426.

METHOD OF PRODUCING A HOT ROLLED STEEL SHEET

TECHNICAL FIELD

The present invention relates to a hot-rolled steel sheet which has superior local deformability during bending, stretch flanging, burring or the like of stretch forming or the like, has low orientation dependence of formability, and is used for automobile components and the like; and a method of producing the same.

Priority is claimed on Japanese Patent Application No. 2011-047720, filed Mar. 4, 2011 and Japanese Patent Application No. 2011-048231, filed Mar. 4, 2011, the contents of which are incorporated herein by reference.

BACKGROUND ART

In order to suppress the amount of carbon dioxide gas emitted from a vehicle, the weight of a vehicle body has been reduced by the use of a high-strength steel sheet. From the viewpoint of securing the safety of a passenger, a large number of high-strength steel sheets, in addition to a mild steel sheets, are used in a vehicle body. However, in order to further reduce the weight of a vehicle body, the strength of a high-strength steel sheet to be used is required to be higher than that of the related art.

However, generally, as the strength of a steel sheet is increased, the formability thereof is reduced. For example, Non-Patent Document 1 discloses that uniform elongation, which is important during drawing or stretch forming, deteriorates due to high-strengthening.

Therefore, in order to use a high-strength steel sheet in, for example, suspension components or components of a vehicle body for absorbing collision energy, it is important to improve local deformability such as local ductility which contributes to formability such as burring workability or bending workability.

To that end, Non-Patent Document 2 discloses a method of improving uniform elongation at the same strength by preparing a complex metallographic structure of a steel sheet.

Non-Patent Document 3 discloses a method of controlling a metallographic structure in which local deformability, represented by bendability, hole expansibility, or burring workability, is improved by inclusion control, single structuring, and a reduction in hardness difference between structures. In this method, a single structure is prepared by structure control to improve hole expansibility. In order to prepare a single structure, basically, a heat treatment from an austenitic single phase is required in this method as disclosed in Non-Patent Document 4.

In addition, Non-Patent Document 4 discloses a technique of increasing strength and securing ductility at the same time in which cooling after hot rolling is controlled to control a metallographic structure; and a precipitate and a transformation structure are controlled to obtain appropriate fractions of ferrite and bainite.

However, the above-described techniques are the methods of improving local deformability which depend on structure control, and greatly affect the structure formation of a base.

Meanwhile, techniques relating to the improvement of material properties by an increase in rolling reduction during continuous hot rolling are disclosed in the related art. These techniques are so-called grain refinement techniques. For example, Non-Patent Document 5 discloses a technique of increasing strength and toughness by grain refinement in which large reduction is performed in an austenite region in a lowest possible temperature range to transform non-recrystallized austenite into ferrite and thus to facilitate the grain refinement of ferrite which is the primary phase of a product. However, measures for improving local deformability that the invention is to solve is not disclosed at all.

PRIOR ART DOCUMENT

Non-Patent Document

[Non-Patent Document 1] Kishida, "Nippon Steel Technical Report" (1999), No. 371, p. 13

[Non-Patent Document 2] O. Matsumura et al., "Trans. ISIJ" (1987), vol. 27, p. 570

[Non-Patent Document 3] Kato et al., "Iron-making Research" (1984), vol. 312, p. 41

[Non-Patent Document 4] K. Sugimoto et al., "ISIJ International" (2000), Vol. 40, p. 920

[Non-Patent Document 5] Nakayama Steel Works Ltd. NFG product introduction

DISCLOSURE OF THE INVENTION

Problem that the Invention is to Solve

As described above, as measures for improving elongation and local deformability of a high-strength steel sheet, generally, structure control including inclusion control is performed. However, for structure control, it is necessary that a precipitate or fractions and forms of structures such as ferrite and bainite be controlled. Therefore, a metallographic structure of a base is limited.

An object of the present invention is to provide a hot-rolled steel sheet in which the kinds of phases are not limited, the strength is high, the elongation and local deformability are superior, and the orientation dependence of formability is low by controlling not a base structure but a texture and furthermore controlling the size and form of a grain unit of crystal grains; and to provide a method of producing the same.

"High strength" described in the present invention represents the tensile strength being greater than or equal to 440 MPa.

Means for Solving the Problems

According to the findings of the related art, as described above, elongation and local deformability, which contribute to hole expansibility, bendability, and the like, are improved by inclusion control, precipitate refining, structure homogenizing, single structuring, and a reduction in hardness difference between structures. However, only with these techniques, a main structure configuration is limited. Furthermore, when Nb, Ti, or the like, which is a representative element significantly contributing to an increase in strength, is added, there is a concern that anisotropy is extremely increased. Therefore, other formability factors deteriorate, a direction of blanking before forming is limited, and the use thereof is limited.

In order to improve elongation and local deformability contributing to hole expansibility, bending workability, and the like, the present inventors have newly focused on influences of a texture of a steel sheet and have investigated and studied the effects thereof in detail. As the results, it was found that local deformability can be significantly improved by controlling, in a hot rolling process, pole densities of orientations of a specific crystal orientation group; and by controlling a Lankford value (r value) in a direction (C direction) that forms 90° with respect to a rolling direction and a Lankford value (r value) in a direction that forms 30° with respect to the rolling direction.

Furthermore, it was found that local deformability can be further improved by controlling the r value in the rolling direction, the r value in a direction that forms 60° with respect to the rolling direction, and the shape, size, and hardness of crystal grains in a structure in which the strength of orientations of a specific crystal orientation group is controlled.

However, generally, in a structure into which low-temperature product phases (for example, bainite and martensite) are incorporated, it is difficult to quantify crystal grains. Therefore, in the related art, effects of the shape and size of crystal grains are not studied.

On the other hand, the present inventors found that the quantification problem can be solved by defining a grain unit, which is measured as follows, as crystal grains and using the size of the grain unit as the grain size.

That is, the grain unit described in the present invention can be obtained by measuring orientations in a measurement step of 0.5 μm or less at a magnification of, for example, 1500 times in analysis of orientations of a steel sheet using EBSP (Electron Backscattering Diffraction Pattern); and defining a position in which a difference between adjacent measurement points is greater than 15° as a grain boundary of a grain unit.

Regarding the crystal grains (grain unit) defined as described above, when the equivalent circle diameter defined as described above is d and d=2r, each volume is obtained according to $4\pi r^3/3$; and a volume average grain size can be obtained by a weighted average of the volume.

As a result of the investigation on the effects of the volume average grain size on the elongation of the grain unit, it was found that ductility and local ductility can be improved by controlling the strength of orientations of a specific crystal orientation group and controlling the volume average grain size to be less than or equal to a critical grain size.

The present invention has been made based on the above-described findings and, in order to solve the above-described problems, adopts the following measures.

(1) According to an aspect of the present invention, there is provided a hot-rolled steel sheet including, by mass %, C: a content [C] of 0.0001% to 0.40%, Si: a content [Si] of 0.001% to 2.5%, Mn: a content [Mn] of 0.001% to 4.0%, P: a content [P] of 0.001% to 0.15%, S: a content [S] of 0.0005% to 0.10%, Al: a content [Al] of 0.001% to 2.0%, N: a content [N] of 0.0005% to 0.01%, 0: a content [0] of 0.0005% to 0.01%, and a balance consisting of iron and unavoidable impurities, in which a plurality of crystal grains are present in a metallographic structure of the steel sheet; an average value of pole densities of an orientation group {100}<011> to {223}<110>, which is represented by an arithmetic mean of pole densities of orientations {100}<011>, {116}<110>, {114}<110>, {112}<110>, and {223}<110> in a thickness center portion of a thickness range of ⅝ to ⅜ from a surface of the steel sheet, is 1.0 to 6.5 and a pole density of a crystal orientation {332}<113> is 1.0 to 5.0; and a Lankford value rC in a direction perpendicular to a rolling direction is 0.70 to 1.10 and a Lankford value r30 in a direction that forms 30° with respect to the rolling direction is 0.70 to 1.10.

(2) In the hot-rolled steel sheet according to (1), a volume average grain size of the crystal grains may be 2 μm to 15 μm.

(3) In the hot-rolled steel sheet according to (1), the average value of the pole densities of the orientation group {100}<011> to {223}<110> may be 1.0 to 5.0 and the pole density of the crystal orientation {332}<113> may be 1.0 to 4.0.

(4) In the hot-rolled steel sheet according to (3), an area ratio of coarse crystal grains having a grain size of greater than 35 μm to the crystal grains in the metallographic structure of the steel sheet may be 0% to 10%.

(5) In the hot-rolled steel sheet according to any one of (1) to (4), a Lankford value rL in the rolling direction may be 0.70 to 1.10 and a Lankford value r60 in a direction that forms 60° with respect to the rolling direction may be 0.70 to 1.10.

(6) In the hot-rolled steel sheet according to any one of (1) to (5), wherein when a length of the crystal grains in the rolling direction is defined as dL and a length of the crystal grains in a thickness direction is defined as dt, an area ratio of crystal grains having a value of 3.0 or less, which is obtained by dividing the length dL in the rolling direction by a length dt in the thickness direction, to the crystal grains in the metallographic structure of the steel sheet may be 50% to 100%.

(7) In the hot-rolled steel sheet according to any one of (1) to (6), a ferrite phase may be present in the metallographic structure of the steel sheet and a Vickers hardness Hv of the ferrite phase may satisfy a following expression 1.

$$Hv<200+30\times[Si]+21\times[Mn]+270\times[P]+78\times[Nb]^{1/2}+108\times[Ti]^{1/2} \quad \text{(Expression 1)}$$

(8) In the hot-rolled steel sheet according to any one of (1) to (7), when a phase having a highest phase fraction in the metallographic structure of the steel sheet is defined as a primary phase and hardness of the primary phase is measured at 100 or more points, a value, which is obtained by dividing a standard deviation of the hardness by an average value of the hardness, may be less than or equal to 0.2.

(9) In the hot-rolled steel sheet according to any one of (1) to (8), the steel sheet may further include one or more selected from a group consisting of, by mass %, Ti: a content [Ti] of 0.001% to 0.20%, Nb: a content [Nb] of 0.001% to 0.20%, V: a content [V] of 0.001% to 1.0%, W: a content [W] of 0.001% to 1.0%, B: a content [B] of 0.0001% to 0.0050%, Mo: a content [Mo] of 0.001% to 2.0%, Cr: a content [Cr] of 0.001% to 2.0%, Cu: a content [Cu] of 0.001% to 2.0%, Ni: a content [Ni] of 0.001% to 2.0%, Co: a content [Co] of 0.0001% to 1.0%, Sn: a content [Sn] of 0.0001% to 0.2%, Zr: a content [Zr] of 0.0001% to 0.2%, As: a content [As] of 0.0001% to 0.50%, Mg: a content [Mg] of 0.0001% to 0.010%, Ca: a content [Ca] of 0.0001% to 0.010%, and REM: a content [REM] of 0.0001% to 0.1%.

(10) According to another aspect of the present invention, there is provided a method of producing a hot-rolled steel sheet, including: performing a first hot rolling which reduces a steel ingot or a slab including, by mass %, C: a content [C] of 0.0001% to 0.40%, Si: a content [Si] of 0.001% to 2.5%, Mn: a content [Mn] of 0.001% to 4.0%, P: a content [P] of 0.001% to 0.15%, S: a content [S] of 0.0005% to 0.10%, Al: a content [Al] of 0.001% to 2.0%, N: a content [N] of 0.0005% to 0.01%, 0: a content [O] of 0.0005% to 0.01%, and a balance consisting of iron and unavoidable impurities, and which includes at least one pass at a rolling reduction of 40% or higher in a temperature range of 1000° C. to 1200° C. so as to control an austenite grain size to be less than or equal to 200 μm; performing a second hot rolling in which, when a temperature determined by components of the steel sheet according to a following expression 2 is represented by T1° C., a total rolling reduction is larger than or equal to 50% in a temperature range of (T1+30)° C. to (T1+200)° C.; performing a third hot rolling in which a total rolling reduction is lower than or equal to 30% in a temperature range of T1° C. to less than (T1+30)° C.; finishing the hot rollings at T1° C. or higher; and performing a primary cooling between rolling stands such that, when a pass of a rolling reduction of 30% or higher in the temperature range of (T1+30)° C. to (T1+200)° C. is a large reduction pass, a waiting time t (second) from a finish of a final pass of a large reduction pass to the start of cooling satisfies a following expression 3.

$$T1=850+10\times([C]+[N])\times[Mn]+350\times[Nb]+250\times[Ti]+40\times[B]+10\times[Cr]+100\times[Mo]+100\times[V] \quad \text{(Expression 2)}$$

$$t\leq t1\times 2.5 \quad \text{(Expression 3)}$$

(wherein t1 is represented by a following expression 4)

$$t1=0.001\times((Tf-T1)\times P1/100)^2-0.109\times((Tf-T1)\times P1/100)+3.1 \quad \text{(Expression 4)}$$

(wherein Tf represents the temperature (° C.) of the steel sheet at the time of the finish of the final pass, and P1 represents the rolling reduction (%) during the final pass)

(11) In the method of producing a hot-rolled steel sheet according to (10), the waiting time t (second) may further satisfy a following expression 5.

$$t<t1 \quad \text{(Expression 5)}$$

(12) In the method of producing a hot-rolled steel sheet according to (10), the waiting time t (second) may further satisfy a following expression 6.

$$t1\leq t\leq t1\times 2.5 \quad \text{(Expression 6)}$$

(13) In the method of producing a hot-rolled steel sheet according to any one of (10) to (12), a cooling temperature change, which is a difference between a steel sheet temperature at a time of the a start of the cooling and a steel sheet temperature at the time of the finish of the cooling in the primary cooling, may be 40° C. to 140° C., and the steel sheet temperature at the time of the finish of cooling in the primary cooling may be lower than or equal to (T1+100)° C.

(14) In the method of producing a hot-rolled steel sheet according to any one of (10) to (13), in the second hot rolling of the temperature range of (T1+30)° C. to (T1+200)° C., the reduction may be performed at least once in one pass at a rolling reduction of 30% or higher.

(15) In the method of producing a hot-rolled steel sheet according to any one of (10) to (14), in the first hot rolling, the reduction may be performed at least twice at a rolling reduction of 40% or higher to control an austenite grain size to be less than or equal to 100 μm.

(16) In the method of producing a hot-rolled steel sheet according to any one of (10) to (15), a secondary cooling may start after passing through a final rolling stand and within 10 seconds from the finish of the primary cooling.

(17) In the method of producing a hot-rolled steel sheet according to any one of (10) to (16), in the second hot rolling, an increase in the temperature of the steel sheet between passes may be lower than or equal to 18° C.

(18) In the method of producing a hot-rolled steel sheet according to any one of (10) to (17), the steel ingot or the slab may further include one or more selected from a group consisting of, by mass %, Ti: a content [Ti] of 0.001% to 0.20%, Nb: a content [Nb] of 0.001% to 0.20%, V: a content [V] of 0.001% to 1.0%, W: a content [W] of 0.001% to 1.0%, B: a content [B] of 0.0001% to 0.0050%, Mo: a content [Mo] of 0.001% to 2.0%, Cr: a content [Cr] of 0.001% to 2.0%, Cu: a content [Cu] of 0.001% to 2.0%, Ni: a content [Ni] of 0.001% to 2.0%, Co: a content [Co] of 0.0001% to 1.0%, Sn: a content [Sn] of 0.0001% to 0.2%, Zr: a content [Zr] of 0.0001% to 0.2%, As: a content [As] of 0.0001% to 0.50%, Mg: a content [Mg] of 0.0001% to 0.010%, Ca: a content [Ca] of 0.0001% to 0.010%, and REM: a content [REM] of 0.0001% to 0.1%.

Advantage of the Invention

According to the present invention, a hot-rolled steel sheet in which, even when an element such as Nb or Ti is added, an influence on anisotropy is small and elongation and local deformability are superior can be obtained.

EMBODIMENTS OF THE INVENTION

Hereinbelow, an embodiment of the present invention will be described in detail.

(1) An average value of pole densities of an orientation group {100}<011> to {223}<110> and a pole density of a crystal orientation {332}<113>, in a thickness center portion of a thickness range of ⅝ to ⅜ from a surface of the steel sheet:

In the hot-rolled steel sheet according to the embodiment, an average value of pole densities of an orientation group {100}<011> to {223}<110>, which is represented by an arithmetic mean of pole densities of orientations {100}<011>, {116}<110>, {114}<110>, {112}<110>, and {223}<110> in a thickness center portion of a thickness range of ⅝ to ⅜ from the surface of the steel sheet, is a particularly important characteristic value.

Figure 1:
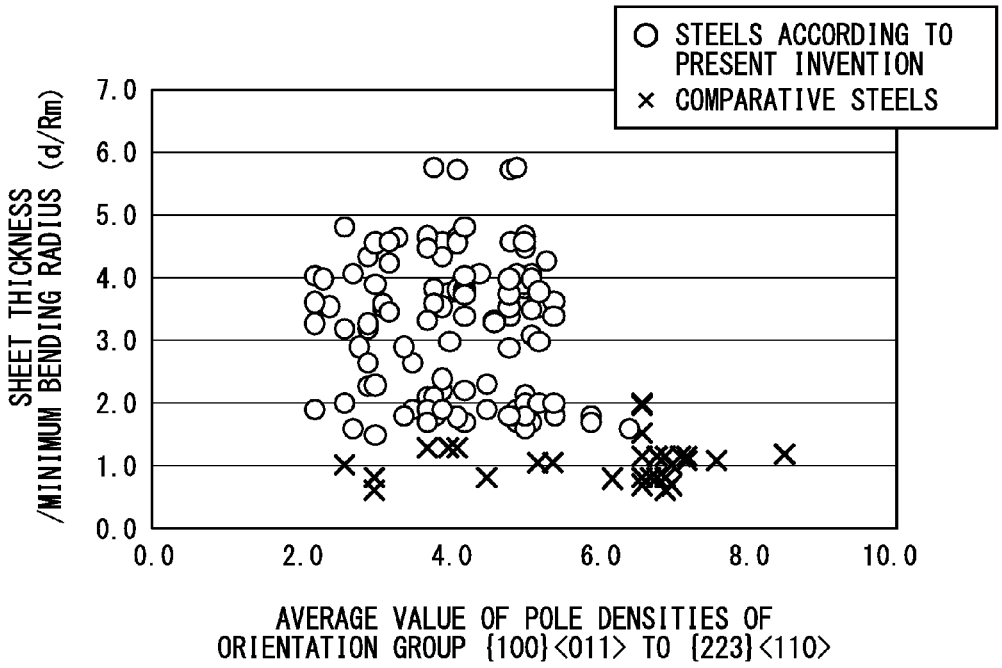
FIG. 1 is a diagram illustrating the relationship between an average value of pole densities of an orientation group {100}<011> to {223}<110> and a value of sheet thickness/minimum bending radius in a hot-rolled steel sheet according to an embodiment of the present invention.

As illustrated in FIG. 1, when the average value of pole densities of the orientation group {100}<011> to [223]<110> in the thickness center portion of a thickness range of 5/8 to 3/8 from the surface of the steel sheet, is less than or equal to 6.5, that is, when the average value of pole densities of the orientation group {100}<011> to {223}<110>, which is obtained by calculating intensity ratios of orientations to a random sample according to the ESBP method, is less than or equal to 6.5, a value d/Rm (bending in the C direction) of sheet thickness/minimum bending radius, which is necessary for processing suspension components and frame components is greater than or equal to 1.5. Furthermore, when the average value of pole densities of the orientation group {100}<011> to {223}<110> is less than or equal to 5.0, a ratio of bending in the 45° direction to bending in the C direction (bending in 45° direction/bending in C direction) as the index indicating the orientation dependency (isotropy) of formability is less than or equal to 1.4, which is more preferable because local deformability is high irrespective of a bending direction. When superior hole expansibility and low limit bending property are necessary, the average value of the pole densities is more preferably less than 4.0 and still more preferably less than 3.0.

When the average value of pole densities of the orientation group {100}<011> to {223}<110> is greater than 6.5, the anisotropy of mechanical properties of the steel sheet is extremely increased. As a result, even though local deformability in a direction is improved, material properties significantly deteriorate in different directions from the direction and the above-described expression of sheet thickness/minimum bending radius ≥1.5 is not satisfied.

Meanwhile, when the average value of the pole densities is less than 1.0, there is a concern pertaining to deterioration in local deformability.

Figure 2:
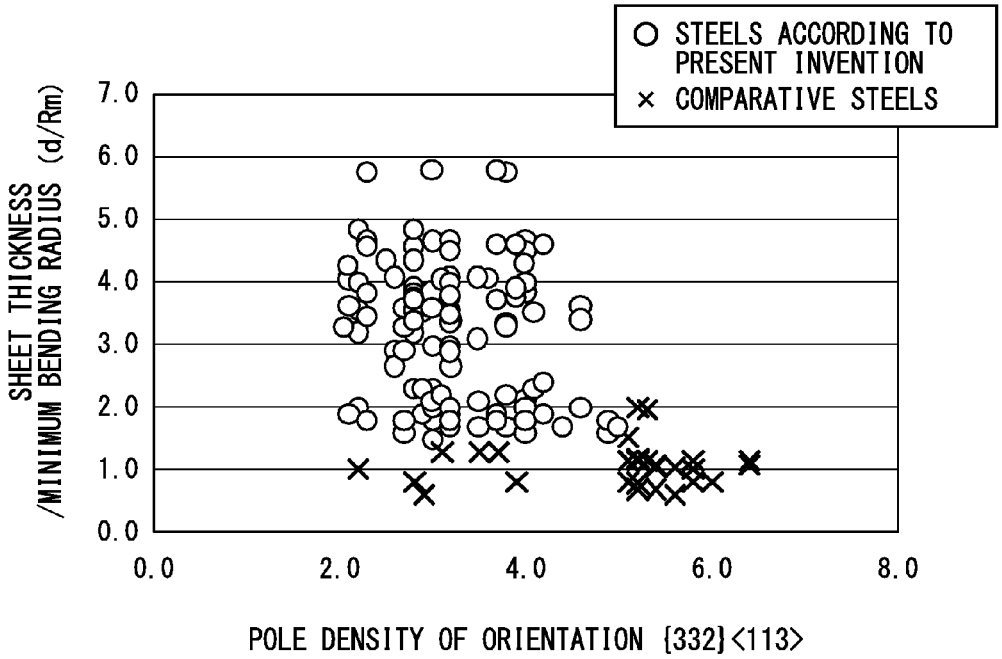
FIG. 2 is a diagram illustrating a relationship between a pole density of an orientation {332}<113> and a value of sheet thickness/minimum bending radius in a hot-rolled steel sheet according to an embodiment of the present invention.

For the same reason, as illustrated in FIG. 2, when the pole density of the crystal orientation {332}<113> in the thickness center portion of a thickness range of 5/8 to 3/8 from the surface of the steel sheet is less than or equal to 5.0, the value of sheet thickness/minimum bending radius of 1.5 or greater, which is necessary for processing suspension components, is satisfied.

Furthermore, when the pole density of the crystal orientation {332}<113> is greater than or equal to 4.0, the ratio of bending in the 45° direction to bending in the C direction is less than or equal to 1.4, which is more preferable. The above-described pole density is more preferably less than or equal to 3.0. When the pole density is greater than 5.0, the anisotropy of mechanical properties of the steel sheet is extremely increased. As a result, even though local deformability in a direction is improved, material properties significantly deteriorate in different directions from the direction. Therefore, the expression of sheet thickness/minimum bending radius ≥1.5 or the expression of ratio of bending in the 45° direction to bending in the C direction ≤1.4 cannot be satisfied. On the other hand, when the pole density is less than 1.0, there is a concern pertaining to deterioration of local deformability.

The reason why the above-described pole density of the crystal orientation is important for shape fixability during bending is not clear, but it is considered that the pole density has a relationship with the slip behavior of crystal during bending deformation.

(2) r Value rC in a Direction Perpendicular to the Rolling Direction:

This rC is important in the embodiment. That is, as a result of thorough investigation, the present inventors found that, even when only the above-described pole densities of the various kinds of crystal orientations are appropriate, superior hole expansibility and bendability cannot be necessarily obtained. In addition to the above-described pole densities, it is necessary for the rC to be 0.70 to 1.10.

When this rC is 0.70 to 1.10, superior local deformability can be obtained.

(3) r Value r30 in a Direction that Forms 30° with Respect to the Rolling Direction:

This r30 is important in the embodiment. That is, as a result of thorough investigation, the present inventors found that, even when the above-described pole densities of the various kinds of crystal orientations are appropriate, superior local deformability cannot be necessarily obtained. In addition to the above-described pole densities, it is necessary that r30 be 0.70 to 1.10.

When this r30 is 0.70 to 1.10, superior local deformability can be obtained.

(4) Volume Average Grain Size of Crystal Grains

As a result of thorough investigation on the texture control and microstructure of a hot-rolled steel sheet, the present inventors found that, under the conditions that the texture is controlled as described above, the influences of the size, in particular, the volume average grain size of crystal grains on elongation is extremely large; and the elongation can be improved by refining the volume average grain size. Furthermore, the present inventors found that fatigue properties (fatigue limit ratio), which are required for an automobile steel sheet and the like can be improved by refining the volume average grain size.

Regarding the contribution of the grain unit, even when the number of crystal grains is small, as the large size of the grain unit increase, the elongation deteriorates. Therefore, the size of the grain unit has a strong correlation not with the normal average grain size but with the volume average grain size obtained by the weighted average of the volume. In order to obtain the above-described effects, it is preferable that the volume average grain size be 2 μm to 15 μm. In the case of a steel sheet having a tensile strength of 540 MPa or higher, it is more preferable that the volume average grain size be greater than or equal to 9.5 μm.

The reason why the elongation is improved by the refinement of the volume average grain size is not clear, but is considered to be that strain dispersion is promoted during local deformation by suppressing micro-order local strain concentration. Furthermore, it is considered that microscopic local strain concentration can be suppressed by improving deformation homogenization, micro-order strain can be uniformly dispersed, and uniform elongation can be improved. Meanwhile, the reason why fatigue properties are improved by the refinement of the volume average grain size is considered to be that since a fatigue phenomenon is repetitive plastic deformation which is dislocation motion, this phenomenon is strongly affected by a grain boundary which is a barrier thereof.

The measurement of the grain unit is as described above.

(5) Ratio of Coarse Crystal Grains Having a Grain Size of Greater than 35 μm

It was found that the bendability is strongly affected by the equiaxial property of crystal grains and the effect thereof is large. In order to suppress the localization of strain and improve the bendability by the effects of the isotropic and equiaxial properties, it is preferable that an area ratio (coarse grain area ratio) of coarse crystal grains having a grain size of greater than 35 μm to the crystal grains in the metallographic structure be smaller and 0% to 10%. When the ratio is lower than or equal to 10%, the bendability can be sufficiently improved.

The reason is not clear, but it is considered that bending deformation is the mode in which strain locally concentrates;

and a state in which strain concentrates on all the crystal grains uniformly and equivalently is advantageous for bendability. It is considered that, when the amount of crystal grains having a great grain size is large, even if the isotropic and equiaxial properties are sufficient, local crystal grains are deformed; and as a result, due to the orientations of the locally deformed crystal grains, unevenness in bendability is great and the bendability deteriorates.

(6) r Value rL in the Rolling Direction and r Value r60 in a Direction that Forms 60° with Respect to the Rolling Direction:

Furthermore, as the results of thorough investigation, it is found that, in a state in which the above-described pole densities of the various kinds of crystal orientations, rC, and r30 are controlled in the predetermined ranges, when a r value rL in the rolling direction is 0.70 to 1.10; and a r value r60 in a direction that forms 60° with respect to the rolling direction is 0.70 to 1.10, superior local deformability can be obtained.

For example, when the average value of pole densities of the orientation group {100}<011> to {223}<110> is 1.0 to 6.5; the pole density of the crystal orientation {332}<113> is 1.0 to 5.0; the values of rC and r30 are 0.70 to 1.10; and the values of rL and r60 are 0.70 to 1.10, an expression of sheet thickness/minimum bending radius ≥2.0 is satisfied.

It is generally known that a texture and an r value have a correlation with each other. However, in the hot-rolled steel sheet according to the embodiment, the above-described limitation relating to the pole densities of crystal orientations and the above-described limitation relating to the r values do not have the same meaning. Therefore, when both the limitations are satisfied at the same time, superior local deformability can be obtained.

(7) Ratio of Grains Having Superior Equiaxial Property

As the results of further investigation on local deformability, the present inventors found that, when the equiaxial property of crystal grains is superior in a state where the above-described texture and r values are satisfied, the orientation dependency of bending is small and the local deformability is improved. The index indicating this equiaxial property is the ratio of crystal grains having a value of 3.0 or less to all the crystal grains in the metallographic structure of the steel sheet and having superior equiaxial property, in which the value is obtained by dividing a length dL in the hot rolling direction by a length dt in a thickness direction (dL/dt), that is, an equiaxial grain fraction. It is preferable that the equiaxial grain fraction is 50% to 100%. When the equiaxial grain fraction is less than 50%, bendability R in the L direction which is the rolling direction or in the C direction which is the direction perpendicular to the rolling direction deteriorates.

(8) Hardness of a Ferrite Phase:

In order to further improve elongation, it is preferable that a ferrite structure is present in the steel sheet and it is more preferable that a ratio of the ferrite structure to the entire structure is larger than or equal to 10%. At this time, it is preferable that a Vickers hardness of the obtained ferrite phase satisfy the following expression (expression 1). When the Vickers hardness is greater than or equal to that, the improvement effect of elongation by the presence of a ferrite phase cannot be obtained.

$$Hv<200+30\times[Si]+21\times[Mn]+270\times[P]+78\times[Nb]^{1/2}+108\times[Ti]^{1/2} \quad \text{(Expression 1)}$$

[Si], [Mn], [P], [Nb], and [Ti] represent the element concentrations (mass %) by weight thereof in the steel sheet.

(9) Standard Deviation of Hardness of Primary Phase/Average Value of Hardness

In addition to the texture, grain size, and equiaxial property, the homogeneity of each crystal grain also greatly contributes to the uniform dispersion of micro-order strain during rolling. As a result of investigation on the homogeneity, the present inventors found that the balance between the ductility and the local deformation of a final product can be improved in a structure having high homogeneity of the primary phase. This homogeneity is defined by measuring the hardness of the primary phase having a highest phase fraction with a nanoindenter at 100 or more points under a load of 1 mN; and obtaining a standard deviation thereof. That is, the lower standard deviation of hardness/the average value of hardness, the higher the homogeneity, and when the average value is lower than or equal to 0.2, the effect thereof is obtained. In the nanoindenter (for example, UMIS-2000, manufactured by CSIRO), the hardness of a crystal grain alone not having a grain boundary can be measured by using a indenter having a smaller size than the grain size.

The present invention is applicable to all the hot-rolled steel sheets, and when the above-described limitations are satisfied, the elongation and local deformability, such as bending workability or hole expansibility, of a hot-rolled steel sheet are significantly improved without being limited to a combination of metallographic structures of the steel sheet. The above-described hot-rolled steel sheets include hot-rolled steel strips which are base sheets for cold-rolled steel sheets or zinc-plated steel sheets.

The pole density is synonymous with X-ray random intensity ratio. The X-ray random intensity ratio is the values obtained by measuring the X-ray intensities of a reference sample not having accumulation in a specific orientation and a test sample with an X-ray diffraction method under the same conditions; and dividing the X-ray intensity of the test sample by the X-ray intensity of the reference sample. The pole density can be measured by an X-ray diffraction, EBSP, or ECP (Electron Channeling Pattern) method. For example, the average value of pole densities of the orientation group {100}<011> to {223}<110> is obtained by obtaining pole densities of orientations {100}<011>, {116}<110>, {114}<110>, {112}<110>, and {223}<110> from a three-dimensional texture (ODF) which is calculated using plural pole figures of pole figures {110}, {100}, {211}, and {310} according to a series expanding method; and obtaining an arithmetic mean of these pole densities. In the measurement, it is only necessary that a sample which is provided for the X-ray diffraction, EBSP, or ECP method is prepared according to the above-described method such that the thickness of the steel sheet is reduced to a predetermined thickness by mechanical polishing or the like; strain is removed by chemical polishing, electrolytic polishing, or the like; and an appropriate surface in a thickness range of ⅜ to ⅝ is obtained as the measurement surface. It is preferable that a transverse direction be obtained at a ¼ position or a ¾ position from an end portion of the steel sheet.

Of course, when the limitation relating to the above-described pole density is satisfied not only in the thickness center portion but in as many portions having various thicknesses as possible, local deformability is further improved. However, as a result of investigation on the influence of a texture on the material properties of a steel sheet, it was found that orientation accumulation in the thickness center portion in a thickness range of ⅝ to ⅜ from the surface of the steel sheet most greatly affects the anisotropy of the steel sheet; and approximately represents the material properties of the entire steel sheet. Therefore, the average value of pole densities of the orientation group {100}<011> to {223}<110>; and the pole density of the crystal orientation {332}<113>, in the thickness center portion in a thickness range of ⅝ to ⅜ from the surface of the steel sheet are specified.

Here, {hkl}<uvw> described represents that, when a sample is prepared according to the above-described method, the normal direction of a sheet plane is parallel to {hkl}; and the rolling direction is parallel to <uvw>. Regarding the crystal orientations, generally, orientations perpendicular to a sheet plane are represented by [hkl] or {hkl}; and orientations parallel to the rolling direction are represented by (uvw) or <uvw>. {hkl} and <uvw> represent the collective terms for equivalent planes, and [hkl] and (uvw) represent individual crystal planes. That is, since a body-centered structure is a target in the embodiment, for example, (111), (−111), (1−11), (11−1), (−1−11), (−11−1), (1−1−1), and (−1−1−1) planes are equivalent and cannot be distinguished from each other. In such a case, these orientations are collectively called {111}. Since ODF is also used for representing orientations of the other low-symmetry crystalline structures, individual orientations are generally represented by [hkl](uvw). However, in the embodiment, [hkl](uvw) and {hkl}<uvw> are synonymous.

The metallographic structure in each steel sheet can be determined as follows.

Perlite is specified by structure observation using an optical microscope. Next, crystalline structures are determined using an EBSP method, and a crystal having a fcc structure is defined as austenite. Ferrite, bainite, and martensite which have a bcc structure can be identified using a KAM (Kernel Average Misorientation) method equipped with EBSP-OIM (registered trademark). In the KAM method, a calculation is performed for each pixel in which orientation differences between pixels are averaged using, among measurement data, a first approximation of adjacent six pixels of pixels of a regular hexagon, a second approximation of 12 pixels thereof which is further outside, or a third approximation of 18 pixels thereof which is further outside; and the average value is set to a center pixel value. By performing this calculation so as not to exceed a grain boundary, a map representing orientation changes in crystal grains can be created. This map shows the strain distribution based on local orientation changes in crystal grains.

In examples according to the present invention, a condition for calculating orientation differences between adjacent pixels in EBSP-OIM (registered trademark) are set to the third approximation and these orientation differences are set to be less than or equal to 5°. In the above-described third approximation of orientation differences, when the calculated value is greater than 1°, the pixel is defined as bainite or martensite which is a low-temperature transformation product; and when the calculated value is less than or equal to 1°, the pixel is defined as ferrite. The reason is as follows: since polygonal pro-eutecitoid ferrite transformed at a high temperature is produced by diffusion transformation, a dislocation density is low, a strain in crystal grains is small, and differences between crystal orientations in crystal grains are small; and as a result of various investigations which have been performed by the present inventors, it was found that the ferrite volume fraction obtained by observation using an optical microscope approximately matched with the area ratio obtained by the third approximation of orientation differences of 1° in the KAM method.

The above-described respective r values are evaluated in a tensile test using a JIS No. 5 tensile test piece. The tensile strain is evaluated in a range of uniform elongation of 5% to 15%.

The direction in which bending is performed varies depending on work pieces and thus is not particularly limited. In the hot-rolled steel sheet according to the present invention, the in-plane anisotropy of the steel sheet is suppressed; and the bendability in the C direction is sufficient. Since the C direction is the direction in which the bendability of a rolled material most significantly deteriorates, bendability is satisfied in all the directions.

As described above, the grain size of ferrite, bainite, martensite, and austenite can be obtained by measuring orientations in a measurement, for example, step of 0.5 μm or less at a magnification of 1500 times in analysis of orientations of a steel sheet using EBSP; defining a position in which an orientation difference between adjacent measurement points is greater than 15° as a grain boundary; and obtaining an equivalent circle diameter of the grain boundary. At this time, the lengths of grains in the rolling direction and the thickness direction are also obtained to obtain dL/dt.

When perlite structure is present in the metallographic structure, the equiaxial grain fraction dL/dt and grain size thereof can be obtained with a binarizing or point counting method in the structure observation using an optical microscope.

Next, limitation conditions for components of the steel sheet will be described. "%" representing the content of each component is "mass %".

C is an element that is basically contained in the steel sheet, and the lower limit of a content [C] thereof is 0.0001%. The lower limit is more preferably 0.001% in order to suppress an excessive increase in the steel making cost of the steel sheet; and is still more preferably 0.01% in order to obtain a high-strength steel at a low cost. On the other hand, when the content [C] of C is greater than 0.40%, workability and weldability deteriorate. Therefore, the upper limit is set to 0.40%. Since the excessive addition of C significantly impairs spot weldability, the content [C] is more preferably less than or equal to 0.30%. The content [C] is still more preferably less than or equal to 0.20%.

Si is an effective element for increasing the mechanical strength of the steel sheet. However, when a content [Si] thereof is greater than 2.5%, workability may deteriorate or surface defects may be generated. Therefore, the upper limit is set to 2.5%. Meanwhile, when the content [Si] of Si in a steel for practical use is less than 0.001%, there may be a problem. Therefore, the lower limit is set to 0.001%. The lower limit is preferably 0.01% and more preferably 0.05%.

Mn is an effective element for increasing the mechanical strength of the steel sheet. However, when a content [Mn] thereof is greater than 4.0%, workability deteriorates. Therefore, the upper limit is set to 4.0%. Mn suppresses the production of ferrite, and thus when it is desired that a structure contains a ferrite phase to secure elongation, the content is preferably less than or equal to 3.0%. Meanwhile, the lower limit of the content [Mn] of Mn is set to 0.001%. However, in order to avoid an excessive increase in the steel making cost of the steel sheet, the content [Mn] is preferably greater than or equal to 0.01%. The lower limit is more preferably 0.2%. In addition, when an element for suppressing hot-cracking by S, such as Ti, is not sufficiently added other than Mn, it is preferable that Mn be added such that the content satisfies, by weight %, an expression of [Mn]/[S]≥20.

Regarding contents [P] and [S] of P and S, in order to prevent deterioration in workability and cracking during hot rolling or cold rolling, [P] is set to be less than or equal to 0.15% and [S] is set to be less than or equal to 0.10%. The lower limit of [P] is set to 0.001% and the lower limit of [S] is set to 0.0005%. Since extreme desulfurization causes an excessive increase in cost, the content [S] is more preferably greater than or equal to 0.001%.

0.001% or greater of Al is added for deoxidation. However, when sufficient deoxidation is necessary, it is more preferable that 0.01% or greater of Al is added. It is still more preferable that 0.02% or greater of Al is added. However, when the content of Al is too great, weldability deteriorates. Therefore, the upper limit is set to 2.0%. That is, the content [Al] of Al is 0.01% to 2.0%.

N and O are impurities, and contents [N] and [0] of both N and O are set to be less than or equal to 0.01% so as not to impair workability. The lower limits of both the elements are set to 0.0005%. However, in order to suppress an excessive increase in the steel making cost of the steel sheet, the contents [N] and [0] thereof are preferably greater than or equal to 0.001%. The contents [N] and [0] are more preferably greater than or equal to 0.002%.

The above-described chemical elements are base components (base elements) of the steel according to the embodiment. A chemical composition in which the base components are controlled (contained or limited); and a balance thereof is iron and unavoidable impurities, is a basic composition according to the present invention. However, in addition to this basic composition (instead of a part of Fe of the balance), the steel according to the embodiment may optionally further contain the following chemical elements (optional elements). Even when these optional elements are unavoidably (for example, the amount of each optional element is less than the lower limit) incorporated into the steel, the effects of the embodiment do not deteriorate.

That is, for increasing the mechanical strength through precipitation strengthening or for inclusion control and precipitation refinement to improve local deformability, the steel sheet according to the embodiment may further contain one or more selected from a group consisting of Ti, Nb, B, Mg, REM, Ca, Mo, Cr, V, W, Cu, Ni, Co, Sn, Zr, and As which are elements used in the related art. For precipitation strengthening, it is effective to produce fine carbon nitride and to add Ti, Nb, V, or W. In addition, Ti, Nb, V or W is a solid element and has an effect of contributing to grain refining.

In order to obtain the effect of precipitation strengthening by the addition of Ti, Nb, V, or W, it is preferable that a content [Ti] of Ti be greater than or equal to 0.001%; a content [Nb] of Nb be greater than or equal to 0.001%; a content [V] of V be greater than or equal to 0.001%; and a content [W] of W be greater than or equal to 0.001%. When precipitation is particularly necessary, it is more preferable that the content [Ti] of Ti be greater than or equal to 0.01%; the content [Nb] of Nb is greater than or equal to 0.005%; the content [V] of V is greater than or equal to 0.01%; and the content [W] of W be greater than or equal to 0.01%. Furthermore, Ti and Nb also have an effect of improving material properties through mechanisms other than precipitation strengthening, such as carbon or nitrogen fixation, structure control, and fine grain strengthening. In addition, V is effective for precipitation strengthening, has a smaller amount of deterioration in local deformability by the addition thereof than that of Mo or Cr, and is effective when high strength and superior hole expansibility and bendability are necessary. However, even when these elements are excessively added, an increase in strength is saturated, recrystallization after hot rolling is suppressed, and there are problems in crystal orientation control. Therefore, it is preferable that the contents [Ti] and [Nb] of Ti and Nb be less than or equal to 0.20%; and the contents [V] and [W] of V and W be less than or equal to 1.0%. However, when elongation is particularly necessary, it is more preferable that the content [V] of V be less than or equal to 0.50%; and the content [W] of W be less than or equal to 0.50%.

When it is desired that strength is secured by increasing the hardenability of a structure and controlling a second phase, it is effective to add one or two or more selected from a group consisting of B, Mo, Cr, Cu, Ni, Co, Sn, Zr, and As. Furthermore, in addition to the above-described effects, B has an effect of improving material properties through mechanisms other than the above-described mechanism, such as carbon or nitrogen fixation, precipitation strengthening, and fine grain strengthening. In addition, Mo and Cr have an effect of improving material properties in addition to the effect of improving the mechanical strength.

In order to obtain these effects, it is preferable that a content [B] of B is greater than or equal to 0.0001%; a content [Mo] of Mo, a content [Cr] of Cr, a content [Ni] of Ni, and a content [Cu] of Cu is greater than or equal to 0.001%; and a content [Co] of Co, a content [Sn] of Sn, a content [Zr] of Zr, and a content [As] of As is greater than or equal to 0.0001%. However, conversely, since excessive addition thereof impairs workability, it is preferable that the upper limit of the content [B] of B is set to 0.0050%; the upper limit of the content [Mo] of Mo is set to 2.0%; the upper limits of the content [Cr] of Cr, the content [Ni] of Ni, and the content [Cu] of Cu is set to 2.0%; the upper limit of the content [Co] of Co is set to 1.0%; the upper limits of the content [Sn] of Sn and the content [Zr] of Zr is set to 0.2%; and the upper limit of the content [As] of As is set to 0.50%. When workability is strongly and particularly required, it is preferable that the upper limit of the content [B] of B is set to 0.005%; and the upper limit of the content [Mo] of Mo is set to 0.50%. In addition, from the viewpoint of cost, it is more preferable that B, Mo, Cr, or As is selected from the above-described addition elements.

Mg, REM, and Ca are important addition elements for making inclusions harmless and further improving local deformability. In order to obtain these effects, the lower limits of contents [Mg], [REM], and [Ca] are set to 0.0001%, respectively. However, when it is necessary that the forms of inclusions are controlled, it is preferable that the contents are greater than or equal to 0.0005%, respectively. On the other hand, since an excess addition thereof leads to deterioration in cleanliness, the upper limit of the content [Mg] of Mg is set to 0.010%, the upper limit of the content [REM] of REM is set to 0.1%, and the upper limit of the content [Ca] of Ca is set to 0.010%.

Even when the hot-rolled steel sheet according to the embodiment is subjected to any surface treatment, the improvement effect of local deformability does not disappear. Even when the hot-rolled steel sheet according to the embodiment is subjected to electroplating, hot dip plating, deposition plating, organic coating forming, film laminating, a treatment with an organic salt/an inorganic salt, and a non-chromium treatment, the effects of the invention can be obtained.

Next, a method of producing a hot-rolled steel sheet according to an embodiment of the present invention will be described.

In order to realize superior elongation and local deformability, it is important that a texture having predetermined pole densities is formed; and the conditions for rC and r30 are satisfied. Furthermore, it is more preferable that the conditions for the grain unit (volume average grain size), the coarse particle area ratio, the equiaxial property, the homogenization, and the suppression of excessive hardening of ferrite be satisfied. Production conditions for satisfying these conditions will be described below in detail.

A production method which is performed before hot rolling is not particularly limited. That is, an ingot may be prepared using a blast furnace, an electric furnace, or the like; various kinds of secondary smelting may be performed; and casting may be performed with a method such as normal continuous casting, ingot casting, or thin slab casting. In the case of continuous casting, a cast slab may be cooled to a low temperature once and heated again for hot rolling; or may be hot-rolled after casting without cooling the cast slab to a low temperature. As a raw material, scrap may be used.

The hot-rolled steel sheet according to the embodiment is obtained using the above-described components of the steel when the following requirements are satisfied.

In order to satisfy the above-described predetermined values of rC of 0.70 or greater and r30 of 1.10 or less, an austenite grain size after rough rolling, that is, before finish rolling is important. Therefore, the austenite grain size before finish rolling is controlled to be less than or equal to 200 μm. By reducing the austenite grain size before finish rolling, elongation and local deformability can be improved.

Figure 3:
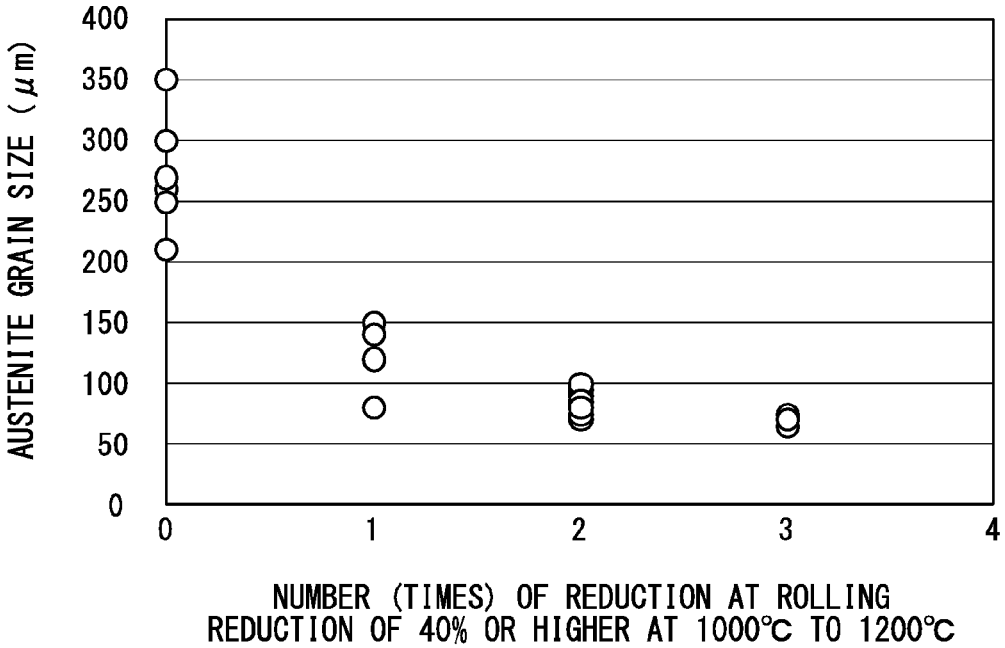
FIG. 3 is a diagram illustrating a relationship between the number of rolling at a rolling reduction of 40% or higher and an austenite grain size in rough rolling (first hot rolling) according to an embodiment of the present invention.

In order to control the austenite grain size before finish rolling to be less than or equal to 200 μm, as illustrated in FIG. 3, it is necessary that rough rolling (first hot rolling) is performed in a temperature range of 1000° C. to 1200° C.; and reduction is performed at least once in the temperature range at a rolling reduction of 40% or higher.

Furthermore, in order to improve local deformability by controlling rL and r60 to promote the recrystallization of austenite during subsequent finish rolling, the austenite grain size before finish rolling is preferably less than or equal to 100 μm. To that end, it is preferable that the reduction be performed two or more times at a rolling reduction of 40% in the first hot rolling. As the rolling reduction is larger and the number of reduction is more, the austenite grain size becomes smaller. However, when the rolling reduction is larger than 70% or when rough rolling is performed more than 10 times, there are concerns about a reduction in temperature and excessive production of scales.

The reason why the refinement of the austenite grain size affects local deformability is considered to be that an austenite grain boundary after rough rolling, that is, before finish rolling functions as a recrystallization nucleus during finish rolling.

In order to confirm the austenite grain size after rough rolling, it is preferable that the steel sheet before finish rolling be cooled as rapidly as possible. The steel sheet is cooled at a cooling rate of 10° C./s or higher, a structure of a cross-section of the steel sheet is etched to make the austenite grain boundary stand out, and the measurement is performed using an optical microscope. At this time, 20 or more visual fields are measured with an image analysis or point counting method at a magnification of 50 times or more.

In order to control the average value of pole densities of the orientation group {100}<011> to {223}<110> and the pole density of the crystal orientation {332}<113> in the thickness center portion of a thickness range of ⅝ to ⅜ from the surface of the steel sheet, to the above-described ranges, during finish rolling after rough rolling, based on a temperature T1 determined by components of the steel sheet according to the following expression 2, a process (second hot rolling) in which a rolling reduction is large in a temperature range of (T1+30)° C. to (T1+200)° C. (preferably, (T1+50)° C. to (T1+100)° C.) is performed; and a process (third hot rolling) in which a rolling reduction is low in a temperature range of T1° C. to less than (T1+30)° C. is performed. In the above-described configuration, the local deformability and shape of a final hot-rolled product can be secured.

$$T1=850+10\times([C]+[N])\times[Mn]+350\times[Nb]+250\times[Ti]+40\times[B]+10\times[Cr]+100\times[Mo]+100\times[V] \quad \text{(Expression 2)}$$

In the expression 2, the amount of a chemical element which is not contained in the steel sheet is calculated as 0%.

Figure 4:
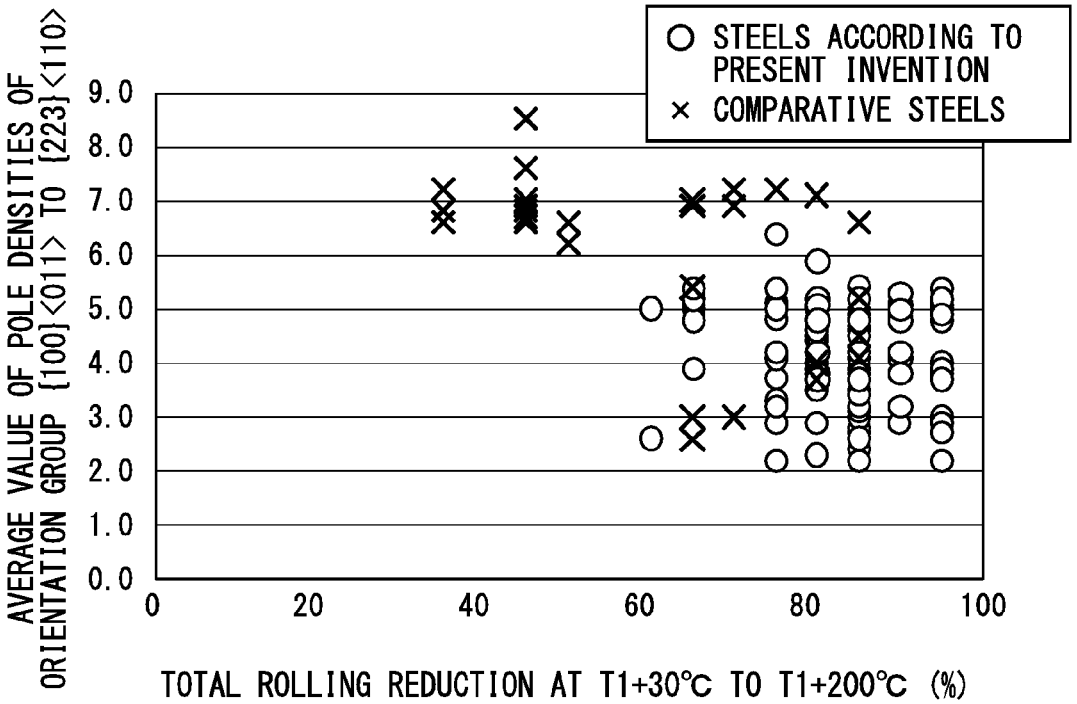
FIG. 4 is a diagram illustrating a relationship between a total rolling reduction in a temperature range of (T1+30)° C. to (T1+200)° C. and an average value of pole densities of an orientation group {100}<011> to {223}<110> in a hot-rolled steel sheet according to an embodiment of the present invention.
Figure 5:
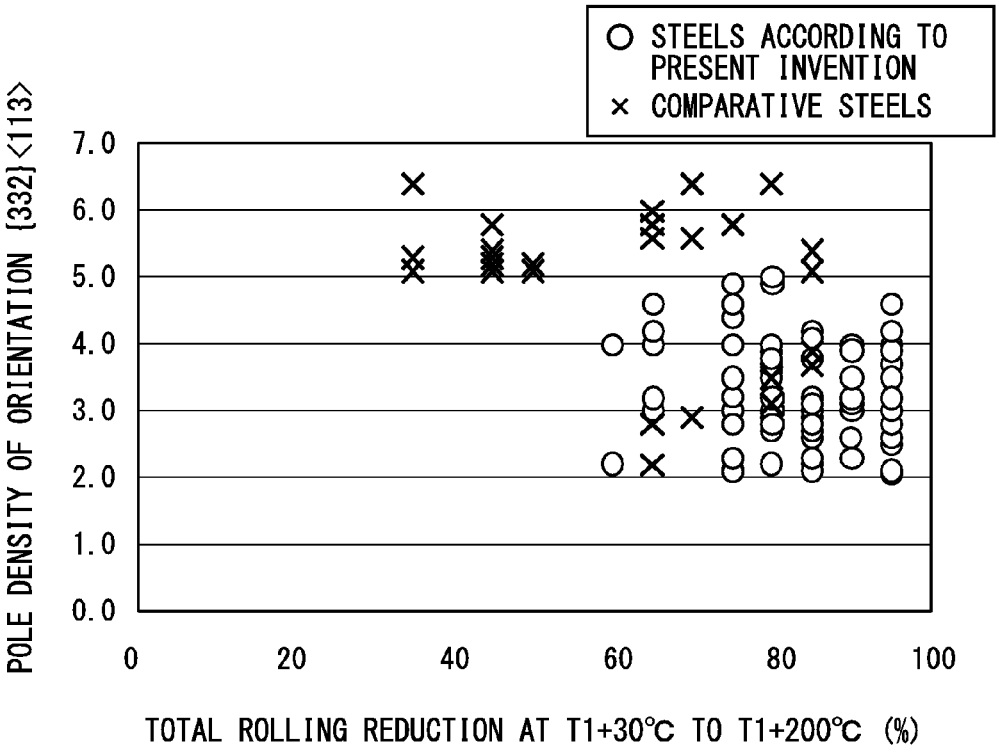
FIG. 5 is a diagram illustrating a relationship between a total rolling reduction in a temperature range of (T1+30)° C. to (T1+200)° C. and a pole density of a crystal orientation {332}<113> in a hot-rolled steel sheet according to an embodiment of the present invention.

That is, as illustrated in FIGS. 4 and 5, the large reduction in the temperature range of (T1+30)° C. to (T1+200)° C. and the small reduction in the temperature range of T1° C. to less than (T1+30)° C. control the average value of pole densities of the orientation group {100}<011> to {223}<110> and the pole density of the crystal orientation {332}<113> in the thickness center portion of a thickness range of ⅝ to ⅜ from the surface of the steel sheet; and significantly improves the local deformability of the hot-rolled steel sheet.

This temperature T1 was empirically obtained. The present inventors experimentally found that recrystallization was promoted in an austenite range of each steel based on the temperature T1.

In order to obtain superior local deformability, it is important that strain is made accumulate by the large reduction (second hot-rolling) in the temperature range of (T1+30)° C. to (T1+200)° C.; or that recrystallization is repeatedly performed at each reduction. For the strain accumulation, it is necessary that a total rolling reduction in this temperature range is higher than or equal to 50%. The total rolling reduction is preferably higher than or equal to 70%. On the other hand, a total rolling reduction of higher than 90% is not preferable from the viewpoint of temperature maintenance and excessive rolling loads. Furthermore, in order to increase the homogeneity of the hot-rolled sheet and increase the elongation and local deformability to the maximum, it is preferable that reduction be performed at a rolling reduction of 30% or higher in at least one pass of the rolling (second hot rolling) in the temperature range of (T1+30)° C. to (T1+200)° C. The rolling reduction is more preferably higher than or equal to 40%. On the other hand, when the rolling reduction is larger than 70% in one pass, there is a concern about shape defects. When higher workability is required, it is more preferable that the rolling reduction is higher than or equal to 30% in final two passes of the second hot rolling process.

In order to promote uniform recrystallization by releasing accumulated strain, it is necessary that, after the large reduction in the temperature range of (T1+30)° C. to (T1+200)° C., the processing amount of the rolling (third hot rolling) in the temperature range of T1° C. to less than (T1+30)° C. is suppressed to the minimum. Therefore, the total rolling reduction in the temperature range of T1° C. to less than (T1+30)° C. be controlled to be lower than or equal to 30%. From the viewpoint of the shape of the sheet, a rolling reduction of 10% or higher is preferable; however, when local deformability is emphasized, a rolling reduction of 0% is more preferable. When the rolling reduction in the temperature range of T1° C. to less than (T1+30)° C. is out of the predetermined range, recrystallized austenite grains are grown and local deformability deteriorates.

As described above, under the production conditions according to the embodiment, local deformability such as hole expansibility or bendability is improved. Therefore, it is important that the texture of a hot-rolled production is controlled by uniformly and finely recrystallizing austenite during finish rolling.

When reduction is performed at a lower temperature than the specified temperature range or when a rolling reduction is larger than the specified rolling reduction, the texture of austenite is grown. As a result, in a finally obtained hot-rolled steel sheet, it is not possible to obtain the average value of pole densities of the orientation group {100}<011> to {223}<110>, which is equal to or less than 5.0; and the pole density of the crystal orientation {332}<113>, which is equal to or less than 4.0, in the thickness center portion of a thickness range of ⅝ to ⅜ from the surface of the steel sheet. That is, the pole densities of the respective crystal orientations are not obtained.

On the other hand, when reduction is performed at a higher temperature than the predetermined temperature range or when a rolling reduction is lower than the specified rolling reduction, problems of coarse crystal grain and duplex grains may occur. As a result, the area ratio of coarse crystal grains having a grain size of greater than 35 μM and the volume average grain size are increased. Regarding whether or not the above-described predetermined reduction is performed or not, the rolling reduction can be confirmed by the actual results or calculation from rolling load, sheet thickness measurement, and the like. In addition, the temperature can also be measured when there is a thermometer between stands or can be obtained from a line speed, a rolling reduction, or the like by a calculation simulation in consideration of deformation heating and the like. Therefore, the temperature can be obtained in either or both of the methods.

Hot rolling performed as described above is finished at a temperature of T1° C. or higher. When the end temperature of hot rolling is lower than T1° C., rolling is performed in a non-recrystallized region and anisotropy is increased. Therefore, local deformability significantly deteriorates.

When a pass of a rolling reduction of 30% or higher in a temperature range of (T1+30)° C. to (T1+200)° C. is defined as a large reduction pass, it is necessary that a waiting time t (second) from the finish of a final pass of the large reduction pass to the start of primary cooling, which is performed between rolling stands, satisfies the following expression 3. Cooling after the final pass greatly affects the austenite grain size. That is, cooling after the final pass greatly affects the equiaxial grain fraction and coarse grain area ratio of the steel sheet.

$$t \leq 2.5 \times t1 \quad \text{(Expression 3)}$$

In the expression 3, t1 is represented by the following expression 4.

$$t1 = 0.001 \times ((Tf - T1) \times P1/100)^2 - 0.109 \times ((Tf - T1) \times P1/100) + 3.1 \quad \text{(Expression 4)}$$

When the waiting time t is longer than the value of t1×2.5, recrystallization is almost completed. In addition, the crystal grains are significantly grown, coarse grains are formed, and the r values and elongation deteriorate.

By further limiting the waiting time t to be shorter than t1, the growth of crystal grains can be suppressed to a large degree. In the case of a hot-rolled sheet having the components according to the embodiment, the volume average grain size can be controlled to be less than or equal to 15 μm. Therefore, even if recrystallization does not sufficiently advance, the elongation of the steel sheet can be sufficiently improved and fatigue properties can be improved.

In addition, by further limiting the waiting time t to be t1 to 2.5×t1, although the volume average grain size of crystal grains is higher than, for example, 15 μm, recrystallization sufficiently advances and crystal orientations are random. Therefore, the elongation of the steel sheet can be sufficiently improved and the isotropy can be significantly improved at the same time.

When an increase in the temperature of the steel sheet is very low in the temperature range of (T1+30)° C. to (T1+200)° C.; and the predetermined roll reduction is not obtained in the temperature range of (T1+30)° C. to (T1+200)° C., recrystallization is suppressed at the same time.

When rL and r60 are 0.70 to 1.10, respectively, in the state where the pole densities, rC, and r30 are in the predetermined ranges, the expression of sheet thickness/minimum bending radius ≥2.0 is satisfied. To that end, it is preferable that an increase in the temperature of the steel sheet between passes during the reduction in the temperature range of (T1+30)° C. to (T1+200)° C. is suppressed to be lower than or equal to 18° C. in a state where the waiting time until the start of the primary cooling is in the above-described range.

When the increase in the temperature of the steel sheet between passes in the temperature range of (T1+30)° C. to (T1+200)° C. is lower than or equal to 18° C.; and the waiting time t satisfies the above-described expression 3, uniformly recrystallized austenite in which rL and r60 are 0.70 to 1.10 can be obtained.

It is preferable that a cooling temperature change, which is a difference between a steel sheet temperature at the time of the start of cooling and a steel sheet temperature at the time of the finish of cooling in the primary cooling, is 40° C. to 140° C.; and the steel sheet temperature at the time of the finish of cooling in the primary cooling is lower than or equal to (T1+100)° C. When the cooling temperature change is greater than or equal to 40° C., the coarsening of austenite grains can be suppressed. When the cooling temperature change is less than 40° C., the effect cannot be obtained. On the other hand, when the cooling temperature change is greater than 140° C., recrystallization is insufficient and thus it is difficult to obtain the desired random texture. In addition, it is difficult to obtain a ferrite phase which is effective for elongation, and since the hardness of the ferrite phase is increased, elongation and local deformability deteriorate. In addition, when the steel sheet temperature at the time of the finish of cooling is higher than (T1+100)° C., the effects of cooling cannot be sufficiently obtained. The reason is as follows: for example, even when the primary cooling is performed under appropriate conditions after the final pass, if the steel sheet temperature after the primary cooling is higher than (T1+100)° C., there is a concern about crystal grain growth; and the austenite grain size may be significantly coarsened.

A cooling pattern after passing through a finishing mill is not particularly limited. Even when cooling patterns for performing structure controls suitable for the respective purposes are adopted, the effects of the present invention can be obtained. For example, after the primary cooling in order to further suppress the coarsening of the austenite grains, secondary cooling may be performed after passing through a final rolling stand of the finishing mill. When the secondary cooling is performed after the primary cooling, it is preferable that the secondary cooling is performed within 10 seconds from the finish of the primary cooling. When the time exceeds 10 seconds, the effect of suppressing the coarsening of the austenite grains cannot be obtained.

Figure 9:
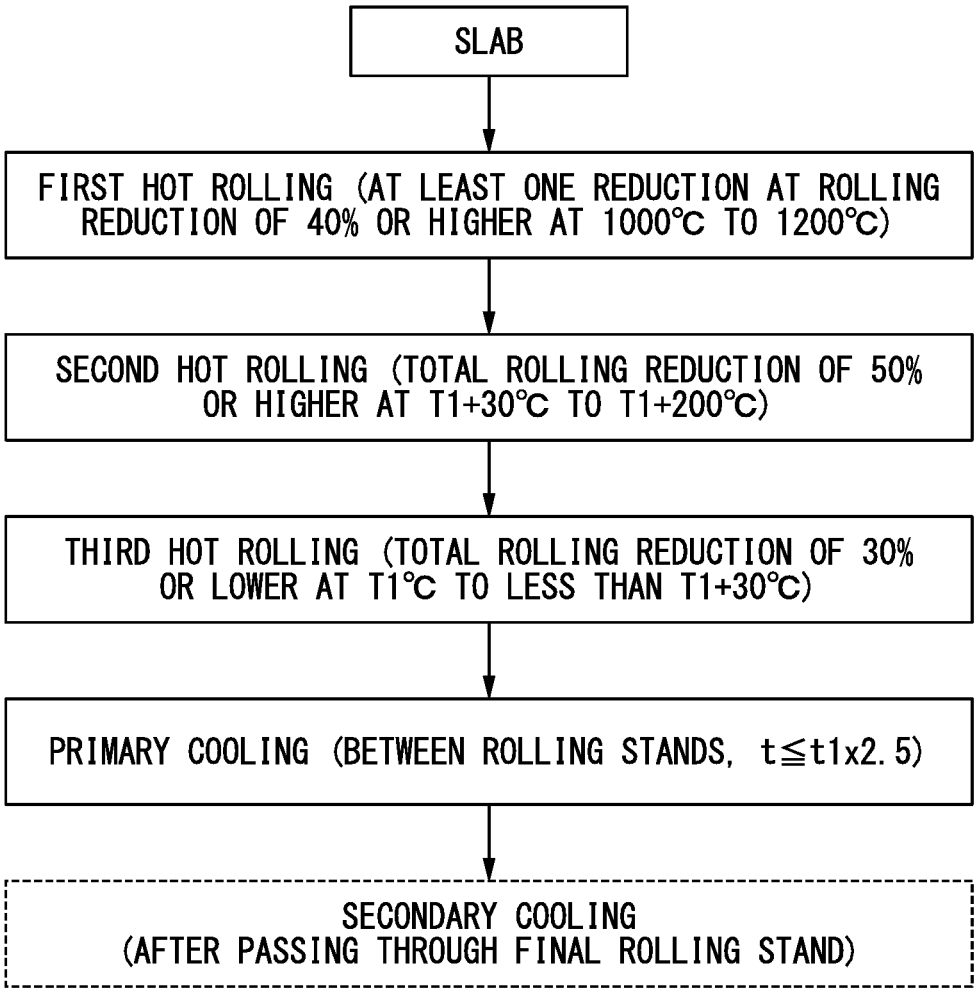
FIG. 9 is a flowchart illustrating a method of producing a hot-rolled steel sheet according to an embodiment of the present invention.

The production method according to the embodiment is shown using a flowchart of FIG. 9.

As described above, in the embodiment, it is important that the first hot rolling, the second hot rolling, the third hot rolling, and the primary cooling are performed under the predetermined conditions.

During hot rolling, after rough rolling, a sheet bar may be joined and finish rolling may be continuously performed. At this time, a rough bar may be temporarily wound in the coil state, may be stored in a cover having, optionally, a heat insulation function, may be unwound again, and may be joined. In addition, after hot rolling, winding may be performed.

After cooling, the hot-rolled steel sheet may be optionally subjected to skin pass rolling. Skin pass rolling has effects of preventing stretcher strain, generated in machining fabrication, and correcting the shape.

The structure of the hot-rolled steel sheet obtained in the embodiment may contain ferrite, pearlite, bainite, martensite, austenite, and compounds such as carbon nitrides. However, since pearlite impairs local ductility, a content thereof is preferably less than or equal to 5%.

The hot-rolled steel sheet according to the embodiment is applicable not only to bending but to bending, stretching, drawing, and combined forming in which bending is mainly performed.

EXAMPLES

Technical details of the hot-rolled steel sheet according to the present invention will be described using Examples according to the present invention. FIGS. 1 to 8 are graphs of the following examples.

Results of investigation using steels A to AN and steels a to k as examples, which have chemical compositions as shown in Tables 1 to 3, will be described.

[Table 1]

[Table 2]

[Table 3]

These steels was casted; was reheated without any treatment or after being cooled to room temperature; was heated to a temperature of 1000° C. to 1300° C.; and was subjected to hot rolling under conditions shown in Tables 4 to 18. Hot rolling was finished at T1° C. or higher and cooling was performed under conditions shown in Tables 4 to 18. Finally, hot-rolled steel sheets having a thickness of 2 mm to 5 mm were obtained.

[Table 4]

[Table 5]

[Table 6]

[Table 7]

[Table 8]

[Table 9]

[Table 10]

[Table 11]

[Table 12]

[Table 13]

[Table 14]

[Table 15]

[Table 16]

[Table 17]

[Table 18]

The chemical components of each steel are shown in Tables 1 to 3, and production conditions and mechanical properties of each steel are shown in Tables 4 to 18.

As indices of local deformability, a hole expansion ratio λ and a limit bending radius (sheet thickness/minimum bending radius) obtained by 90° V-shape bending were used. In a bending test, bending in the C direction and bending in the 45° direction were performed, and a ratio thereof was used as an index of orientation dependency (isotropy) of formability. A tensile test and the bending test were performed according to JIS Z2241 and JIS Z2248 (V block 90° bending test), and a hole expansion test was performed according to JFS T1001. In a thickness center position of a thickness range of ⅝ to ⅜ of a cross-section parallel to a rolling direction, the pole densities were measured at a ¼ position from an end portion in a transverse direction using the above-described EBSP method at pitches of 0.5 μm. In addition, the r values in the respective directions and the volume average grain size were measured according to the above-described methods.

Figure 6:
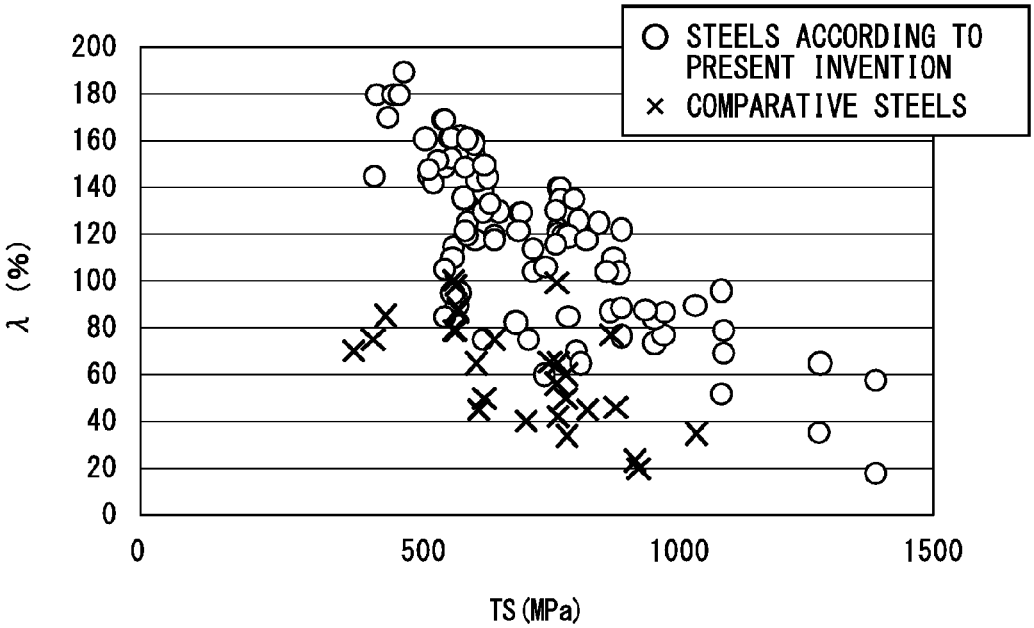
FIG. 6 is a diagram illustrating a relationship between the strength and the hole expansibility of a hot-rolled steel sheet according to an embodiment of the present invention and a comparative steel.
Figure 7:
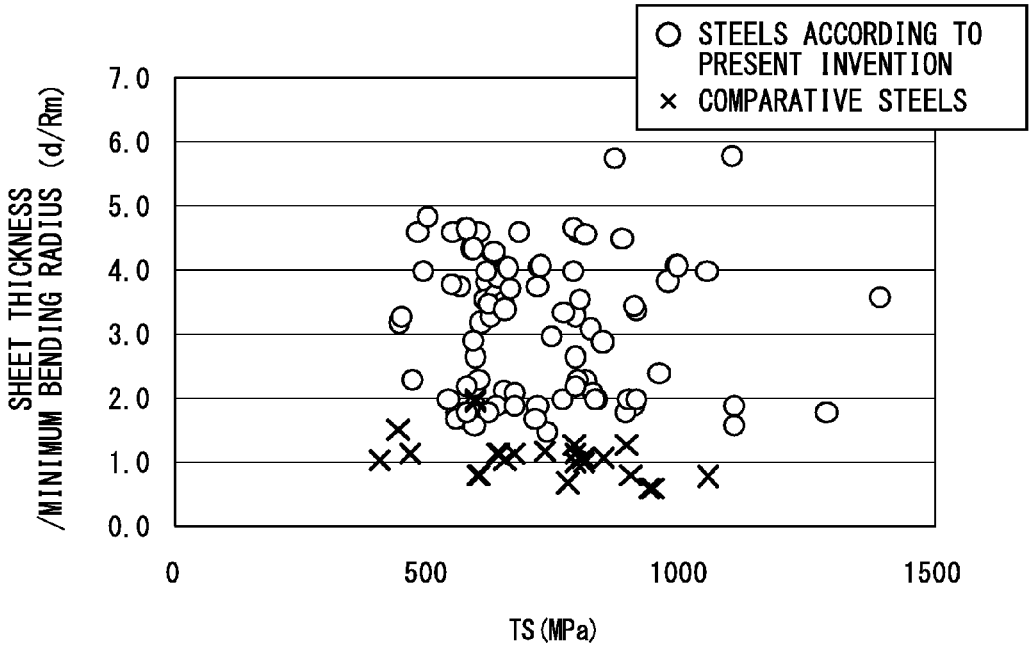
FIG. 7 is a diagram illustrating a relationship between the strength and bendability of a hot-rolled steel sheet according to an embodiment of the present invention and a comparative steel.
Figure 8:
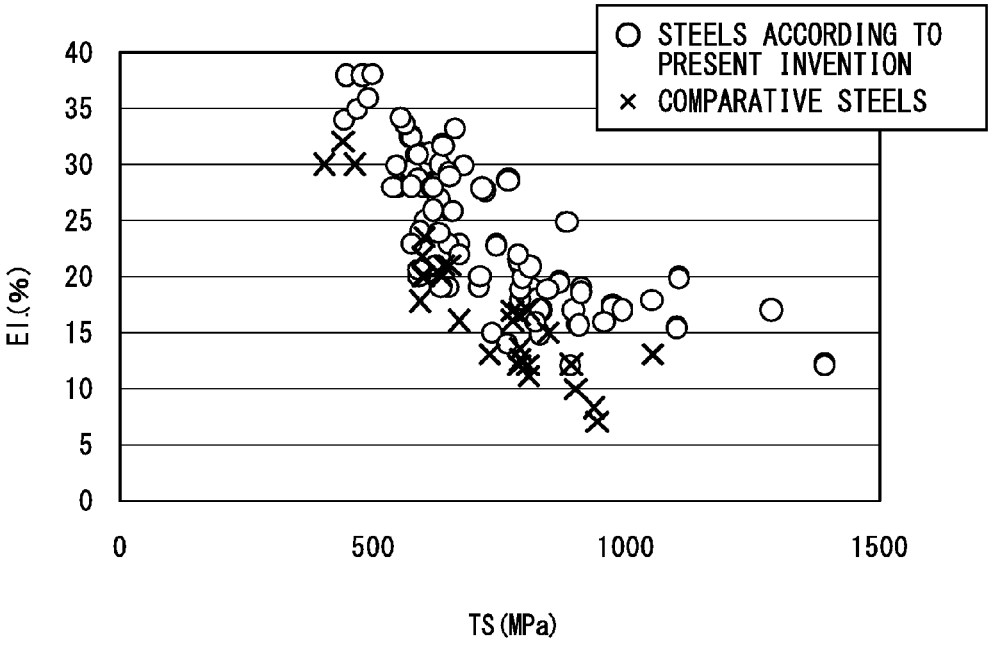
FIG. 8 is a diagram illustrating a relationship between the strength and elongation of a hot-rolled steel sheet according to an embodiment of the present invention and a comparative steel.

In a fatigue test, a specimen for a plane bending fatigue test having a length of 98 mm, a width of 38 mm, a width of a minimum cross-sectional portion of 20 mm, and a bending radius of a notch of 30 mm, was cut out from a final product. The product was tested in a completely reversed plane bending fatigue test without any processing for a surface. Fatigue properties of the steel sheet were evaluated using a value (fatigue limit ratio σW/σB) obtained by dividing a fatigue strength σW at $2\times10^6$ times by a tensile strength σB of the steel sheet For example, as illustrated in FIGS. 6, 7, and 8, the steels, which satisfied the requirements according to the present invention, had superior hole expansibility and bendability and elongation. Furthermore, when the production conditions were in the preferable ranges, the steels showed higher hole expansibility, bendability, isotropy, fatigue properties, and the like.

INDUSTRIAL APPLICABILITY

As described above, according to the present invention, a hot-rolled steel sheet can be obtained in which a main structure configuration is not limited; local deformability is superior by controlling the size and form of crystal grains and controlling a texture; and the orientation dependence of formability is low. Accordingly, the present invention is highly applicable in the steel industry.

In addition, generally, as the strength is higher, the formability is reduced. Therefore, the effects of the present invention are particularly high in the case of a high-strength steel sheet.

TABLE 1

| STEEL | T1 (° C.) | C | Si | Mn | P | S | Al | N | wt % O |
|---|---|---|---|---|---|---|---|---|---|
| A | 851 | 0.070 | 0.08 | 1.30 | 0.015 | 0.004 | 0.040 | 0.0026 | 0.0032 |
| B | 851 | 0.070 | 0.08 | 1.30 | 0.015 | 0.004 | 0.040 | 0.0026 | 0.0032 |
| C | 865 | 0.080 | 0.31 | 1.35 | 0.012 | 0.005 | 0.016 | 0.0032 | 0.0023 |
| D | 865 | 0.080 | 0.31 | 1.35 | 0.012 | 0.005 | 0.016 | 0.0032 | 0.0023 |
| E | 858 | 0.060 | 0.87 | 1.20 | 0.009 | 0.004 | 0.038 | 0.0033 | 0.0026 |
| F | 858 | 0.060 | 0.30 | 1.20 | 0.009 | 0.004 | 0.500 | 0.0033 | 0.0026 |
| G | 865 | 0.210 | 0.15 | 1.62 | 0.012 | 0.003 | 0.026 | 0.0033 | 0.0021 |
| H | 865 | 0.210 | 1.20 | 1.62 | 0.012 | 0.003 | 0.026 | 0.0033 | 0.0021 |
| I | 861 | 0.035 | 0.67 | 1.88 | 0.015 | 0.003 | 0.045 | 0.0028 | 0.0029 |
| J | 896 | 0.035 | 0.67 | 1.88 | 0.015 | 0.003 | 0.045 | 0.0028 | 0.0029 |
| K | 875 | 0.180 | 0.48 | 2.72 | 0.009 | 0.003 | 0.050 | 0.0036 | 0.0022 |
| L | 892 | 0.180 | 0.48 | 2.72 | 0.009 | 0.003 | 0.050 | 0.0036 | 0.0022 |
| M | 892 | 0.060 | 0.11 | 2.12 | 0.010 | 0.005 | 0.033 | 0.0028 | 0.0035 |
| N | 886 | 0.060 | 0.11 | 2.12 | 0.010 | 0.005 | 0.033 | 0.0028 | 0.0035 |
| O | 903 | 0.040 | 0.13 | 1.33 | 0.010 | 0.005 | 0.038 | 0.0032 | 0.0026 |
| P | 903 | 0.040 | 0.13 | 1.33 | 0.010 | 0.010 | 0.038 | 0.0036 | 0.0029 |
| Q | 852 | 0.300 | 1.20 | 0.50 | 0.008 | 0.003 | 0.045 | 0.0028 | 0.0029 |
| R | 852 | 0.260 | 1.80 | 0.80 | 0.008 | 0.003 | 0.045 | 0.0028 | 0.0022 |
| S | 851 | 0.060 | 0.30 | 1.30 | 0.080 | 0.002 | 0.030 | 0.0032 | 0.0022 |
| T | 853 | 0.200 | 0.21 | 1.30 | 0.010 | 0.002 | 1.400 | 0.0032 | 0.0035 |

TABLE 1-continued

| STEEL | T1 (° C.) | C | Si | Mn | P | S | Al | N | O (wt %) |
|---|---|---|---|---|---|---|---|---|---|
| U | 880 | 0.035 | 0.021 | 1.30 | 0.010 | 0.002 | 0.035 | 0.0023 | 0.0033 |
| V | 868 | 0.150 | 0.61 | 2.20 | 0.011 | 0.002 | 0.028 | 0.0021 | 0.0036 |
| W | 851 | 0.080 | 0.20 | 1.56 | 0.006 | 0.002 | 0.800 | 0.0035 | 0.0045 |
| X | 850 | 0.0021 | 1.20 | 2.50 | 0.010 | 0.003 | 0.033 | 0.0033 | 0.0021 |
| Y | 850 | 0.014 | 0.95 | 2.20 | 0.008 | 0.005 | 0.038 | 0.0033 | 0.0021 |
| Z | 852 | 0.060 | 0.003 | 2.60 | 0.008 | 0.005 | 0.038 | 0.0033 | 0.0021 |
| AA | 852 | 0.060 | 0.052 | 2.70 | 0.120 | 0.005 | 0.038 | 0.0028 | 0.0029 |
| AB | 850 | 0.060 | 1.40 | 0.01 | 0.010 | 0.005 | 0.045 | 0.0028 | 0.0029 |
| AC | 850 | 0.040 | 1.90 | 0.22 | 0.010 | 0.005 | 0.045 | 0.0028 | 0.0029 |
| AD | 851 | 0.065 | 0.09 | 1.35 | 0.008 | 0.003 | 0.035 | 0.0022 | 0.0026 |
| AE | 864 | 0.082 | 0.23 | 1.40 | 0.011 | 0.002 | 0.021 | 0.0036 | 0.0027 |
| AF | 857 | 0.058 | 0.89 | 1.25 | 0.007 | 0.002 | 0.039 | 0.0042 | 0.0041 |
| AG | 871 | 0.211 | 0.09 | 1.65 | 0.011 | 0.003 | 0.032 | 0.0038 | 0.0029 |
| AH | 860 | 0.038 | 0.58 | 1.91 | 0.012 | 0.003 | 0.045 | 0.0032 | 0.0038 |
| AI | 869 | 0.174 | 0.49 | 2.81 | 0.009 | 0.003 | 0.046 | 0.0029 | 0.0021 |
| AJ | 896 | 0.064 | 1.15 | 2.45 | 0.010 | 0.003 | 0.034 | 0.0032 | 0.0035 |
| AK | 894 | 0.045 | 0.11 | 1.35 | 0.010 | 0.003 | 0.035 | 0.0041 | 0.0035 |
| AL | 861 | 0.165 | 0.65 | 2.35 | 0.008 | 0.0005 | 0.015 | 0.0023 | 0.0025 |
| AM | 864 | 0.054 | 1.05 | 2.05 | 0.004 | 0.0006 | 0.019 | 0.0022 | 0.0022 |
| AN | 877 | 0.0002 | 0.05 | 1.75 | 0.090 | 0.0005 | 0.032 | 0.0018 | 0.0024 |
| a | 855 | 0.410 | 0.52 | 1.33 | 0.011 | 0.003 | 0.045 | 0.0026 | 0.0019 |
| b | 1376 | 0.072 | 0.15 | 1.42 | 0.014 | 0.004 | 0.036 | 0.0022 | 0.0025 |
| c | 851 | 0.110 | 0.23 | 1.12 | 0.021 | 0.003 | 0.026 | 0.0025 | 0.0023 |
| d | 1154 | 0.250 | 0.23 | 1.56 | 0.024 | 0.120 | 0.034 | 0.0022 | 0.0023 |
| e | 851 | 0.090 | 3.00 | 1.00 | 0.008 | 0.040 | 0.036 | 0.0035 | 0.0022 |
| f | 854 | 0.070 | 0.21 | 5.00 | 0.008 | 0.002 | 0.033 | 0.0023 | 0.0036 |
| g | 855 | 0.350 | 0.52 | 1.33 | 0.190 | 0.003 | 0.045 | 0.0026 | 0.0019 |
| h | 855 | 0.370 | 0.48 | 1.34 | 0.310 | 0.005 | 0.036 | 0.0035 | 0.0021 |
| i | 1446 | 0.074 | 0.14 | 1.45 | 0.012 | 0.004 | 0.038 | 0.0025 | 0.0026 |
| j | 852 | 0.120 | 0.18 | 1.23 | 0.020 | 0.003 | 0.032 | 0.0026 | 0.0027 |
| k | 1090 | 0.245 | 0.21 | 1.65 | 0.024 | 0.110 | 0.034 | 0.0022 | 0.0023 |

TABLE 2

| STEEL | Ti | Nb | B | Mg | Rem | Ca | Mo | Cr | W (wt %) |
|---|---|---|---|---|---|---|---|---|---|
| A | — | — | — | — | — | — | — | — | — |
| B | — | — | 0.0050 | — | — | — | — | — | — |
| C | — | 0.041 | — | — | — | — | — | — | — |
| D | — | 0.041 | — | — | — | 0.002 | — | — | — |
| E | — | 0.021 | — | — | 0.0015 | — | — | — | — |
| F | — | 0.021 | — | — | 0.0015 | — | — | — | — |
| G | 0.021 | — | 0.0022 | — | — | — | 0.03 | 0.35 | — |
| H | 0.021 | — | 0.0022 | — | — | — | 0.03 | 0.35 | — |
| I | — | 0.021 | — | 0.002 | — | 0.0015 | — | — | — |
| J | 0.14 | 0.021 | — | 0.002 | — | 0.0015 | — | — | — |
| K | — | — | — | 0.002 | — | — | 0.1 | — | — |
| L | — | 0.050 | — | 0.002 | — | 0.002 | 0.1 | — | — |
| M | 0.036 | 0.089 | 0.0012 | — | — | — | — | — | — |
| N | 0.089 | 0.036 | 0.0012 | — | — | — | — | — | — |
| O | 0.042 | 0.121 | 0.0009 | — | — | — | — | — | — |
| P | 0.042 | 0.121 | 0.0009 | — | 0.004 | — | — | — | — |
| Q | — | — | — | — | — | — | — | — | 0.1 |
| R | — | — | — | — | — | — | — | — | — |
| S | — | — | — | — | — | — | — | — | — |
| T | — | — | — | — | — | — | — | — | — |
| U | 0.12 | — | — | — | — | — | — | — | — |
| V | 0.06 | — | — | — | — | — | — | — | — |
| W | — | — | — | — | — | — | — | — | — |
| X | — | — | — | — | — | — | — | — | — |
| Y | — | — | — | — | — | — | — | — | — |
| Z | — | — | — | — | — | — | — | — | — |
| AA | — | — | — | — | — | — | — | — | — |
| AB | — | — | — | — | — | — | — | — | — |
| AC | — | — | — | — | — | — | — | — | — |
| AD | — | — | — | — | — | — | — | — | — |
| AE | — | 0.037 | — | — | — | — | — | — | — |
| AF | — | 0.019 | — | — | 0.0017 | — | — | — | — |
| AG | 0.052 | — | 0.0012 | — | — | — | 0.04 | 0.02 | — |
| AH | — | 0.018 | — | 0.001 | — | 0.0017 | — | — | — |
| AI | — | — | — | 0.001 | — | — | 0.12 | — | — |
| AJ | 0.152 | 0.018 | — | — | — | — | — | — | — |
| AK | 0.05 | 0.087 | 0.0009 | — | — | — | — | — | — |

TABLE 2-continued

| STEEL | Ti | Nb | B | Mg | Rem | Ca | Mo | Cr | W (wt %) |
|---|---|---|---|---|---|---|---|---|---|
| AL | 0.03 | — | — | — | — | 0.0009 | — | — | — |
| AM | 0.015 | 0.025 | 0.0021 | — | 0.0005 | — | — | — | 0.21 |
| AN | 0.008 | 0.072 | 0.0005 | — | — | — | — | — | — |
| a | — | — | — | — | — | — | — | — | — |
| b | — | 1.5 | — | — | — | — | — | — | — |
| c | — | — | — | 0.15 | — | — | — | — | — |
| d | — | — | — | — | — | — | — | 5.0 | — |
| e | — | — | — | — | — | — | — | — | — |
| f | — | — | — | — | — | — | — | — | — |
| g | — | — | — | — | — | — | — | — | — |
| h | — | — | — | — | — | — | — | — | — |
| i | — | 1.7 | — | — | — | — | — | — | — |
| j | — | — | — | 0.21 | — | — | — | — | — |
| k | — | — | — | — | — | — | — | 4.6 | — |

TABLE 3

| STEEL | As | Cu | Ni | Co | Sn | Zr | V (wt %) | NOTE |
|---|---|---|---|---|---|---|---|---|
| A | — | — | — | — | — | — | — | STEEL ACCORDING TO PRESENT INVENTION |
| B | — | — | — | — | — | — | — | STEEL ACCORDING TO PRESENT INVENTION |
| C | — | — | — | — | — | — | — | STEEL ACCORDING TO PRESENT INVENTION |
| D | — | — | — | — | — | — | — | STEEL ACCORDING TO PRESENT INVENTION |
| E | — | — | — | — | — | — | — | STEEL ACCORDING TO PRESENT INVENTION |
| F | — | — | — | — | — | — | — | STEEL ACCORDING TO PRESENT INVENTION |
| G | — | — | — | — | — | — | — | STEEL ACCORDING TO PRESENT INVENTION |
| H | — | — | — | — | — | — | — | STEEL ACCORDING TO PRESENT INVENTION |
| I | — | — | — | — | — | — | 0.029 | STEEL ACCORDING TO PRESENT INVENTION |
| J | — | — | — | — | — | — | 0.029 | STEEL ACCORDING TO PRESENT INVENTION |
| K | — | — | — | — | — | — | 0.1 | STEEL ACCORDING TO PRESENT INVENTION |
| L | — | — | — | — | — | — | 0.1 | STEEL ACCORDING TO PRESENT INVENTION |
| M | — | — | — | — | — | — | — | STEEL ACCORDING TO PRESENT INVENTION |
| N | — | — | — | — | — | — | — | STEEL ACCORDING TO PRESENT INVENTION |
| O | — | — | — | — | — | — | — | STEEL ACCORDING TO PRESENT INVENTION |
| P | — | — | — | — | — | — | — | STEEL ACCORDING TO PRESENT INVENTION |
| Q | — | — | — | — | — | — | — | STEEL ACCORDING TO PRESENT INVENTION |
| R | — | — | — | — | — | — | — | STEEL ACCORDING TO PRESENT INVENTION |
| S | — | — | — | — | — | — | — | STEEL ACCORDING TO PRESENT INVENTION |
| T | — | — | — | — | — | — | — | STEEL ACCORDING TO PRESENT INVENTION |
| U | 0.002 | — | — | — | — | — | — | STEEL ACCORDING TO PRESENT INVENTION |
| V | — | 0.5 | 0.25 | — | — | 0.02 | — | STEEL ACCORDING TO PRESENT INVENTION |
| W | — | — | — | 0.5 | 0.02 | — | — | STEEL ACCORDING TO PRESENT INVENTION |
| X | — | — | — | — | — | — | — | STEEL ACCORDING TO PRESENT INVENTION |
| Y | — | — | — | — | — | — | — | STEEL ACCORDING TO PRESENT INVENTION |
| Z | — | — | — | — | — | — | — | STEEL ACCORDING TO PRESENT INVENTION |
| AA | — | — | — | — | — | — | — | STEEL ACCORDING TO PRESENT INVENTION |
| AB | — | — | — | — | — | — | — | STEEL ACCORDING TO PRESENT INVENTION |
| AC | — | — | — | — | — | — | — | STEEL ACCORDING TO PRESENT INVENTION |
| AD | — | — | — | — | — | — | — | STEEL ACCORDING TO PRESENT INVENTION |
| AE | — | — | — | — | — | — | — | STEEL ACCORDING TO PRESENT INVENTION |
| AF | — | — | — | — | — | — | — | STEEL ACCORDING TO PRESENT INVENTION |
| AG | — | — | — | — | — | — | — | STEEL ACCORDING TO PRESENT INVENTION |
| AH | — | — | — | — | — | — | 0.026 | STEEL ACCORDING TO PRESENT INVENTION |
| AI | — | — | — | — | — | — | 0.02 | STEEL ACCORDING TO PRESENT INVENTION |
| AJ | — | — | — | — | — | — | — | STEEL ACCORDING TO PRESENT INVENTION |
| AK | — | — | — | — | — | — | — | STEEL ACCORDING TO PRESENT INVENTION |
| AL | 0.005 | 0.03 | 0.02 | — | — | — | — | STEEL ACCORDING TO PRESENT INVENTION |
| AM | — | — | — | 0.01 | 0.015 | 0.02 | — | STEEL ACCORDING TO PRESENT INVENTION |
| AN | — | 0.01 | 0.05 | — | 0.018 | — | — | STEEL ACCORDING TO PRESENT INVENTION |
| a | — | — | — | — | — | — | — | COMPARATIVE STEEL |
| b | — | — | — | — | — | — | — | COMPARATIVE STEEL |
| c | — | — | — | — | — | — | — | COMPARATIVE STEEL |
| d | — | — | — | — | — | — | 2.5 | COMPARATIVE STEEL |
| e | — | — | — | — | — | — | — | COMPARATIVE STEEL |
| f | — | — | — | — | — | — | — | COMPARATIVE STEEL |
| g | — | — | — | — | — | — | — | COMPARATIVE STEEL |
| h | — | — | — | — | — | — | — | COMPARATIVE STEEL |
| i | — | — | — | — | — | — | — | COMPARATIVE STEEL |
| j | — | — | — | — | — | — | — | COMPARATIVE STEEL |
| k | — | — | — | — | — | — | 1.9 | COMPARATIVE STEEL |

TABLE 4

| EXAMPLE NO. | STEEL | T1 (° C.) | (1) | (2) | AUSTENITE GRAIN SIZE (μm) | (3) | (4) | (5) |
|---|---|---|---|---|---|---|---|---|
| 1 | A | 851 | 1 | 50 | 150 | 85 | 2 | 15 |
| 2 | A | 851 | 2 | 45/45 | 90 | 95 | 3 | 5 |
| 3 | A | 851 | 1 | 50 | 150 | 85 | 2 | 15 |
| 4 | A | 851 | 2 | 45/45 | 90 | 95 | 2 | 5 |
| 5 | A | 851 | 2 | 45/45 | 90 | 45 | 1 | 20 |
| 6 | B | 851 | 1 | 50 | 140 | 85 | 2 | 15 |
| 7 | B | 851 | 2 | 45/45 | 80 | 95 | 2 | 5 |
| 8 | B | 851 | 0 | — | 250 | 65 | 2 | 18 |
| 9 | C | 865 | 2 | 45/45 | 80 | 75 | 3 | 15 |
| 10 | C | 865 | 2 | 45/45 | 80 | 85 | 3 | 18 |
| 11 | C | 865 | 2 | 45/45 | 80 | 75 | 3 | 15 |
| 12 | C | 865 | 2 | 45/45 | 80 | 85 | 2 | 18 |
| 13 | C | 865 | 2 | 45/45 | 80 | 45 | 1 | 15 |
| 14 | D | 865 | 2 | 45/45 | 80 | 75 | 3 | 15 |
| 15 | D | 865 | 2 | 45/45 | 80 | 85 | 2 | 18 |
| 16 | D | 865 | 2 | 45/45 | 80 | 85 | 2 | 18 |
| 17 | E | 858 | 2 | 45/45 | 95 | 85 | 3 | 13 |
| 18 | E | 858 | 2 | 45/45 | 95 | 95 | 2 | 14 |
| 19 | D | 858 | 2 | 45/45 | 95 | 85 | 2 | 13 |
| 20 | D | 858 | 2 | 45/45 | 95 | 95 | 2 | 14 |
| 21 | D | 858 | 2 | 40/45 | 95 | 75 | 2 | 12 |
| 22 | F | 858 | 2 | 45/45 | 90 | 85 | 2 | 13 |
| 23 | F | 858 | 2 | 45/45 | 90 | 95 | 2 | 14 |
| 24 | F | 858 | 0 | — | 300 | 85 | 2 | 13 |
| 25 | G | 865 | 3 | 40/40/40 | 75 | 80 | 2 | 16 |
| 26 | G | 865 | 3 | 40/40/40 | 75 | 80 | 2 | 16 |
| 27 | G | 865 | 3 | 40/40/40 | 75 | 80 | 2 | 16 |
| 28 | H | 865 | 3 | 40/40/40 | 70 | 80 | 2 | 16 |
| 29 | I | 861 | 2 | 45/40 | 95 | 80 | 3 | 17 |
| 30 | I | 861 | 1 | 50 | 120 | 80 | 3 | 18 |
| 31 | I | 861 | 2 | 45/40 | 95 | 80 | 3 | 17 |
| 32 | I | 861 | 1 | 50 | 120 | 80 | 3 | 18 |
| 33 | I | 861 | 1 | 50 | 120 | 80 | 2 | 40 |
| 34 | J | 896 | 2 | 45/40 | 100 | 80 | 2 | 17 |
| 35 | J | 896 | 1 | 50 | 120 | 80 | 2 | 18 |
| 36 | J | 896 | 1 | 50 | 120 | 80 | 2 | 18 |
| 37 | K | 875 | 3 | 40/40/40 | 70 | 95 | 3 | 18 |
| 38 | K | 875 | 3 | 40/40/40 | 70 | 95 | 2 | 18 |
| 39 | L | 892 | 3 | 40/40/40 | 75 | 95 | 2 | 18 |
| 40 | M | 892 | 3 | 40/40/40 | 65 | 95 | 3 | 10 |
| 41 | M | 892 | 3 | 40/40/40 | 65 | 95 | 2 | 10 |
| 42 | M | 892 | 0 | — | 350 | 45 | 2 | 30 |
| 43 | N | 886 | 3 | 40/40/40 | 70 | 95 | 2 | 10 |
| 44 | O | 903 | 2 | 45/45 | 70 | 90 | 2 | 13 |
| 45 | O | 903 | 2 | 45/45 | 95 | 85 | 2 | 15 |
| 46 | O | 903 | 2 | 45/45 | 70 | 85 | 2 | 13 |
| 47 | O | 903 | 2 | 45/45 | 100 | 35 | 1 | 12 |
| 48 | P | 903 | 2 | 45/45 | 75 | 85 | 2 | 15 |
| 49 | K | 875 | 3 | 40/40/40 | 70 | 65 | 3 | 20 |
| 50 | M | 892 | 1 | 50 | 120 | 75 | 3 | 20 |
| 51 | M | 892 | 1 | 50 | 120 | 60 | 2 | 21 |
| 52 | O | 903 | 1 | 50 | 120 | 65 | 2 | 19 |
| 53 | O | 903 | 1 | 50 | 120 | 35 | 3 | 12 |
| 54 | A | 851 | 2 | 45/45 | 90 | 45 | 2 | 20 |

(1) NUMBER OF REDUCTIONS OF 40% OR HIGHER AT 1000° C. TO 1200° C.
(2) ROLLING REDUCTION (%) OF 40% OR HIGHER AT 1000° C. TO 1200° C.
(3) TOTAL ROLLING REDUCTION (%) AT T1 + 30° C. TO T1 + 200° C.
(4) NUMBER (%) OF REDUCTIONS OF 30% OR HIGHER AT T1 + 30° C. TO T1 + 200° C.
(5) TEMPERATURE INCREASE (° C.) DURING REDUCTION AT T1 + 30° C. TO T1 + 200° C.

TABLE 5

| EXAMPLE NO. | (1) | (2) | (3) | (4) | t1 | 2.5 × t1 | (5) |
|---|---|---|---|---|---|---|---|
| 1 | 10 | 935 | 40 | 45 | 0.57 | 1.41 | 0.8 |
| 2 | 0 | 892 | 35 | 60 | 1.74 | 4.35 | 2.0 |
| 3 | 20 | 935 | 40 | 45 | 0.57 | 1.41 | 1.0 |
| 4 | 25 | 892 | 35 | 60 | 1.74 | 4.35 | 2.0 |
| 5 | 0 | 930 | 30 | 25 | 1.08 | 2.69 | 1.2 |
| 6 | 0 | 935 | 40 | 45 | 0.57 | 1.42 | 1.0 |
| 7 | 10 | 891 | 35 | 60 | 1.77 | 4.44 | 2.0 |
| 8 | 0 | 850 | 30 | 35 | 3.14 | 7.84 | 3.2 |

TABLE 5-continued

| EXAMPLE NO. | (1) | (2) | (3) | (4) | t1 | 2.5 × t1 | (5) |
|---|---|---|---|---|---|---|---|
| 9 | 25 | 945 | 37 | 40 | 0.76 | 1.90 | 1.0 |
| 10 | 5 | 920 | 31 | 33 | 1.54 | 3.86 | 2.3 |
| 11 | 25 | 945 | 37 | 38 | 0.76 | 1.90 | 1.5 |
| 12 | 5 | 920 | 31 | 54 | 1.54 | 3.86 | 2.0 |
| 13 | 0 | 1075 | 30 | 25 | 0.20 | 0.50 | 0.4 |
| 14 | 0 | 950 | 37 | 38 | 0.67 | 1.67 | 1.0 |
| 15 | 10 | 922 | 31 | 54 | 1.50 | 3.74 | 2.0 |
| 16 | 20 | 922 | 31 | 54 | 1.50 | 3.74 | 0.9 |

TABLE 5-continued

| EXAMPLE NO. | (1) | (2) | (3) | (4) | t1 | 2.5 × t1 | (5) |
|---|---|---|---|---|---|---|---|
| 17 | 15 | 955 | 31 | 33 | 0.73 | 1.82 | 1.0 |
| 18 | 0 | 934 | 40 | 45 | 0.71 | 1.78 | 1.0 |
| 19 | 0 | 955 | 31 | 54 | 0.73 | 1.82 | 1.0 |
| 20 | 10 | 935 | 40 | 55 | 0.69 | 1.73 | 1.0 |
| 21 | 20 | 880 | 30 | 45 | 2.43 | 6.07 | 2.0 |
| 22 | 10 | 955 | 30 | 55 | 0.78 | 1.95 | 1.0 |
| 23 | 15 | 933 | 40 | 55 | 0.73 | 1.83 | 1.0 |
| 24 | 20 | 890 | 30 | 55 | 2.15 | 5.37 | 2.5 |
| 25 | 25 | 970 | 30 | 35 | 0.62 | 1.56 | 0.9 |
| 26 | 5 | 970 | 30 | 50 | 0.66 | 1.66 | 1.0 |
| 27 | 15 | 970 | 30 | 50 | 0.66 | 1.66 | 3.0 |
| 28 | 0 | 970 | 30 | 50 | 0.66 | 1.66 | 1.0 |
| 29 | 5 | 960 | 30 | 35 | 0.70 | 1.75 | 1.0 |
| 30 | 15 | 921 | 30 | 35 | 1.40 | 3.50 | 2.0 |
| 31 | 0 | 961 | 30 | 50 | 0.73 | 1.82 | 1.0 |
| 32 | 5 | 922 | 30 | 50 | 1.44 | 3.60 | 2.0 |
| 33 | 0 | 850 | 40 | 40 | 3.60 | 8.99 | 4.0 |
| 34 | 5 | 960 | 30 | 50 | 1.38 | 3.44 | 2.0 |
| 35 | 10 | 920 | 30 | 50 | 2.37 | 5.91 | 3.0 |
| 36 | 15 | 920 | 30 | 50 | 2.37 | 5.91 | 2.0 |
| 37 | 0 | 990 | 30 | 35 | 0.53 | 1.32 | 0.7 |
| 38 | 0 | 990 | 30 | 65 | 0.53 | 1.32 | 1.0 |
| 39 | 5 | 990 | 30 | 65 | 0.77 | 1.92 | 1.0 |

TABLE 5-continued

| EXAMPLE NO. | (1) | (2) | (3) | (4) | t1 | 2.5 × t1 | (5) |
|---|---|---|---|---|---|---|---|
| 40 | 0 | 943 | 35 | 40 | 1.46 | 3.65 | 2.1 |
| 41 | 0 | 943 | 35 | 60 | 1.46 | 3.65 | 2.0 |
| 42 | 0 | 910 | 35 | 35 | 2.44 | 6.09 | 2.5 |
| 43 | 0 | 940 | 35 | 60 | 1.40 | 3.51 | 2.0 |
| 44 | 0 | 1012 | 40 | 45 | 0.25 | 0.63 | 0.3 |
| 45 | 10 | 985 | 40 | 45 | 0.61 | 1.52 | 0.9 |
| 46 | 0 | 1012 | 40 | 45 | 0.25 | 0.63 | 0.5 |
| 47 | 0 | 880 | 30 | 25 | 3.92 | 9.79 | 4.0 |
| 48 | 0 | 985 | 40 | 45 | 0.61 | 1.52 | 1.0 |
| 49 | 25 | 965 | 34 | 37 | 0.70 | 1.75 | 0.9 |
| 50 | 15 | 993 | 30 | 32 | 0.71 | 1.77 | 0.8 |
| 51 | 20 | 945 | 45 | 45 | 1.06 | 2.64 | 1.1 |
| 52 | 15 | 967 | 38 | 40 | 1.05 | 2.63 | 1.5 |
| 53 | 45 | 880 | 30 | 35 | 3.92 | 9.79 | 2.0 |
| 54 | 45 | 930 | 30 | 35 | 1.08 | 2.69 | 4.6 |

(1) TOTAL REDUCTION (%) AT T1° C. TO LESS THAN T1 + 30° C.
(2) Tf: TEMPERATURE (° C.) AFTER FINAL PASS OF LARGE REDUCTION PASS
(3) P1: ROLLING REDUCTION (%) DURING FINAL PASS OF LARGE REDUCTION PASS
(4) ROLLING REDUCTION (%) ONE PASS BEFORE FINAL PASS OF LARGE REDUCTION PASS
(5) t: WAITING TIME (s) FROM FINISH OF LARGE REDUCTION PASS TO START OF PRIMARY COOLING

TABLE 6

| EXAMPLE NO. | t/t1 | (1) | (2) | (3) | (4) | WINDING TEMPERATURE (° C.) | (5) | POLE DENSITY OF {332}<113> |
|---|---|---|---|---|---|---|---|---|
| 1 | 1.4 | 110 | 88 | 820 | 1.5 | 550 | 2.6 | 2.2 |
| 2 | 1.1 | 90 | 72 | 797 | 1.5 | 550 | 2.2 | 2.1 |
| 3 | 1.8 | 110 | 88 | 820 | 1.5 | 100 | 2.4 | 2.2 |
| 4 | 1.1 | 90 | 72 | 797 | 1.5 | 100 | 2.2 | 2.1 |
| 5 | 1.1 | 130 | 104 | 795 | 2.0 | 100 | 6.7 | 5.1 |
| 6 | 1.8 | 80 | 64 | 850 | 2.0 | 400 | 3.1 | 2.9 |
| 7 | 1.1 | 100 | 80 | 786 | 1.5 | 400 | 3.0 | 2.8 |
| 8 | 1.0 | 100 | 80 | 745 | 2.0 | 400 | 3.0 | 2.8 |
| 9 | 1.3 | 80 | 64 | 860 | 1.5 | 400 | 2.9 | 2.8 |
| 10 | 1.5 | 80 | 64 | 835 | 1.8 | 400 | 2.7 | 2.7 |
| 11 | 2.0 | 90 | 72 | 850 | 1.0 | 100 | 3.3 | 3.0 |
| 12 | 1.3 | 110 | 88 | 805 | 1.5 | 300 | 4.9 | 3.8 |
| 13 | 2.0 | 110 | 88 | 960 | 1.0 | 400 | 6.6 | 5.2 |
| 14 | 1.5 | 120 | 96 | 825 | 1.5 | 450 | 4.8 | 3.2 |
| 15 | 1.3 | 90 | 72 | 827 | 2.0 | 450 | 4.9 | 3.1 |
| 16 | 0.6 | 95 | 76 | 822 | 7.0 | 450 | 5.4 | 3.0 |
| 17 | 1.4 | 100 | 80 | 850 | 1.8 | 100 | 3.5 | 3.2 |
| 18 | 1.4 | 100 | 80 | 829 | 1.5 | 100 | 3.0 | 2.8 |
| 19 | 1.4 | 100 | 80 | 850 | 1.5 | 450 | 2.8 | 2.6 |
| 20 | 1.4 | 90 | 72 | 840 | 1.5 | 450 | 2.9 | 2.5 |
| 21 | 0.8 | 130 | 104 | 745 | 1.5 | 450 | 5.1 | 4.4 |
| 22 | 1.3 | 80 | 64 | 870 | 2.0 | 450 | 4.8 | 3.8 |
| 23 | 1.4 | 100 | 80 | 828 | 2.0 | 100 | 4.9 | 3.7 |
| 24 | 1.2 | 100 | 80 | 785 | 2.0 | 400 | 4.5 | 3.9 |
| 25 | 1.4 | 80 | 64 | 885 | 2.0 | 450 | 5.0 | 4.0 |
| 26 | 1.5 | 90 | 72 | 875 | 1.0 | 500 | 5.0 | 4.0 |
| 27 | 4.5 | 20 | 16 | 945 | 1.0 | 450 | 3.7 | 3.5 |
| 28 | 1.5 | 110 | 88 | 855 | 1.5 | 400 | 5.0 | 4.0 |
| 29 | 1.4 | 80 | 64 | 875 | 1.6 | 400 | 2.9 | 2.7 |
| 30 | 1.4 | 80 | 64 | 836 | 1.8 | 400 | 3.5 | 2.9 |
| 31 | 1.4 | 110 | 88 | 846 | 2.0 | 600 | 4.0 | 3.9 |
| 32 | 1.4 | 120 | 96 | 797 | 1.5 | 600 | 3.8 | 3.7 |
| 33 | 1.1 | 90 | 72 | 755 | 2.0 | 600 | 3.9 | 3.8 |
| 34 | 1.5 | 95 | 76 | 860 | 1.0 | 500 | 4.4 | 3.6 |
| 35 | 1.3 | 100 | 80 | 815 | 1.5 | 500 | 4.5 | 3.7 |
| 36 | 0.8 | 200 | 160 | 715 | 1.5 | 500 | 4.2 | 3.5 |
| 37 | 1.3 | 90 | 72 | 895 | 1.6 | 400 | 3.0 | 3.0 |
| 38 | 1.9 | 90 | 72 | 895 | 1.5 | 100 | 4.9 | 3.7 |
| 39 | 1.3 | 90 | 72 | 895 | 1.5 | 400 | 5.0 | 4.0 |
| 40 | 1.4 | 90 | 72 | 848 | 1.4 | 580 | 2.9 | 3.0 |
| 41 | 1.4 | 150 | 120 | 788 | 1.5 | 450 | 4.0 | 3.0 |
| 42 | 1.0 | 80 | 64 | 825 | 2.0 | 520 | 6.6 | 5.2 |
| 43 | 1.4 | 100 | 80 | 835 | 1.5 | 600 | 2.7 | 2.6 |
| 44 | 1.2 | 100 | 80 | 907 | 1.7 | 550 | 2.9 | 2.6 |
| 45 | 1.5 | 100 | 80 | 880 | 1.7 | 550 | 3.0 | 2.9 |

TABLE 6-continued

| EXAMPLE NO. | t/t1 | (1) | (2) | (3) | (4) | WINDING TEMPERATURE (° C.) | (5) | POLE DENSITY OF {332}<113> |
|---|---|---|---|---|---|---|---|---|
| 46 | 2.0 | 100 | 80 | 907 | 2.0 | 520 | 3.0 | 2.8 |
| 47 | 1.0 | 90 | 72 | 785 | 2.0 | 540 | 6.8 | 5.3 |
| 48 | 1.6 | 110 | 88 | 870 | 1.0 | 550 | 3.1 | 2.7 |
| 49 | 1.3 | 50 | 40 | 910 | 1.2 | 650 | 5.0 | 4.0 |
| 50 | 1.1 | 30 | 24 | 958 | 1.2 | 550 | 3.7 | 3.5 |
| 51 | 1.0 | 50 | 40 | 890 | 1.3 | 550 | 5.0 | 4.0 |
| 52 | 1.4 | 50 | 40 | 912 | 1.3 | 650 | 5.0 | 3.0 |
| 53 | 0.5 | 50 | 40 | 825 | 1.4 | 650 | 7.2 | 6.4 |
| 54 | 4.3 | 70 | 56 | 855 | 1.5 | 500 | 6.6 | 5.1 |

(1) COOLING TEMPERATURE CHANGE (° C.) OF PRIMARY COOLING
(2) RATE (° C./s) OF PRIMARY COOLING
(3) END TEMPERATURE (° C.) OF PRIMARY COOLING
(4) TIME (s) FROM FINISH OF PRIMARY COOLING TO START OF SECONDARY COOLING
(5) AVERAGE VALUE OF POLE DENSITIES OF ORIENTATION GROUP {100}<011> TO {223}<110>

TABLE 7

| EXAMPLE NO. | rC | r30 | rL | r60 | COARSE GRAIN AREA RATIO (%) | VOLUME AVERAGE GRAIN SIZE (μm) | EQUIAXIAL GRAIN FRACTION (%) | RIGHT SIDE OF EXPRESSION 1 | FERRITE HARDNESS (HV) |
|---|---|---|---|---|---|---|---|---|---|
| 1 | 0.87 | 1.04 | 0.88 | 1.05 | 7.7 | 17.6 | 74 | 234 | 155 |
| 2 | 0.90 | 0.96 | 0.92 | 0.98 | 7.6 | 17.5 | 80 | 234 | 160 |
| 3 | 0.88 | 1.05 | 0.94 | 1.00 | 7.2 | 17.0 | 71 | 234 | 156 |
| 4 | 0.90 | 1.00 | 0.90 | 1.02 | 7.2 | 17.1 | 75 | 234 | 140 |
| 5 | 0.70 | 1.09 | 0.71 | 1.19 | 11.0 | 21.0 | 43 | 234 | 171 |
| 6 | 0.88 | 0.99 | 0.86 | 1.10 | 7.2 | 17.0 | 70 | 234 | 132 |
| 7 | 0.92 | 1.00 | 0.90 | 1.10 | 7.2 | 17.1 | 73 | 234 | 148 |
| 8 | 0.71 | 1.17 | 0.70 | 1.12 | 11.9 | 22.0 | 40 | 234 | 148 |
| 9 | 0.79 | 1.05 | 0.87 | 1.05 | 7.2 | 17.0 | 72 | 257 | 155 |
| 10 | 0.85 | 1.02 | 0.69 | 1.11 | 7.2 | 17.1 | 73 | 257 | 157 |
| 11 | 0.80 | 1.00 | 0.82 | 1.01 | 7.3 | 17.2 | 61 | 257 | 154 |
| 12 | 0.91 | 1.10 | 0.68 | 1.12 | 7.2 | 17.0 | 69 | 257 | 171 |
| 13 | 0.70 | 1.10 | 0.71 | 1.20 | 12.9 | 23.0 | 33 | 257 | 171 |
| 14 | 0.88 | 1.10 | 0.90 | 1.08 | 6.4 | 16.2 | 66 | 257 | 180 |
| 15 | 0.96 | 1.09 | 0.69 | 1.12 | 6.5 | 16.3 | 74 | 257 | 154 |
| 16 | 0.72 | 1.09 | 0.67 | 1.26 | 7.0 | 11.0 | 95 | 257 | 158 |
| 17 | 0.75 | 0.98 | 0.78 | 1.00 | 7.2 | 17.0 | 75 | 265 | 180 |
| 18 | 0.85 | 0.95 | 0.83 | 0.98 | 7.0 | 16.8 | 78 | 265 | 188 |
| 19 | 0.93 | 1.01 | 0.92 | 1.08 | 7.2 | 17.0 | 69 | 265 | 168 |
| 20 | 0.88 | 1.08 | 0.90 | 1.06 | 7.3 | 17.2 | 73 | 265 | 159 |
| 21 | 0.70 | 1.08 | 0.72 | 1.26 | 8.0 | 10.0 | 36 | 265 | 184 |
| 22 | 0.92 | 1.09 | 0.91 | 1.10 | 6.6 | 16.4 | 74 | 248 | 140 |
| 23 | 1.00 | 1.07 | 0.89 | 1.10 | 5.6 | 15.4 | 78 | 248 | 157 |
| 24 | 0.70 | 1.26 | 0.73 | 1.30 | 11.0 | 21.0 | 49 | 248 | 157 |
| 25 | 0.70 | 1.08 | 0.70 | 1.09 | 7.3 | 17.2 | 72 | 257 | 167 |
| 26 | 0.85 | 1.07 | 0.89 | 1.10 | 6.7 | 16.5 | 63 | 257 | 154 |
| 27 | 0.70 | 1.23 | 0.72 | 1.16 | 52.0 | 21.0 | 63 | 257 | 94 |
| 28 | 0.86 | 1.03 | 0.90 | 1.02 | 6.3 | 16.1 | 68 | 289 | 193 |
| 29 | 0.90 | 1.06 | 0.85 | 1.05 | 7.0 | 16.8 | 72 | 275 | 183 |
| 30 | 0.95 | 1.02 | 0.68 | 1.11 | 7.1 | 16.9 | 72 | 275 | 188 |
| 31 | 0.99 | 0.96 | 1.00 | 0.99 | 7.2 | 17.0 | 73 | 275 | 183 |
| 32 | 0.87 | 1.07 | 0.67 | 1.18 | 7.2 | 17.0 | 68 | 275 | 182 |
| 33 | 0.71 | 1.10 | 0.73 | 1.31 | 12.9 | 23.0 | 33 | 275 | 165 |
| 34 | 0.88 | 1.10 | 0.88 | 1.02 | 6.9 | 16.7 | 63 | 315 | 174 |
| 35 | 0.89 | 1.08 | 0.68 | 1.15 | 7.0 | 16.8 | 68 | 315 | 180 |
| 36 | 0.71 | 1.09 | 0.69 | 1.25 | 1.5 | 11.0 | 48 | 315 | 335 |
| 37 | 0.75 | 1.05 | 0.68 | 1.20 | 6.5 | 16.3 | 78 | 274 | 174 |
| 38 | 0.90 | 1.10 | 0.67 | 1.16 | 5.3 | 15.1 | 73 | 274 | 164 |
| 39 | 0.92 | 1.09 | 0.69 | 1.14 | 5.4 | 15.2 | 73 | 291 | 175 |
| 40 | 0.74 | 1.07 | 0.72 | 1.09 | 6.6 | 16.4 | 77 | 294 | 188 |
| 41 | 0.88 | 1.08 | 0.92 | 1.02 | 6.9 | 16.7 | 73 | 294 | 186 |
| 42 | 0.74 | 1.23 | 0.72 | 1.23 | 11.0 | 21.0 | 41 | 294 | 167 |
| 43 | 0.90 | 1.07 | 0.91 | 1.10 | 6.1 | 15.9 | 73 | 298 | 188 |
| 44 | 0.72 | 1.06 | 0.71 | 1.08 | 6.7 | 16.5 | 78 | 284 | 181 |
| 45 | 0.72 | 1.10 | 0.73 | 1.08 | 6.6 | 16.4 | 74 | 284 | 178 |
| 46 | 0.91 | 1.09 | 0.90 | 0.99 | 6.5 | 16.3 | 74 | 284 | 180 |
| 47 | 0.70 | 1.10 | 0.71 | 1.30 | 6.5 | 16.3 | 38 | 284 | 170 |
| 48 | 0.92 | 1.08 | 0.89 | 1.03 | 5.3 | 15.1 | 64 | 284 | 179 |
| 49 | 0.73 | 1.10 | 0.70 | 1.01 | 6.9 | 16.7 | 69 | 274 | 175 |
| 50 | 0.75 | 1.05 | 0.71 | 1.00 | 6.4 | 16.2 | 74 | 294 | 186 |
| 51 | 0.70 | 1.10 | 0.75 | 1.05 | 6.4 | 16.2 | 70 | 294 | 188 |

TABLE 7-continued

| EXAMPLE NO. | rC | r30 | rL | r60 | COARSE GRAIN AREA RATIO (%) | VOLUME AVERAGE GRAIN SIZE (μm) | EQUIAXIAL GRAIN FRACTION (%) | RIGHT SIDE OF EXPRESSION 1 | FERRITE HARDNESS (HV) |
|---|---|---|---|---|---|---|---|---|---|
| 52 | 0.75 | 1.02 | 0.71 | 1.06 | 6.5 | 16.3 | 67 | 284 | 172 |
| 53 | 0.71 | 1.09 | 0.54 | 1.31 | 0.5 | 10.0 | 59 | 284 | 170 |
| 54 | 0.79 | 1.15 | 0.69 | 1.15 | 61.0 | 24.0 | 29 | 234 | 156 |

TABLE 8

| EXAMPLE NO. | STANDARD DEVIATION OF HARDNESS/ AVERAGE VALUE OF HARDNESS | TS (Mpa) | El. (%) | λ (%) | TS × λ (MPa · %) | SHEET THICKNESS/ MINIMUM BENDING RADIUS (C BENDING) | RATIO OF BENDING IN 45° DIRECTION/BENDING IN C DIRECTION | FATIGUE LIMIT RATIO | NOTE |
|---|---|---|---|---|---|---|---|---|---|
| 1 | 0.10 | 445 | 34 | 145 | 64525 | 3.2 | 1.1 | 0.427 | STEEL ACCORDING TO PRESENT INVENTION |
| 2 | 0.14 | 450 | 38 | 180 | 81000 | 3.3 | 1.2 | 0.427 | STEEL ACCORDING TO PRESENT INVENTION |
| 3 | 0.11 | 612 | 31 | 136 | 83149 | 3.6 | 1.2 | 0.420 | STEEL ACCORDING TO PRESENT INVENTION |
| 4 | 0.14 | 632 | 30 | 159 | 100623 | 3.6 | 1.1 | 0.419 | STEEL ACCORDING TO PRESENT INVENTION |
| 5 | 0.21 | 602 | 20 | 88 | 53005 | 0.8 | 1.7 | 0.418 | COMPARATIVE STEEL |
| 6 | 0.12 | 648 | 29 | 139 | 89910 | 3.5 | 1.2 | 0.419 | STEEL ACCORDING TO PRESENT INVENTION |
| 7 | 0.14 | 638 | 32 | 143 | 91312 | 3.9 | 1.3 | 0.419 | STEEL ACCORDING TO PRESENT INVENTION |
| 8 | 0.24 | 598 | 20 | 79 | 47268 | 0.8 | 1.6 | 0.418 | COMPARATIVE STEEL |
| 9 | 0.17 | 605 | 25 | 95 | 57475 | 3.2 | 1.4 | 0.420 | STEEL ACCORDING TO PRESENT INVENTION |
| 10 | 0.15 | 595 | 24 | 115 | 68425 | 1.6 | 1.3 | 0.420 | STEEL ACCORDING TO PRESENT INVENTION |
| 11 | 0.14 | 575 | 30 | 169 | 97520 | 4.7 | 1.1 | 0.421 | STEEL ACCORDING TO PRESENT INVENTION |
| 12 | 0.17 | 575 | 33 | 149 | 85757 | 1.7 | 1.0 | 0.421 | STEEL ACCORDING TO PRESENT INVENTION |
| 13 | 0.17 | 591 | 18 | 100 | 59144 | 2.0 | 1.7 | 0.418 | COMPARATIVE STEEL |
| 14 | 0.14 | 910 | 19 | 77 | 69720 | 3.4 | 1.2 | 0.414 | STEEL ACCORDING TO PRESENT INVENTION |
| 15 | 0.17 | 905 | 16 | 104 | 94055 | 1.9 | 1.2 | 0.414 | STEEL ACCORDING TO PRESENT INVENTION |
| 16 | 0.33 | 890 | 12 | 87 | 77771 | 1.8 | 1.6 | 0.457 | STEEL ACCORDING TO PRESENT INVENTION |
| 17 | 0.12 | 595 | 29 | 85 | 50575 | 2.7 | 1.1 | 0.420 | STEEL ACCORDING TO PRESENT INVENTION |
| 18 | 0.16 | 600 | 28 | 90 | 54000 | 2.3 | 1.3 | 0.420 | STEEL ACCORDING TO PRESENT INVENTION |
| 19 | 0.17 | 589 | 29 | 153 | 90070 | 2.9 | 1.1 | 0.421 | STEEL ACCORDING TO PRESENT INVENTION |
| 20 | 0.12 | 588 | 31 | 162 | 95090 | 4.4 | 1.2 | 0.421 | STEEL ACCORDING TO PRESENT INVENTION |
| 21 | 0.25 | 592 | 20 | 110 | 65123 | 1.7 | 1.7 | 0.467 | STEEL ACCORDING TO PRESENT INVENTION |
| 22 | 0.17 | 869 | 20 | 125 | 108658 | 5.8 | 1.1 | 0.414 | STEEL ACCORDING TO PRESENT INVENTION |
| 23 | 0.15 | 1100 | 15 | 52 | 56771 | 5.8 | 1.2 | 0.412 | STEEL ACCORDING TO PRESENT INVENTION |
| 24 | 0.29 | 899 | 10 | 46 | 41591 | 0.8 | 1.8 | 0.412 | COMPARATIVE STEEL |
| 25 | 0.18 | 650 | 19 | 75 | 48750 | 2.1 | 1.3 | 0.419 | STEEL ACCORDING TO PRESENT INVENTION |
| 26 | 0.17 | 788 | 22 | 130 | 102828 | 4.7 | 1.1 | 0.416 | STEEL ACCORDING TO PRESENT INVENTION |
| 27 | 0.23 | 788 | 12 | 56 | 44127 | 1.3 | 1.7 | 0.414 | COMPARATIVE STEEL |
| 28 | 0.17 | 973 | 17 | 74 | 71577 | 3.8 | 1.4 | 0.413 | STEEL ACCORDING TO PRESENT INVENTION |
| 29 | 0.18 | 625 | 21 | 135 | 84375 | 3.3 | 1.2 | 0.420 | STEEL ACCORDING TO PRESENT INVENTION |
| 30 | 0.19 | 635 | 19 | 118 | 74930 | 1.9 | 1.2 | 0.419 | STEEL ACCORDING TO PRESENT INVENTION |
| 31 | 0.17 | 564 | 34 | 152 | 85552 | 3.8 | 1.2 | 0.421 | STEEL ACCORDING TO PRESENT INVENTION |
| 32 | 0.17 | 554 | 34 | 142 | 78758 | 1.8 | 1.2 | 0.422 | STEEL ACCORDING TO PRESENT INVENTION |
| 33 | 0.32 | 576 | 23 | 105 | 60736 | 2.2 | 1.4 | 0.418 | STEEL ACCORDING TO PRESENT INVENTION |
| 34 | 0.17 | 721 | 28 | 129 | 93227 | 4.1 | 1.3 | 0.417 | STEEL ACCORDING TO PRESENT INVENTION |
| 35 | 0.17 | 716 | 28 | 122 | 87137 | 1.9 | 1.2 | 0.417 | STEEL ACCORDING TO PRESENT INVENTION |
| 36 | 0.17 | 711 | 19 | 83 | 58760 | 1.7 | 1.7 | 0.441 | STEEL ACCORDING TO PRESENT INVENTION |
| 37 | 0.12 | 735 | 15 | 75 | 55125 | 1.5 | 1.2 | 0.410 | STEEL ACCORDING TO PRESENT INVENTION |
| 38 | 0.17 | 1286 | 17 | 35 | 45403 | 1.8 | 1.3 | 0.410 | STEEL ACCORDING TO PRESENT INVENTION |
| 39 | 0.18 | 1104 | 20 | 69 | 76639 | 1.6 | 1.1 | 0.412 | STEEL ACCORDING TO PRESENT INVENTION |
| 40 | 0.17 | 810 | 19 | 85 | 68850 | 2.3 | 1.2 | 0.415 | STEEL ACCORDING TO PRESENT INVENTION |
| 41 | 0.15 | 745 | 23 | 104 | 77795 | 3.0 | 1.2 | 0.416 | STEEL ACCORDING TO PRESENT INVENTION |
| 42 | 0.24 | 775 | 16 | 65 | 50464 | 0.7 | 1.7 | 0.414 | COMPARATIVE STEEL |
| 43 | 0.15 | 991 | 17 | 77 | 76647 | 4.1 | 1.2 | 0.413 | STEEL ACCORDING TO PRESENT INVENTION |
| 44 | 0.15 | 790 | 21 | 140 | 110600 | 2.7 | 1.3 | 0.416 | STEEL ACCORDING TO PRESENT INVENTION |
| 45 | 0.16 | 795 | 20 | 140 | 111300 | 2.3 | 1.1 | 0.416 | STEEL ACCORDING TO PRESENT INVENTION |

TABLE 8-continued

| EXAMPLE NO. | STANDARD DEVIATION OF HARDNESS/ AVERAGE VALUE OF HARDNESS | TS (Mpa) | El. (%) | λ (%) | TS × λ (MPa · %) | SHEET THICKNESS/ MINIMUM BENDING RADIUS (C BENDING) | RATIO OF BENDING IN 45° DIRECTION/BENDING IN C DIRECTION | FATIGUE LIMIT RATIO | NOTE |
|---|---|---|---|---|---|---|---|---|---|
| 46 | 0.12 | 811 | 21 | 119 | 96817 | 4.6 | 1.3 | 0.415 | STEEL ACCORDING TO PRESENT INVENTION |
| 47 | 0.17 | 791 | 14 | 65 | 51330 | 1.2 | 1.9 | 0.416 | COMPARATIVE STEEL |
| 48 | 0.12 | 1391 | 12 | 18 | 25243 | 3.6 | 1.4 | 0.409 | STEEL ACCORDING TO PRESENT INVENTION |
| 49 | 0.12 | 765 | 14 | 60 | 45900 | 2.0 | 1.2 | 0.416 | STEEL ACCORDING TO PRESENT INVENTION |
| 50 | 0.13 | 825 | 18 | 70 | 57750 | 2.1 | 1.1 | 0.415 | STEEL ACCORDING TO PRESENT INVENTION |
| 51 | 0.14 | 835 | 17 | 65 | 54275 | 2.0 | 1.3 | 0.415 | STEEL ACCORDING TO PRESENT INVENTION |
| 52 | 0.18 | 830 | 17 | 125 | 103750 | 2.0 | 1.2 | 0.415 | STEEL ACCORDING TO PRESENT INVENTION |
| 53 | 0.22 | 805 | 17 | 60 | 48300 | 1.1 | 2.1 | 0.460 | COMPARATIVE STEEL |
| 54 | 0.23 | 465 | 30 | 85 | 39525 | 1.2 | 1.6 | 0.422 | COMPARATIVE STEEL |

TABLE 9

| EXAMPLE NO. | STEEL | T1 (° C.) | (1) | (2) | AUSTENITE GRAIN SIZE (μm) | (3) | (4) | (5) |
|---|---|---|---|---|---|---|---|---|
| 55 | C | 865 | 2 | 45/45 | 80 | 45 | 2 | 15 |
| 56 | E | 858 | 2 | 40/45 | 95 | 75 | 2 | 12 |
| 57 | M | 892 | 0 | — | 350 | 45 | 2 | 30 |
| 58 | I | 858 | 1 | 50 | 120 | 80 | 2 | 40 |
| 59 | A | 851 | 0 | — | 250 | 65 | 2 | 18 |
| 60 | E | 858 | 0 | — | 300 | 85 | 3 | 13 |
| 61 | Q | 852 | 2 | 45/45 | 80 | 80 | 2 | 10 |
| 62 | R | 852 | 2 | 45/45 | 75 | 85 | 2 | 10 |
| 63 | S | 851 | 2 | 45/45 | 80 | 85 | 2 | 12 |
| 64 | T | 853 | 2 | 45/45 | 80 | 95 | 2 | 12 |
| 65 | U | 880 | 2 | 45/45 | 75 | 85 | 2 | 12 |
| 66 | V | 868 | 2 | 45/45 | 85 | 80 | 2 | 12 |
| 67 | W | 851 | 2 | 45/45 | 85 | 80 | 2 | 12 |
| 68 | g | 855 | | CRACKING DURING HOT ROLLING | | | | |
| 69 | a | 855 | | CRACKING DURING HOT ROLLING | | | | |
| 70 | b | 1376 | | CRACKING DURING HOT ROLLING | | | | |
| 71 | c | 851 | | CRACKING DURING HOT ROLLING | | | | |
| 72 | d | 1154 | | CRACKING DURING HOT ROLLING | | | | |
| 73 | e | 851 | 2 | 45/45 | 80 | 65 | 2 | 10 |
| 74 | f | 854 | 2 | 45/45 | 80 | 70 | 3 | 10 |
| 75 | X | 850 | 1 | 50 | 80 | 80 | 3 | 15 |
| 76 | Y | 850 | 2 | 50 | 80 | 80 | 3 | 10 |
| 77 | Z | 852 | 1 | 50 | 120 | 60 | 3 | 10 |
| 78 | AA | 852 | 1 | 50 | 120 | 60 | 3 | 10 |
| 79 | AB | 850 | 2 | 45/45 | 100 | 75 | 3 | 18 |
| 80 | AC | 850 | 2 | 45/45 | 100 | 75 | 3 | 18 |
| 81 | AD | 851 | 1 | 50 | 150 | 85 | 2 | 25 |
| 82 | AD | 851 | 2 | 45/45 | 95 | 90 | 3 | 15 |
| 83 | AE | 864 | 2 | 45/40 | 80 | 75 | 3 | 15 |
| 84 | AE | 864 | 2 | 45/45 | 80 | 85 | 3 | 18 |
| 85 | AF | 857 | 2 | 45/45 | 95 | 85 | 3 | 17 |
| 86 | AF | 857 | 2 | 45/45 | 95 | 90 | 2 | 14 |
| 87 | AF | 857 | 2 | 45/45 | 95 | 90 | 3 | 14 |
| 88 | AG | 871 | 3 | 40/40/40 | 75 | 90 | 2 | 20 |
| 89 | AH | 860 | 2 | 45/40 | 95 | 80 | 2 | 16 |
| 90 | AH | 860 | 1 | 50 | 120 | 80 | 2 | 18 |
| 91 | AI | 869 | 3 | 40/40/40 | 70 | 90 | 2 | 20 |
| 92 | AJ | 896 | 3 | 40/40/40 | 65 | 95 | 2 | 0 |
| 93 | AK | 894 | 2 | 45/45 | 70 | 90 | 2 | 15 |
| 94 | AK | 894 | 2 | 45/45 | 95 | 85 | 2 | 0 |
| 95 | AD | 851 | 2 | 40/40 | 100 | 80 | 2 | 25 |
| 96 | AI | 869 | 2 | 40/40 | 100 | 75 | 2 | 20 |
| 97 | AL | 861 | 2 | 40/40 | 100 | 90 | 2 | 15 |
| 98 | AM | 864 | 2 | 40/40 | 100 | 90 | 2 | 15 |
| 99 | AN | 877 | 2 | 40/40 | 100 | 90 | 2 | 15 |
| 100 | AK | 894 | 0 | — | 210 | 70 | 2 | 10 |
| 101 | AG | 871 | 0 | — | 260 | 45 | 1 | 20 |
| 102 | AD | 851 | 0 | — | 270 | 50 | 1 | 15 |
| 103 | AJ | 896 | 1 | 50 | 120 | 50 | 1 | 10 |
| 104 | h | 855 | | CRACKING DURING HOT ROLLING | | | | |
| 105 | i | 1446 | | CRACKING DURING HOT ROLLING | | | | |
| 106 | j | 852 | | CRACKING DURING HOT ROLLING | | | | |
| 107 | k | 1154 | | CRACKING DURING HOT ROLLING | | | | |

(1) NUMBER OF REDUCTIONS OF 40% OR HIGHER AT 1000° C. TO 1200° C.
(2) ROLLING REDUCTION (%) OF 40% OR HIGHER AT 1000° C. TO 1200° C.
(3) TOTAL ROLLING REDUCTION (%) AT T1 + 30° C. TO T1 + 200° C.
(4) NUMBER (%) OF REDUCTIONS OF 30% OR HIGHER AT T1 + 30° C. TO T1 + 200° C.
(5) TEMPERATURE INCREASE (° C.) DURING REDUCTION AT T1 + 30° C. TO T1 + 200° C.

TABLE 10

| EXAMPLE NO. | (1) | (2) | (3) | (4) | t1 | 2.5 × t1 | (5) |
|---|---|---|---|---|---|---|---|
| 55 | 45 | 1075 | 30 | 32 | 0.20 | 0.50 | 0.4 |
| 56 | 45 | 890 | 30 | 32 | 2.15 | 5.36 | 2.2 |
| 57 | 35 | 910 | 35 | 40 | 2.44 | 6.09 | 2.6 |
| 58 | 35 | 860 | 40 | 42 | 3.02 | 7.54 | 3.2 |
| 59 | 20 | 850 | 30 | 31 | 3.13 | 7.83 | 3.4 |
| 60 | 25 | 890 | 30 | 33 | 2.15 | 5.36 | 2.5 |
| 61 | 5 | 957 | 40 | 40 | 0.29 | 0.72 | 0.5 |
| 62 | 10 | 967 | 35 | 50 | 0.33 | 0.83 | 0.5 |
| 63 | 15 | 996 | 40 | 45 | 0.14 | 0.36 | 0.2 |

TABLE 10-continued

| EXAMPLE NO. | (1) | (2) | (3) | (4) | t1 | 2.5 × t1 | (5) |
|---|---|---|---|---|---|---|---|
| 64 | 0 | 958 | 40 | 55 | 0.29 | 0.72 | 0.5 |
| 65 | 10 | 985 | 35 | 50 | 0.44 | 1.11 | 1.0 |
| 66 | 10 | 973 | 40 | 40 | 0.29 | 0.73 | 0.5 |
| 67 | 5 | 956 | 40 | 40 | 0.29 | 0.73 | 0.5 |
| 68 | | CRACKING DURING HOT ROLLING | | | | | |
| 69 | | CRACKING DURING HOT ROLLING | | | | | |
| 70 | | CRACKING DURING HOT ROLLING | | | | | |
| 71 | | CRACKING DURING HOT ROLLING | | | | | |
| 72 | | CRACKING DURING HOT ROLLING | | | | | |

TABLE 10-continued

| EXAMPLE NO. | (1) | (2) | (3) | (4) | t1 | 2.5 × t1 | (5) |
|---|---|---|---|---|---|---|---|
| 73 | 5 | 956 | 35 | 30 | 0.44 | 1.11 | 1.0 |
| 74 | 0 | 919 | 35 | 35 | 1.14 | 2.84 | 1.5 |
| 75 | 0 | 950 | 35 | 40 | 0.51 | 1.28 | 1.1 |
| 76 | 0 | 950 | 35 | 40 | 0.52 | 1.29 | 1.1 |
| 77 | 5 | 970 | 35 | 40 | 0.30 | 0.75 | 0.5 |
| 78 | 5 | 970 | 35 | 40 | 0.30 | 0.75 | 0.5 |
| 79 | 25 | 920 | 35 | 40 | 1.03 | 2.57 | 1.2 |
| 80 | 25 | 920 | 35 | 40 | 1.03 | 2.58 | 1.3 |
| 81 | 0 | 940 | 35 | 40 | 0.67 | 1.68 | 0.2 |
| 82 | 0 | 950 | 35 | 40 | 0.52 | 1.31 | 0.1 |
| 83 | 5 | 945 | 35 | 35 | 0.82 | 2.04 | 0.4 |
| 84 | 0 | 940 | 30 | 40 | 1.14 | 2.84 | 0.6 |
| 85 | 0 | 960 | 35 | 40 | 0.48 | 1.19 | 0.1 |
| 86 | 5 | 970 | 35 | 45 | 0.36 | 0.89 | 0.1 |
| 87 | 5 | 970 | 35 | 45 | 0.36 | 0.89 | 0.1 |
| 88 | 0 | 980 | 40 | 40 | 0.25 | 0.62 | 0.1 |
| 89 | 5 | 980 | 30 | 35 | 0.47 | 1.17 | 0.2 |
| 90 | 10 | 950 | 30 | 35 | 0.88 | 2.20 | 0.2 |
| 91 | 0 | 990 | 40 | 50 | 0.17 | 0.42 | 0.1 |
| 92 | 0 | 1045 | 40 | 45 | 0.16 | 0.39 | 0.1 |
| 93 | 0 | 1000 | 30 | 45 | 0.64 | 1.60 | 0.3 |
| 94 | 0 | 990 | 35 | 40 | 0.56 | 1.40 | 0.2 |

TABLE 10-continued

| EXAMPLE NO. | (1) | (2) | (3) | (4) | t1 | 2.5 × t1 | (5) |
|---|---|---|---|---|---|---|---|
| 95 | 0 | 930 | 40 | 40 | 0.65 | 1.63 | 0.3 |
| 96 | 15 | 980 | 35 | 35 | 0.37 | 0.94 | 0.3 |
| 97 | 10 | 980 | 40 | 40 | 0.18 | 0.45 | 0.1 |
| 98 | 0 | 1000 | 40 | 40 | 0.13 | 0.33 | 0.1 |
| 99 | 10 | 1020 | 40 | 40 | 0.14 | 0.35 | 0.1 |
| 100 | 25 | 880 | 30 | 30 | 3.56 | 8.91 | 3.5 |
| 101 | 45 | 810 | 30 | 15 | 5.42 | 13.55 | 9.5 |
| 102 | 45 | 810 | 35 | 10 | 4.87 | 12.16 | 4.0 |
| 103 | 45 | 870 | 50 | 0 | 4.68 | 11.71 | 1.5 |
| 104 | | CRACKING DURING HOT ROLLING | | | | | |
| 105 | | CRACKING DURING HOT ROLLING | | | | | |
| 106 | | CRACKING DURING HOT ROLLING | | | | | |
| 107 | | CRACKING DURING HOT ROLLING | | | | | |

(1) TOTAL REDUCTION (%) AT T1° C. TO LESS THAN T1 + 30° C.

(2) Tf: TEMPERATURE (° C.) AFTER FINAL PASS OF LARGE REDUCTION PASS (3) P1: ROLLING REDUCTION (%) DURING FINAL PASS OF LARGE REDUCTION PASS (4) ROLLING REDUCTION (%) ONE PASS BEFORE FINAL PASS OF LARGE REDUCTION PASS (5) t: WAITING TIME (s) FROM FINISH OF LARGE REDUCTION PASS TO START OF PRIMARY COOLING

TABLE 11

| EXAMPLE NO. | t/t1 | (1) | RATE (° C./s) OF PRIMARY COOLING | END TEMPERATURE (° C.) OF PRIMARY COOLING | (2) | WINDING TEMPERATURE (° C.) | (3) | POLE DENSITY OF {332}<113> |
|---|---|---|---|---|---|---|---|---|
| 55 | 2.0 | 70 | 56 | 1000 | 1.7 | 400 | 6.9 | 5.2 |
| 56 | 1.0 | 70 | 56 | 815 | 1.2 | 550 | 7.2 | 5.8 |
| 57 | 1.1 | 70 | 56 | 835 | 1.3 | 600 | 7.6 | 5.4 |
| 58 | 1.1 | 70 | 56 | 785 | 1.2 | 400 | 7.1 | 6.4 |
| 59 | 1.1 | 70 | 56 | 775 | 1.1 | 600 | 5.4 | 5.6 |
| 60 | 1.2 | 90 | 72 | 795 | 1.0 | 450 | 5.2 | 5.4 |
| 61 | 1.7 | 110 | 88 | 842 | 1.5 | 600 | 4.8 | 3.7 |
| 62 | 1.5 | 120 | 96 | 842 | 1.5 | 600 | 4.6 | 3.8 |
| 63 | 1.4 | 90 | 72 | 901 | 1.5 | 500 | 2.6 | 2.2 |
| 64 | 1.7 | 95 | 76 | 858 | 2.0 | 400 | 5.0 | 4.0 |
| 65 | 2.2 | 100 | 80 | 880 | 1.0 | 500 | 2.2 | 2.1 |
| 66 | 1.7 | 100 | 80 | 868 | 1.0 | 550 | 5.0 | 4.0 |
| 67 | 1.7 | 100 | 80 | 851 | 1.0 | 400 | 2.3 | 2.2 |
| 68 | | | | CRACKING DURING HOT ROLLING | | | | |
| 69 | | | | CRACKING DURING HOT ROLLING | | | | |
| 70 | | | | CRACKING DURING HOT ROLLING | | | | |
| 71 | | | | CRACKING DURING HOT ROLLING | | | | |
| 72 | | | | CRACKING DURING HOT ROLLING | | | | |
| 73 | 2.2 | 100 | 80 | 851 | 1.5 | 550 | 2.6 | 2.2 |
| 74 | 1.3 | 100 | 80 | 814 | 1.0 | 550 | 3.0 | 2.9 |
| 75 | 2.1 | 90 | 72 | 855 | 1.5 | 550 | 4.8 | 3.7 |
| 76 | 2.1 | 90 | 72 | 855 | 1.5 | 550 | 4.6 | 3.8 |
| 77 | 1.7 | 90 | 72 | 875 | 1.5 | 550 | 2.6 | 2.2 |
| 78 | 1.7 | 120 | 96 | 845 | 1.5 | 550 | 5.0 | 4.0 |
| 79 | 1.2 | 120 | 96 | 795 | 1.5 | 550 | 2.2 | 2.1 |
| 80 | 1.3 | 120 | 96 | 795 | 1.5 | 550 | 5.0 | 4.0 |
| 81 | 0.2 | 90 | 80 | 845 | 0.5 | 500 | 4.5 | 4.1 |
| 82 | 0.2 | 90 | 80 | 855 | 0.4 | 500 | 3.2 | 2.3 |
| 83 | 0.5 | 100 | 90 | 840 | 1.0 | 450 | 3.2 | 2.1 |
| 84 | 0.5 | 90 | 90 | 845 | 1.2 | 470 | 3.4 | 2.7 |
| 85 | 0.3 | 100 | 90 | 855 | 1.0 | 500 | 3.9 | 2.8 |
| 86 | 0.3 | 100 | 90 | 865 | 0.5 | 500 | 4.1 | 2.3 |
| 87 | 0.3 | 100 | 90 | 865 | 4.0 | 500 | 4.1 | 2.3 |
| 88 | 0.4 | 30 | 75 | 945 | 1.3 | 650 | 3.8 | 3.0 |
| 89 | 0.4 | 110 | 75 | 865 | 0.6 | 450 | 4.2 | 2.8 |
| 90 | 0.2 | 110 | 75 | 835 | 0.7 | 450 | 3.7 | 3.2 |
| 91 | 0.4 | 100 | 80 | 885 | 1.4 | 550 | 4.2 | 3.1 |
| 92 | 0.6 | 50 | 80 | 990 | 7.5 | 600 | 5.1 | 3.2 |
| 93 | 0.5 | 100 | 90 | 895 | 1.2 | 550 | 4.8 | 3.2 |
| 94 | 0.4 | 100 | 90 | 885 | 0.7 | 550 | 3.9 | 4.2 |
| 95 | 0.4 | 150 | 90 | 775 | 0.8 | 400 | 5.2 | 3.2 |
| 96 | 0.7 | 130 | 100 | 845 | 1.0 | 350 | 5.4 | 4.6 |
| 97 | 0.7 | 100 | 100 | 875 | 0.9 | 550 | 5.1 | 3.5 |
| 98 | 0.9 | 90 | 80 | 905 | 0.9 | 650 | 5.3 | 4.0 |

TABLE 11-continued

| EXAMPLE NO. | t/t1 | (1) | RATE (° C./s) OF PRIMARY COOLING | END TEMPERATURE (° C.) OF PRIMARY COOLING | (2) | WINDING TEMPERATURE (° C.) | (3) | POLE DENSITY OF {332}<113> |
|---|---|---|---|---|---|---|---|---|
| 99 | 0.8 | 135 | 80 | 880 | 1.0 | 100 | 5.0 | 3.9 |
| 100 | 1.0 | 100 | 80 | 775 | 0.7 | 550 | 7.2 | 6.4 |
| 101 | 1.8 | 100 | 85 | 705 | 3.5 | 500 | 8.5 | 5.2 |
| 102 | 0.8 | 100 | 85 | 705 | 7.0 | 550 | 6.6 | 5.1 |
| 103 | 0.3 | 90 | 85 | 775 | 0.5 | 600 | 6.2 | 5.2 |
| 104 | | | | CRACKING DURING HOT ROLLING | | | | |
| 105 | | | | CRACKING DURING HOT ROLLING | | | | |
| 106 | | | | CRACKING DURING HOT ROLLING | | | | |
| 107 | | | | CRACKING DURING HOT ROLLING | | | | |

(1) COOLING TEMPERATURE CHANGE (° C.) OF PRIMARY COOLING (2) TIME (s) FROM FINISH OF PRIMARY COOLING TO START OF SECONDARY COOLING (3) AVERAGE VALUE OF POLE DENSITIES OF ORIENTATION GROUP {100}<011> TO {223}<110>

TABLE 12

| EXAMPLE NO. | rC | r30 | rL | r60 | COARSE GRAIN AREA RATIO (%) | VOLUME AVERAGE GRAIN SIZE (μm) | EQUIAXIAL GRAIN FRACTION (%) | RIGHT SIDE OF EXPRESSION 1 | FERRITE HARDNESS (Hv) |
|---|---|---|---|---|---|---|---|---|---|
| 55 | 0.70 | 1.08 | 0.56 | 1.19 | 12.9 | 23.0 | 70 | 257 | 154 |
| 56 | 0.68 | 1.18 | 0.65 | 1.15 | 12.9 | 23.0 | 79 | 265 | 184 |
| 57 | 0.65 | 1.22 | 0.52 | 1.30 | 11.0 | 21.0 | 73 | 294 | 190 |
| 58 | 0.65 | 1.15 | 0.63 | 1.23 | 11.9 | 22.0 | 57 | 275 | 180 |
| 59 | 0.75 | 1.05 | 0.59 | 1.21 | 14.8 | 25.0 | 81 | 234 | 161 |
| 60 | 0.72 | 1.10 | 0.68 | 1.10 | 12.9 | 23.0 | 78 | 265 | 182 |
| 61 | 0.71 | 1.00 | 0.77 | 1.08 | 7.0 | 16.8 | 68 | 249 | 166 |
| 62 | 0.72 | 1.06 | 0.75 | 1.10 | 6.8 | 16.6 | 69 | 273 | 181 |
| 63 | 0.93 | 1.10 | 0.90 | 1.10 | 7.4 | 17.3 | 69 | 258 | 155 |
| 64 | 0.74 | 0.98 | 0.73 | 0.99 | 6.4 | 16.2 | 78 | 236 | 146 |
| 65 | 0.92 | 1.09 | 0.94 | 1.09 | 7.1 | 16.9 | 64 | 268 | 170 |
| 66 | 0.73 | 0.99 | 0.70 | 1.10 | 6.7 | 16.5 | 63 | 294 | 186 |
| 67 | 0.94 | 1.08 | 0.96 | 1.09 | 7.1 | 16.9 | 63 | 240 | 152 |
| 68 | | | | | CRACKING DURING HOT ROLLING | | | | |
| 69 | | | | | CRACKING DURING HOT ROLLING | | | | |
| 70 | | | | | CRACKING DURING HOT ROLLING | | | | |
| 71 | | | | | CRACKING DURING HOT ROLLING | | | | |
| 72 | | | | | CRACKING DURING HOT ROLLING | | | | |
| 73 | 0.70 | 1.22 | 0.72 | 1.26 | 11.0 | 21.0 | 68 | 313 | 355 |
| 74 | 0.71 | 1.19 | 0.70 | 1.20 | 11.0 | 21.0 | 30 | 313 | 199 |
| 75 | 0.70 | 1.00 | 0.80 | 1.10 | 7.2 | 17.1 | 60 | 291 | 196 |
| 76 | 0.71 | 1.00 | 0.77 | 1.10 | 6.7 | 16.5 | 65 | 277 | 188 |
| 77 | 0.72 | 1.00 | 0.75 | 1.00 | 6.3 | 16.1 | 65 | 257 | 170 |
| 78 | 0.73 | 1.00 | 0.70 | 1.10 | 6.2 | 16.0 | 66 | 280 | 191 |
| 79 | 0.70 | 1.00 | 0.68 | 1.14 | 7.2 | 17.1 | 62 | 245 | 177 |
| 80 | 0.72 | 1.00 | 0.67 | 1.17 | 7.2 | 17.0 | 62 | 264 | 185 |
| 81 | 0.87 | 1.04 | 0.88 | 1.05 | 0.3 | 9.5 | 83 | 233 | 150 |
| 82 | 0.90 | 0.96 | 0.92 | 0.98 | 0.2 | 8.7 | 91 | 233 | 158 |
| 83 | 0.88 | 1.05 | 0.94 | 1.00 | 0.6 | 4.5 | 88 | 254 | 170 |
| 84 | 0.79 | 1.05 | 0.69 | 1.11 | 0.6 | 5.2 | 92 | 254 | 176 |
| 85 | 0.85 | 1.02 | 0.90 | 1.03 | 0.3 | 5.1 | 84 | 266 | 186 |
| 86 | 0.80 | 1.00 | 0.82 | 1.01 | 0.4 | 6.1 | 93 | 266 | 180 |
| 87 | 0.91 | 1.10 | 0.90 | 1.10 | 0.4 | 6.1 | 93 | 266 | 182 |
| 88 | 0.75 | 1.05 | 0.72 | 1.08 | 0.5 | 5.0 | 82 | 265 | 190 |
| 89 | 0.90 | 1.10 | 0.87 | 1.09 | 0.5 | 5.6 | 81 | 271 | 185 |
| 90 | 0.92 | 1.09 | 0.67 | 1.18 | 0.3 | 4.8 | 79 | 271 | 180 |
| 91 | 0.71 | 1.07 | 0.72 | 1.09 | 0.5 | 4.5 | 71 | 276 | 191 |
| 92 | 0.88 | 1.08 | 0.92 | 1.02 | 0.6 | 4.2 | 70 | 341 | 260 |
| 93 | 0.72 | 1.06 | 0.75 | 1.10 | 0.5 | 4.6 | 81 | 282 | 200 |
| 94 | 0.93 | 1.10 | 0.90 | 1.10 | 0.4 | 4.2 | 78 | 282 | 201 |
| 95 | 0.74 | 0.98 | 0.73 | 0.99 | 0.5 | 6.7 | 70 | 233 | 150 |
| 96 | 0.92 | 1.09 | 0.94 | 1.09 | 0.7 | 5.9 | 65 | 276 | 190 |
| 97 | 0.73 | 0.99 | 0.70 | 1.10 | 0.7 | 4.5 | 65 | 290 | 200 |
| 98 | 0.94 | 1.08 | 0.96 | 1.09 | 0.7 | 5.2 | 70 | 301 | 210 |
| 99 | 1.05 | 0.87 | 1.05 | 1.08 | 0.7 | 5.9 | 75 | 293 | 190 |
| 100 | 0.67 | 1.24 | 0.54 | 1.31 | 0.8 | 10.5 | 75 | 282 | 180 |
| 101 | 0.65 | 1.25 | 0.56 | 1.19 | 1.0 | 16.9 | 85 | 265 | 180 |
| 102 | 0.69 | 1.11 | 0.67 | 1.12 | 0.7 | 16.7 | 85 | 233 | 150 |
| 103 | 0.72 | 1.06 | 0.75 | 1.10 | 0.4 | 3.8 | 45 | 341 | 250 |
| 104 | | | | | CRACKING DURING HOT ROLLING | | | | |
| 105 | | | | | CRACKING DURING HOT ROLLING | | | | |

TABLE 12-continued

| EXAMPLE NO. | rC | r30 | rL | r60 | COARSE GRAIN AREA RATIO (%) | VOLUME AVERAGE GRAIN SIZE (μm) | EQUIAXIAL GRAIN FRACTION (%) | RIGHT SIDE OF EXPRESSION 1 | FERRITE HARDNESS (Hv) |
|---|---|---|---|---|---|---|---|---|---|
| 106 | CRACKING DURING HOT ROLLING | | | | | | | | |
| 107 | CRACKING DURING HOT ROLLING | | | | | | | | |

TABLE 13

| EXAMPLE NO. | STANDARD DEVIATION OF HARDNESS/ AVERAGE VALUE OF HARDNESS | TS (Mpa) | El. (%) | λ (%) | TS × λ (Mpa · %) | SHEET THICKNESS/ MINIMUM BENDING RADIUS (C BENDING) | RATIO OF BENDING IN 45° DIRECTION/BENDING IN C DIRECTION | FATIGUE LIMIT RATIO | NOTE |
|---|---|---|---|---|---|---|---|---|---|
| 55 | 0.30 | 635 | 20 | 65 | 41275 | 1.2 | 2.0 | 0.416 | COMPARATIVE STEEL |
| 56 | 0.31 | 640 | 21 | 45 | 28800 | 1.2 | 1.8 | 0.416 | COMPARATIVE STEEL |
| 57 | 0.33 | 845 | 15 | 45 | 38025 | 1.1 | 2.2 | 0.413 | COMPARATIVE STEEL |
| 58 | 0.28 | 670 | 16 | 75 | 50250 | 1.2 | 1.9 | 0.416 | COMPARATIVE STEEL |
| 59 | 0.26 | 405 | 30 | 70 | 28350 | 1.1 | 1.7 | 0.425 | COMPARATIVE STEEL |
| 60 | 0.27 | 650 | 21 | 50 | 32500 | 1.1 | 1.6 | 0.416 | COMPARATIVE STEEL |
| 61 | 0.12 | 662 | 33 | 133 | 88232 | 3.7 | 1.2 | 0.418 | STEEL ACCORDING TO PRESENT INVENTION |
| 62 | 0.14 | 767 | 29 | 106 | 81282 | 3.3 | 1.3 | 0.416 | STEEL ACCORDING TO PRESENT INVENTION |
| 63 | 0.12 | 499 | 38 | 189 | 94496 | 4.8 | 1.1 | 0.424 | STEEL ACCORDING TO PRESENT INVENTION |
| 64 | 0.12 | 883 | 25 | 104 | 91850 | 4.5 | 1.2 | 0.414 | STEEL ACCORDING TO PRESENT INVENTION |
| 65 | 0.14 | 657 | 26 | 145 | 94976 | 4.1 | 1.0 | 0.419 | STEEL ACCORDING TO PRESENT INVENTION |
| 66 | 0.12 | 786 | 22 | 116 | 91176 | 4.0 | 1.4 | 0.416 | STEEL ACCORDING TO PRESENT INVENTION |
| 67 | 0.12 | 615 | 28 | 149 | 91635 | 4.0 | 1.0 | 0.420 | STEEL ACCORDING TO PRESENT INVENTION |
| 68 | | | | CRACKING DURING HOT ROLLING | | | | | COMPARATIVE STEEL |
| 69 | | | | CRACKING DURING HOT ROLLING | | | | | COMPARATIVE STEEL |
| 70 | | | | CRACKING DURING HOT ROLLING | | | | | COMPARATIVE STEEL |
| 71 | | | | CRACKING DURING HOT ROLLING | | | | | COMPARATIVE STEEL |
| 72 | | | | CRACKING DURING HOT ROLLING | | | | | COMPARATIVE STEEL |
| 73 | 0.35 | 791 | 12 | 42 | 33091 | 1.0 | 1.7 | 0.414 | COMPARATIVE STEEL |
| 74 | 0.29 | 934 | 8 | 23 | 21674 | 0.6 | 1.6 | 0.412 | COMPARATIVE STEEL |
| 75 | 0.12 | 549 | 28 | 145 | 79605 | 4.6 | 1.1 | 0.422 | STEEL ACCORDING TO PRESENT INVENTION |
| 76 | 0.13 | 792 | 18 | 122 | 96624 | 3.3 | 1.2 | 0.416 | STEEL ACCORDING TO PRESENT INVENTION |
| 77 | 0.18 | 896 | 17 | 110 | 98560 | 2.0 | 1.1 | 0.414 | STEEL ACCORDING TO PRESENT INVENTION |
| 78 | 0.17 | 911 | 19 | 122 | 111142 | 2.0 | 1.2 | 0.414 | STEEL ACCORDING TO PRESENT INVENTION |
| 79 | 0.16 | 593 | 31 | 160 | 94880 | 1.9 | 1.1 | 0.420 | STEEL ACCORDING TO PRESENT INVENTION |
| 80 | 0.11 | 606 | 30 | 162 | 98172 | 1.8 | 1.3 | 0.420 | STEEL ACCORDING TO PRESENT INVENTION |
| 81 | 0.14 | 470 | 35 | 170 | 79900 | 2.3 | 1.7 | 0.475 | STEEL ACCORDING TO PRESENT INVENTION |
| 82 | 0.12 | 480 | 38 | 180 | 86400 | 4.6 | 1.8 | 0.475 | STEEL ACCORDING TO PRESENT INVENTION |
| 83 | 0.15 | 630 | 27 | 155 | 97650 | 4.3 | 1.8 | 0.477 | STEEL ACCORDING TO PRESENT INVENTION |
| 84 | 0.14 | 620 | 26 | 120 | 74400 | 1.8 | 1.7 | 0.475 | STEEL ACCORDING TO PRESENT INVENTION |
| 85 | 0.16 | 620 | 29 | 125 | 77500 | 3.6 | 1.8 | 0.476 | STEEL ACCORDING TO PRESENT INVENTION |
| 86 | 0.12 | 615 | 30 | 122 | 75030 | 3.8 | 1.9 | 0.473 | STEEL ACCORDING TO PRESENT INVENTION |
| 87 | 0.12 | 680 | 30 | 130 | 88400 | 4.6 | 2.0 | 0.470 | STEEL ACCORDING TO PRESENT INVENTION |
| 88 | 0.16 | 670 | 23 | 120 | 80400 | 2.1 | 1.9 | 0.473 | STEEL ACCORDING TO PRESENT INVENTION |
| 89 | 0.14 | 650 | 23 | 130 | 84500 | 3.8 | 1.7 | 0.473 | STEEL ACCORDING TO PRESENT INVENTION |
| 90 | 0.17 | 670 | 22 | 118 | 79060 | 1.9 | 1.6 | 0.474 | STEEL ACCORDING TO PRESENT INVENTION |
| 91 | 0.18 | 790 | 19 | 121 | 95590 | 2.2 | 1.8 | 0.470 | STEEL ACCORDING TO PRESENT INVENTION |
| 92 | 0.18 | 1050 | 18 | 90 | 94500 | 4.0 | 1.8 | 0.463 | STEEL ACCORDING TO PRESENT INVENTION |
| 93 | 0.17 | 800 | 21 | 120 | 96000 | 3.6 | 1.7 | 0.469 | STEEL ACCORDING TO PRESENT INVENTION |
| 94 | 0.16 | 795 | 20 | 135 | 107325 | 4.6 | 1.9 | 0.471 | STEEL ACCORDING TO PRESENT INVENTION |
| 95 | 0.21 | 540 | 28 | 161 | 86940 | 2.0 | 1.6 | 0.476 | STEEL ACCORDING TO PRESENT INVENTION |
| 96 | 0.23 | 830 | 15 | 126 | 104580 | 2.0 | 1.8 | 0.465 | STEEL ACCORDING TO PRESENT INVENTION |
| 97 | 0.18 | 820 | 16 | 135 | 110700 | 3.1 | 1.7 | 0.469 | STEEL ACCORDING TO PRESENT INVENTION |
| 98 | 0.15 | 630 | 24 | 160 | 100800 | 4.3 | 1.8 | 0.475 | STEEL ACCORDING TO PRESENT INVENTION |
| 99 | 0.19 | 600 | 30 | 155 | 93000 | 4.6 | 1.9 | 0.474 | STEEL ACCORDING TO PRESENT INVENTION |

TABLE 13-continued

| EXAMPLE NO. | STANDARD DEVIATION OF HARDNESS/ AVERAGE VALUE OF HARDNESS | TS (Mpa) | El. (%) | λ (%) | TS × λ (Mpa · %) | SHEET THICKNESS/ MINIMUM BENDING RADIUS (C BENDING) | RATIO OF BENDING IN 45° DIRECTION/BENDING IN C DIRECTION | FATIGUE LIMIT RATIO | NOTE |
|---|---|---|---|---|---|---|---|---|---|
| 100 | 0.18 | 805 | 12 | 50 | 40250 | 1.1 | 1.9 | 0.459 | COMPARATIVE STEEL |
| 101 | 0.19 | 730 | 13 | 40 | 29200 | 1.2 | 1.2 | 0.457 | COMPARATIVE STEEL |
| 102 | 0.50 | 440 | 32 | 75 | 33000 | 1.5 | 1.7 | 0.468 | COMPARATIVE STEEL |
| 103 | 0.35 | 1050 | 13 | 35 | 36750 | 0.8 | 1.8 | 0.464 | COMPARATIVE STEEL |
| 104 | | | | CRACKING DURING HOT ROLLING | | | | | COMPARATIVE STEEL |
| 105 | | | | CRACKING DURING HOT ROLLING | | | | | COMPARATIVE STEEL |
| 106 | | | | CRACKING DURING HOT ROLLING | | | | | COMPARATIVE STEEL |
| 107 | | | | CRACKING DURING HOT ROLLING | | | | | COMPARATIVE STEEL |

TABLE 14

| EXAMPLE NO. | STEEL | T1 (° C.) | (1) | (2) | AUSTENITE GRAIN SIZE (μm) | (3) | (4) | (5) |
|---|---|---|---|---|---|---|---|---|
| 108 | A | 851 | 1 | 50 | 150 | 85 | 2 | 15 |
| 109 | A | 851 | 2 | 45/45 | 90 | 95 | 2 | 5 |
| 110 | A | 851 | 2 | 45/45 | 90 | 45 | 1 | 20 |
| 111 | B | 851 | 1 | 50 | 140 | 85 | 2 | 15 |
| 112 | B | 851 | 2 | 45/45 | 80 | 95 | 2 | 5 |
| 113 | B | 851 | 0 | — | 250 | 65 | 2 | 18 |
| 114 | C | 865 | 2 | 45/45 | 80 | 75 | 2 | 15 |
| 115 | C | 865 | 2 | 45/45 | 80 | 85 | 2 | 18 |
| 116 | C | 865 | 2 | 45/45 | 80 | 45 | 1 | 15 |
| 117 | D | 865 | 2 | 45/45 | 80 | 75 | 2 | 15 |
| 118 | D | 865 | 2 | 45/45 | 80 | 85 | 2 | 18 |
| 119 | D | 865 | 2 | 45/45 | 80 | 85 | 2 | 18 |
| 120 | E | 858 | 2 | 45/45 | 95 | 85 | 2 | 13 |
| 121 | D | 858 | 2 | 45/45 | 95 | 95 | 2 | 14 |
| 122 | D | 858 | 2 | 40/45 | 95 | 75 | 1 | 12 |
| 123 | F | 858 | 2 | 45/45 | 90 | 85 | 2 | 13 |
| 124 | F | 858 | 2 | 45/45 | 90 | 95 | 2 | 14 |
| 125 | F | 858 | 0 | — | 300 | 85 | 2 | 13 |
| 126 | G | 865 | 3 | 40/40/40 | 75 | 80 | 2 | 16 |
| 127 | G | 865 | 3 | 40/40/40 | 75 | 80 | 2 | 16 |
| 128 | H | 865 | 3 | 40/40/40 | 70 | 80 | 2 | 16 |
| 129 | I | 861 | 2 | 45/40 | 95 | 80 | 2 | 17 |
| 130 | I | 861 | 1 | 50 | 120 | 80 | 2 | 18 |
| 131 | I | 861 | 1 | 50 | 120 | 80 | 2 | 40 |
| 132 | J | 896 | 2 | 45/40 | 100 | 80 | 2 | 17 |
| 133 | J | 896 | 1 | 50 | 120 | 80 | 2 | 18 |
| 134 | J | 896 | 1 | 50 | 120 | 80 | 2 | 18 |
| 135 | K | 875 | 3 | 40/40/40 | 70 | 95 | 2 | 18 |
| 136 | L | 892 | 3 | 40/40/40 | 75 | 95 | 2 | 18 |
| 137 | M | 892 | 3 | 40/40/40 | 65 | 95 | 2 | 10 |
| 138 | M | 892 | 0 | — | 350 | 45 | 3 | 30 |
| 139 | N | 886 | 3 | 40/40/40 | 70 | 95 | 2 | 10 |
| 140 | O | 903 | 2 | 45/45 | 70 | 85 | 2 | 13 |
| 141 | O | 903 | 2 | 45/45 | 90 | 35 | 1 | 12 |
| 142 | P | 903 | 2 | 45/45 | 75 | 85 | 2 | 15 |
| 143 | Q | 852 | 2 | 45/45 | 80 | 80 | 2 | 10 |
| 144 | R | 852 | 2 | 45/45 | 75 | 85 | 2 | 10 |
| 145 | S | 851 | 2 | 45/45 | 80 | 85 | 2 | 12 |
| 146 | T | 853 | 2 | 45/45 | 80 | 95 | 2 | 12 |
| 147 | U | 880 | 2 | 45/45 | 75 | 85 | 2 | 12 |
| 148 | V | 868 | 2 | 45/45 | 85 | 80 | 2 | 12 |
| 149 | W | 851 | 2 | 45/45 | 85 | 80 | 2 | 12 |
| 150 | a | 855 | | CRACKING DURING HOT ROLLING | | | | |
| 151 | b | 1376 | | CRACKING DURING HOT ROLLING | | | | |
| 152 | c | 851 | | CRACKING DURING HOT ROLLING | | | | |
| 153 | d | 1154 | | CRACKING DURING HOT ROLLING | | | | |
| 154 | e | 851 | 2 | 45/45 | 80 | 65 | 2 | 10 |
| 155 | f | 854 | 2 | 45/45 | 80 | 70 | 2 | 10 |
| 156 | X | 850 | 2 | 45/45 | 80 | 65 | 3 | 12 |
| 157 | Y | 850 | 2 | 45/45 | 80 | 65 | 3 | 12 |
| 158 | Z | 852 | 2 | 45/45 | 80 | 65 | 3 | 12 |
| 159 | AA | 852 | 2 | 45/45 | 80 | 65 | 3 | 12 |
| 160 | AB | 850 | 2 | 45/45 | 80 | 65 | 2 | 12 |
| 161 | AC | 850 | 2 | 45/45 | 80 | 65 | 2 | 12 |

(1) NUMBER OF REDUCTIONS OF 40% OR HIGHER AT 1000° C. TO 1200° C.
(2) ROLLING REDUCTION (%) OF 40% OR HIGHER AT 1000° C. TO 1200° C.
(3) TOTAL ROLLING REDUCTION (%) AT T1 + 30° C. TO T1 + 200° C.
(4) NUMBER (%) OF REDUCTIONS OF 30% OR HIGHER AT T1 + 30° C. TO T1 + 200° C.
(5) TEMPERATURE INCREASE (° C.) DURING REDUCTION AT T1 + 30° C. TO T1 + 200° C.

TABLE 15

| EXAMPLE NO. | (1) | (2) | (3) | (4) | t1 | 2.5 × t1 | (5) |
|---|---|---|---|---|---|---|---|
| 108 | 0 | 935 | 40 | 45 | 0.57 | 1.41 | 0.5 |
| 109 | 0 | 892 | 35 | 60 | 1.74 | 4.35 | 1.4 |
| 110 | 0 | 930 | 30 | 25 | 1.08 | 2.69 | 0.9 |
| 111 | 0 | 935 | 40 | 45 | 0.57 | 1.42 | 0.1 |
| 112 | 0 | 891 | 35 | 60 | 1.77 | 4.44 | 1.1 |
| 113 | 0 | 850 | 30 | 35 | 3.14 | 7.84 | 2.5 |
| 114 | 0 | 945 | 37 | 38 | 0.76 | 1.90 | 0.5 |
| 115 | 0 | 920 | 31 | 54 | 1.54 | 3.86 | 0.9 |

TABLE 15-continued

| EXAMPLE NO. | (1) | (2) | (3) | (4) | t1 | 2.5 × t1 | (5) |
|---|---|---|---|---|---|---|---|
| 116 | 0 | 1075 | 30 | 25 | 0.20 | 0.50 | 0.2 |
| 117 | 0 | 950 | 37 | 38 | 0.67 | 1.67 | 0.4 |
| 118 | 0 | 922 | 31 | 54 | 1.50 | 3.74 | 0.9 |
| 119 | 0 | 922 | 31 | 54 | 1.50 | 3.74 | 4.0 |
| 120 | 0 | 955 | 31 | 54 | 0.73 | 1.82 | 0.4 |
| 121 | 0 | 935 | 40 | 55 | 0.69 | 1.73 | 0.4 |
| 122 | 0 | 880 | 30 | 20 | 2.43 | 6.07 | 2.5 |
| 123 | 0 | 955 | 30 | 55 | 0.78 | 1.95 | 0.5 |

TABLE 15-continued

| EXAMPLE NO. | (1) | (2) | (3) | (4) | t1 | 2.5 × t1 | (5) |
|---|---|---|---|---|---|---|---|
| 124 | 0 | 933 | 40 | 55 | 0.73 | 1.83 | 0.4 |
| 125 | 0 | 890 | 30 | 55 | 2.15 | 5.37 | 1.3 |
| 126 | 0 | 970 | 30 | 50 | 0.66 | 1.66 | 0.4 |
| 127 | 0 | 970 | 30 | 50 | 0.66 | 1.66 | 2.0 |
| 128 | 0 | 970 | 30 | 50 | 0.66 | 1.66 | 0.4 |
| 129 | 0 | 961 | 30 | 50 | 0.73 | 1.82 | 0.4 |
| 130 | 0 | 922 | 30 | 50 | 1.44 | 3.60 | 0.9 |
| 131 | 0 | 850 | 40 | 40 | 3.60 | 8.99 | 2.2 |
| 132 | 0 | 960 | 30 | 50 | 1.38 | 3.44 | 0.8 |
| 133 | 0 | 920 | 30 | 50 | 2.37 | 5.91 | 1.4 |
| 134 | 0 | 920 | 30 | 50 | 2.37 | 5.91 | 1.4 |
| 135 | 0 | 990 | 30 | 65 | 0.53 | 1.32 | 0.3 |
| 136 | 0 | 990 | 30 | 65 | 0.77 | 1.92 | 0.5 |
| 137 | 0 | 943 | 35 | 60 | 1.46 | 3.65 | 0.9 |
| 138 | 0 | 910 | 35 | 35 | 2.44 | 6.09 | 1.5 |
| 139 | 0 | 940 | 35 | 60 | 1.40 | 3.51 | 0.8 |
| 140 | 0 | 1012 | 40 | 45 | 0.25 | 0.63 | 0.2 |
| 141 | 0 | 880 | 30 | 25 | 3.92 | 9.79 | 2.4 |
| 142 | 0 | 985 | 40 | 45 | 0.61 | 1.52 | 0.4 |
| 143 | 0 | 957 | 40 | 40 | 0.29 | 0.72 | 0.2 |
| 144 | 0 | 967 | 35 | 50 | 0.33 | 0.83 | 0.2 |
| 145 | 0 | 996 | 40 | 45 | 0.14 | 0.36 | 0.1 |
| 146 | 0 | 958 | 40 | 55 | 0.29 | 0.72 | 0.2 |

TABLE 15-continued

| EXAMPLE NO. | (1) | (2) | (3) | (4) | t1 | 2.5 × t1 | (5) |
|---|---|---|---|---|---|---|---|
| 147 | 0 | 985 | 35 | 50 | 0.44 | 1.11 | 0.3 |
| 148 | 0 | 973 | 40 | 40 | 0.29 | 0.73 | 0.2 |
| 149 | 0 | 956 | 40 | 40 | 0.29 | 0.73 | 0.2 |
| 150 | | CRACKING DURING HOT ROLLING | | | | | |
| 151 | | CRACKING DURING HOT ROLLING | | | | | |
| 152 | | CRACKING DURING HOT ROLLING | | | | | |
| 153 | | CRACKING DURING HOT ROLLING | | | | | |
| 154 | 0 | 956 | 35 | 30 | 0.44 | 1.11 | 0.3 |
| 155 | 0 | 919 | 35 | 35 | 1.14 | 2.84 | 0.7 |
| 156 | 0 | 950 | 35 | 35 | 0.51 | 1.28 | 0.5 |
| 157 | 0 | 950 | 35 | 35 | 0.52 | 1.29 | 0.5 |
| 158 | 0 | 950 | 35 | 35 | 0.53 | 1.33 | 0.5 |
| 159 | 0 | 950 | 35 | 35 | 0.53 | 1.33 | 0.5 |
| 160 | 0 | 950 | 35 | 35 | 0.51 | 1.28 | 0.5 |
| 161 | 0 | 950 | 35 | 35 | 0.51 | 1.28 | 0.5 |

(1) TOTAL REDUCTION (%) AT T1° C. TO LESS THAN T1 + 30° C.
(2) Tf: TEMPERATURE (° C.) AFTER FINAL PASS OF LARGE REDUCTION PASS
(3) P1: ROLLING REDUCTION (%) DURING FINAL PASS OF LARGE REDUCTION PASS
(4) ROLLING REDUCTION (%) ONE PASS BEFORE FINAL PASS OF LARGE REDUCTION PASS
(5) t: WAITING TIME (s) FROM FINISH OF LARGE REDUCTION PASS TO START OF PRIMARY COOLING

TABLE 16

| EXAMPLE NO. | t/t1 | (1) | RATE (° C./s) OF PRIMARY COOLING | END TEMPERATURE (° C.) OF PRIMARY COOLING | (2) | WINDING TEMPERATURE (° C.) | (3) | X-RAY RANDOM POLE DENSITY OF {332}<113> |
|---|---|---|---|---|---|---|---|---|
| 108 | 0.8 | 110 | 75 | 820 | 1.5 | 350 | 5.2 | 3.2 |
| 109 | 0.8 | 90 | 75 | 797 | 1.5 | 300 | 5.4 | 4.6 |
| 110 | 0.8 | 130 | 80 | 795 | 2.0 | 400 | 6.8 | 5.8 |
| 111 | 0.2 | 80 | 80 | 850 | 2.0 | 400 | 4.8 | 4.1 |
| 112 | 0.6 | 100 | 80 | 786 | 1.5 | 450 | 5.0 | 3.9 |
| 113 | 0.8 | 100 | 85 | 745 | 2.0 | 450 | 6.9 | 6.0 |
| 114 | 0.6 | 90 | 90 | 850 | 1.0 | 550 | 4.1 | 2.3 |
| 115 | 0.6 | 110 | 90 | 805 | 1.5 | 550 | 4.1 | 2.3 |
| 116 | 0.8 | 110 | 90 | 960 | 1.0 | 500 | 6.6 | 5.3 |
| 117 | 0.6 | 120 | 95 | 825 | 1.5 | 100 | 4.2 | 2.8 |
| 118 | 0.6 | 90 | 95 | 827 | 2.0 | 100 | 3.2 | 2.3 |
| 119 | 2.7 | 95 | 100 | 822 | 7.0 | 150 | 4.1 | 3.7 |
| 120 | 0.6 | 100 | 100 | 850 | 1.5 | 550 | 3.4 | 2.7 |
| 121 | 0.6 | 90 | 80 | 840 | 1.5 | 550 | 3.9 | 2.8 |
| 122 | 0.9 | 130 | 80 | 745 | 1.5 | 500 | 6.4 | 4.9 |
| 123 | 0.6 | 80 | 80 | 870 | 2.0 | 300 | 4.1 | 2.3 |
| 124 | 0.6 | 100 | 80 | 828 | 2.0 | 100 | 3.8 | 3.0 |
| 125 | 0.6 | 100 | 75 | 785 | 2.0 | 350 | 6.6 | 5.1 |
| 126 | 0.6 | 90 | 75 | 875 | 1.0 | 450 | 3.7 | 3.2 |
| 127 | 3.0 | 20 | 75 | 945 | 1.0 | 450 | 4.0 | 3.1 |
| 128 | 0.6 | 110 | 85 | 855 | 1.5 | 400 | 3.8 | 3.0 |
| 129 | 0.6 | 110 | 85 | 846 | 2.0 | 620 | 4.2 | 2.8 |
| 130 | 0.6 | 120 | 85 | 797 | 1.5 | 620 | 3.7 | 3.2 |
| 131 | 0.6 | 90 | 85 | 755 | 2.0 | 600 | 5.9 | 4.9 |
| 132 | 0.6 | 95 | 85 | 860 | 1.0 | 480 | 5.1 | 3.2 |
| 133 | 0.6 | 100 | 85 | 815 | 1.5 | 470 | 4.8 | 3.2 |
| 134 | 0.6 | 200 | 85 | 715 | 1.5 | 500 | 5.9 | 5.0 |
| 135 | 0.6 | 90 | 100 | 895 | 1.5 | 400 | 4.8 | 3.2 |
| 136 | 0.6 | 90 | 100 | 895 | 1.5 | 400 | 3.9 | 4.2 |
| 137 | 0.6 | 130 | 100 | 808 | 1.5 | 500 | 5.2 | 3.2 |
| 138 | 0.6 | 80 | 100 | 825 | 2.0 | 550 | 7.0 | 5.4 |
| 139 | 0.6 | 100 | 110 | 835 | 1.5 | 600 | 4.9 | 3.5 |
| 140 | 0.6 | 100 | 100 | 907 | 2.0 | 600 | 4.1 | 2.3 |
| 141 | 0.6 | 90 | 80 | 785 | 2.0 | 600 | 6.6 | 5.1 |
| 142 | 0.6 | 110 | 80 | 870 | 1.0 | 100 | 3.8 | 3.0 |
| 143 | 0.6 | 110 | 80 | 842 | 1.5 | 650 | 4.2 | 2.8 |
| 144 | 0.6 | 120 | 90 | 842 | 1.5 | 500 | 3.7 | 3.2 |
| 145 | 0.6 | 90 | 95 | 901 | 1.5 | 550 | 4.2 | 2.8 |
| 146 | 0.6 | 95 | 95 | 858 | 2.0 | 500 | 3.7 | 3.2 |
| 147 | 0.6 | 100 | 95 | 880 | 1.0 | 600 | 4.2 | 3.1 |

TABLE 16-continued

| EXAMPLE NO. | t/t1 | (1) | RATE (° C./s) OF PRIMARY COOLING | END TEMPERATURE (° C.) OF PRIMARY COOLING | (2) | WINDING TEMPERATURE (° C.) | (3) | X-RAY RANDOM POLE DENSITY OF {332}<113> |
|---|---|---|---|---|---|---|---|---|
| 148 | 0.7 | 100 | 95 | 868 | 1.0 | 550 | 5.1 | 3.2 |
| 149 | 0.7 | 100 | 95 | 851 | 1.0 | 550 | 4.8 | 3.2 |
| 150 | | | | CRACKING DURING HOT ROLLING | | | | |
| 151 | | | | CRACKING DURING HOT ROLLING | | | | |
| 152 | | | | CRACKING DURING HOT ROLLING | | | | |
| 153 | | | | CRACKING DURING HOT ROLLING | | | | |
| 154 | 0.6 | 100 | 90 | 851 | 1.5 | 550 | 7.0 | 5.8 |
| 155 | 0.6 | 100 | 90 | 814 | 1.0 | 500 | 6.9 | 5.6 |
| 156 | 1.0 | 100 | 75 | 845 | 2.0 | 500 | 4.8 | 3.2 |
| 157 | 1.0 | 100 | 75 | 845 | 2.0 | 500 | 5.1 | 3.2 |
| 158 | 0.9 | 100 | 75 | 845 | 2.0 | 500 | 4.8 | 3.2 |
| 159 | 0.9 | 100 | 75 | 845 | 2.0 | 500 | 3.9 | 4.2 |
| 160 | 1.0 | 100 | 75 | 845 | 2.0 | 500 | 5.2 | 3.2 |
| 161 | 1.0 | 100 | 75 | 845 | 2.0 | 500 | 5.4 | 4.6 |

(1) COOLING TEMPERATURE CHANGE (° C.) OF PRIMARY COOLING
(2) TIME (s) FROM FINISH OF PRIMARY COOLING TO START OF SECONDARY COOLING
(3) AVERAGE VALUE OF POLE DENSITIES OF ORIENTATION GROUP {100}<011> TO {223}<110>

TABLE 17

| EXAMPLE NO. | rC | r30 | rL | r60 | COARSE GRAIN AREA RATIO (%) | VOLUME AVERAGE GRAIN SIZE (μm) | EQUIAXIAL GRAIN FRACTION (%) | RIGHT SIDE OF EXPRESSION 1 | FERRITE HARDNESS (Hv) |
|---|---|---|---|---|---|---|---|---|---|
| 108 | 0.70 | 1.08 | 0.70 | 1.09 | 0.7 | 6.6 | 71 | 234 | 156 |
| 109 | 0.85 | 1.07 | 0.89 | 1.10 | 0.7 | 7.4 | 75 | 234 | 140 |
| 110 | 0.70 | 1.10 | 0.72 | 1.16 | 0.7 | 7.5 | 43 | 234 | 171 |
| 111 | 0.72 | 1.06 | 0.71 | 1.08 | 0.2 | 5.8 | 70 | 234 | 132 |
| 112 | 0.72 | 1.10 | 0.73 | 1.08 | 0.6 | 6.1 | 73 | 234 | 148 |
| 113 | 0.65 | 1.15 | 0.63 | 1.23 | 0.7 | 13.8 | 40 | 234 | 148 |
| 114 | 0.75 | 1.05 | 0.71 | 1.00 | 0.6 | 6.3 | 61 | 257 | 154 |
| 115 | 0.70 | 1.10 | 0.67 | 1.11 | 0.6 | 6.3 | 69 | 257 | 171 |
| 116 | 0.71 | 1.07 | 0.56 | 1.19 | 0.7 | 14.6 | 33 | 257 | 171 |
| 117 | 0.85 | 0.95 | 0.83 | 0.98 | 0.6 | 5.7 | 66 | 257 | 180 |
| 118 | 0.93 | 1.01 | 0.68 | 1.21 | 0.6 | 8.2 | 74 | 257 | 154 |
| 119 | 0.70 | 1.15 | 0.52 | 1.30 | 1.1 | 15.7 | 95 | 257 | 158 |
| 120 | 0.75 | 1.05 | 0.72 | 1.08 | 0.6 | 7.3 | 69 | 265 | 168 |
| 121 | 0.90 | 1.10 | 0.87 | 1.09 | 0.6 | 6.8 | 73 | 265 | 159 |
| 122 | 0.71 | 1.08 | 0.71 | 1.09 | 0.8 | 4.9 | 36 | 265 | 184 |
| 123 | 0.85 | 1.02 | 0.90 | 1.03 | 0.6 | 9.2 | 74 | 248 | 140 |
| 124 | 0.80 | 1.00 | 0.82 | 1.01 | 0.6 | 7.1 | 78 | 248 | 157 |
| 125 | 0.70 | 1.18 | 0.71 | 1.20 | 0.6 | 13.3 | 49 | 248 | 157 |
| 126 | 0.88 | 1.05 | 0.94 | 1.00 | 0.6 | 7.2 | 63 | 257 | 154 |
| 127 | 0.74 | 1.20 | 0.72 | 1.23 | 1.1 | 17.6 | 63 | 257 | 94 |
| 128 | 0.90 | 1.10 | 0.87 | 1.09 | 0.6 | 7.1 | 68 | 289 | 193 |
| 129 | 0.92 | 1.09 | 0.90 | 1.00 | 0.6 | 7.8 | 73 | 275 | 183 |
| 130 | 0.74 | 1.07 | 0.69 | 1.20 | 0.6 | 6.0 | 68 | 275 | 182 |
| 131 | 0.70 | 1.09 | 0.71 | 1.08 | 0.6 | 6.5 | 55 | 275 | 165 |
| 132 | 0.72 | 1.06 | 0.71 | 1.08 | 0.6 | 6.9 | 63 | 315 | 174 |
| 133 | 0.72 | 1.10 | 0.73 | 1.08 | 0.6 | 6.9 | 68 | 315 | 180 |
| 134 | 0.71 | 1.10 | 0.68 | 1.15 | 0.6 | 4.9 | 51 | 315 | 335 |
| 135 | 0.92 | 1.09 | 0.69 | 1.14 | 0.6 | 8.3 | 73 | 274 | 164 |
| 136 | 0.73 | 0.99 | 0.64 | 1.18 | 0.6 | 8.3 | 73 | 291 | 175 |
| 137 | 0.94 | 1.08 | 0.96 | 1.09 | 0.6 | 5.3 | 73 | 294 | 186 |
| 138 | 0.65 | 1.22 | 0.52 | 1.30 | 0.6 | 14.1 | 41 | 294 | 167 |
| 139 | 0.93 | 1.10 | 0.90 | 1.10 | 0.6 | 6.7 | 73 | 298 | 188 |
| 140 | 0.74 | 0.98 | 0.73 | 0.99 | 0.6 | 8.2 | 74 | 284 | 180 |
| 141 | 0.70 | 1.10 | 0.71 | 1.19 | 0.6 | 7.7 | 38 | 284 | 170 |
| 142 | 0.93 | 1.10 | 0.90 | 1.10 | 0.6 | 5.6 | 64 | 284 | 179 |
| 143 | 0.74 | 0.98 | 0.73 | 0.99 | 0.6 | 6.1 | 68 | 249 | 166 |
| 144 | 0.92 | 1.09 | 0.94 | 1.09 | 0.6 | 6.1 | 69 | 273 | 181 |
| 145 | 0.75 | 1.05 | 0.72 | 1.08 | 0.6 | 7.6 | 69 | 258 | 155 |
| 146 | 0.90 | 1.10 | 0.87 | 1.09 | 0.6 | 7.7 | 78 | 236 | 146 |
| 147 | 0.92 | 1.09 | 0.90 | 1.00 | 0.6 | 6.4 | 64 | 268 | 170 |
| 148 | 0.74 | 1.07 | 0.72 | 1.09 | 0.7 | 5.9 | 63 | 294 | 186 |
| 149 | 0.88 | 1.08 | 0.92 | 1.02 | 0.7 | 5.7 | 63 | 240 | 152 |
| 150 | | | | | CRACKING DURING HOT ROLLING | | | | |
| 151 | | | | | CRACKING DURING HOT ROLLING | | | | |
| 152 | | | | | CRACKING DURING HOT ROLLING | | | | |
| 153 | | | | | CRACKING DURING HOT ROLLING | | | | |

TABLE 17-continued

| EXAMPLE NO. | rC | r30 | rL | r60 | COARSE GRAIN AREA RATIO (%) | VOLUME AVERAGE GRAIN SIZE (μm) | EQUIAXIAL GRAIN FRACTION (%) | RIGHT SIDE OF EXPRESSION 1 | FERRITE HARDNESS (Hv) |
|---|---|---|---|---|---|---|---|---|---|
| 154 | 0.65 | 1.25 | 0.56 | 1.19 | 0.6 | 2.4 | 68 | 313 | 355 |
| 155 | 0.68 | 1.18 | 0.65 | 1.15 | 0.6 | 1.4 | 30 | 313 | 199 |
| 156 | 0.72 | 1.06 | 0.75 | 1.10 | 0.8 | 6.0 | 75 | 291 | 211 |
| 157 | 0.93 | 1.10 | 0.90 | 1.10 | 0.8 | 6.5 | 70 | 277 | 197 |
| 158 | 0.74 | 0.98 | 0.73 | 0.99 | 0.8 | 6.9 | 64 | 257 | 177 |
| 159 | 0.92 | 1.09 | 0.94 | 1.09 | 0.8 | 6.9 | 80 | 280 | 200 |
| 160 | 0.73 | 0.99 | 0.70 | 1.10 | 0.8 | 4.9 | 66 | 245 | 165 |
| 161 | 0.94 | 1.08 | 0.96 | 1.09 | 0.8 | 8.3 | 71 | 264 | 184 |

TABLE 18

| EXAMPLE NO. | STANDARD DEVIATION OF HARDNESS/ AVERAGE VALUE OF HARDNESS | TS (Mpa) | El. (%) | λ (%) | TS × λ (MPa · %) | SHEET THICKNESS/ MINIMUM BENDING RADIUS (C BENDING) | RATIO OF BENDING IN 45° DIRECTION/BENDING IN C DIRECTION | FATIGUE LIMIT RATIO | NOTE |
|---|---|---|---|---|---|---|---|---|---|
| 108 | 0.11 | 612 | 31 | 136 | 83149 | 3.6 | 1.7 | 0.472 | STEEL ACCORDING TO PRESENT INVENTION |
| 109 | 0.14 | 632 | 30 | 159 | 100623 | 3.6 | 1.9 | 0.469 | STEEL ACCORDING TO PRESENT INVENTION |
| 110 | 0.21 | 602 | 24 | 87 | 52403 | 0.8 | 2.3 | 0.470 | COMPARATIVE STEEL |
| 111 | 0.12 | 648 | 29 | 139 | 89910 | 3.5 | 1.7 | 0.472 | STEEL ACCORDING TO PRESENT INVENTION |
| 112 | 0.14 | 638 | 32 | 143 | 91312 | 3.9 | 1.8 | 0.472 | STEEL ACCORDING TO PRESENT INVENTION |
| 113 | 0.24 | 598 | 22 | 98 | 58636 | 0.8 | 1.9 | 0.462 | COMPARATIVE STEEL |
| 114 | 0.14 | 575 | 30 | 169 | 97520 | 4.7 | 2.0 | 0.475 | STEEL ACCORDING TO PRESENT INVENTION |
| 115 | 0.17 | 575 | 33 | 149 | 85757 | 1.8 | 1.7 | 0.475 | STEEL ACCORDING TO PRESENT INVENTION |
| 116 | 0.17 | 591 | 18 | 79 | 46724 | 2.0 | 2.4 | 0.462 | COMPARATIVE STEEL |
| 117 | 0.14 | 910 | 19 | 89 | 81029 | 3.4 | 2.1 | 0.463 | STEEL ACCORDING TO PRESENT INVENTION |
| 118 | 0.17 | 905 | 16 | 104 | 94055 | 3.5 | 2.0 | 0.459 | STEEL ACCORDING TO PRESENT INVENTION |
| 119 | 0.33 | 890 | 12 | 77 | 68564 | 1.3 | 1.1 | 0.414 | COMPARATIVE STEEL |
| 120 | 0.17 | 589 | 29 | 153 | 90070 | 2.9 | 1.8 | 0.471 | STEEL ACCORDING TO PRESENT INVENTION |
| 121 | 0.12 | 588 | 31 | 162 | 95090 | 4.4 | 1.7 | 0.473 | STEEL ACCORDING TO PRESENT INVENTION |
| 122 | 0.25 | 592 | 21 | 95 | 56225 | 1.6 | 1.7 | 0.478 | STEEL ACCORDING TO PRESENT INVENTION |
| 123 | 0.17 | 869 | 20 | 125 | 108658 | 5.8 | 1.9 | 0.459 | STEEL ACCORDING TO PRESENT INVENTION |
| 124 | 0.15 | 1100 | 15 | 96 | 105600 | 5.8 | 1.6 | 0.457 | STEEL ACCORDING TO PRESENT INVENTION |
| 125 | 0.29 | 899 | 10 | 46 | 41591 | 0.8 | 2.1 | 0.455 | COMPARATIVE STEEL |
| 126 | 0.17 | 788 | 22 | 130 | 102828 | 4.7 | 1.9 | 0.464 | STEEL ACCORDING TO PRESENT INVENTION |
| 127 | 0.23 | 788 | 17 | 99 | 78011 | 1.3 | 1.2 | 0.415 | COMPARATIVE STEEL |
| 128 | 0.17 | 973 | 17 | 84 | 81741 | 3.8 | 2.0 | 0.459 | STEEL ACCORDING TO PRESENT INVENTION |
| 129 | 0.17 | 564 | 34 | 152 | 85552 | 3.8 | 2.1 | 0.472 | STEEL ACCORDING TO PRESENT INVENTION |
| 130 | 0.17 | 554 | 34 | 142 | 78758 | 1.7 | 2.1 | 0.477 | STEEL ACCORDING TO PRESENT INVENTION |
| 131 | 0.20 | 576 | 28 | 85 | 48992 | 1.8 | 2.0 | 0.474 | STEEL ACCORDING TO PRESENT INVENTION |
| 132 | 0.17 | 721 | 28 | 129 | 93227 | 4.1 | 1.9 | 0.466 | STEEL ACCORDING TO PRESENT INVENTION |
| 133 | 0.17 | 716 | 28 | 122 | 87137 | 3.8 | 1.8 | 0.466 | STEEL ACCORDING TO PRESENT INVENTION |
| 134 | 0.17 | 711 | 20 | 83 | 58760 | 1.7 | 1.9 | 0.472 | STEEL ACCORDING TO PRESENT INVENTION |
| 135 | 0.17 | 1286 | 17 | 65 | 83562 | 1.8 | 1.8 | 0.453 | STEEL ACCORDING TO PRESENT INVENTION |
| 136 | 0.18 | 1104 | 20 | 79 | 87229 | 1.9 | 1.7 | 0.456 | STEEL ACCORDING TO PRESENT INVENTION |
| 137 | 0.15 | 745 | 23 | 114 | 84918 | 3.0 | 2.0 | 0.469 | STEEL ACCORDING TO PRESENT INVENTION |
| 138 | 0.24 | 775 | 17 | 65 | 50464 | 0.7 | 2.1 | 0.457 | COMPARATIVE STEEL |
| 139 | 0.15 | 991 | 17 | 87 | 86246 | 4.1 | 1.9 | 0.459 | STEEL ACCORDING TO PRESENT INVENTION |
| 140 | 0.12 | 811 | 21 | 119 | 96817 | 4.6 | 1.8 | 0.462 | STEEL ACCORDING TO PRESENT INVENTION |
| 141 | 0.17 | 791 | 14 | 65 | 51330 | 1.2 | 2.1 | 0.463 | COMPARATIVE STEEL |
| 142 | 0.12 | 1391 | 12 | 58 | 80652 | 3.6 | 2.0 | 0.455 | STEEL ACCORDING TO PRESENT INVENTION |
| 143 | 0.12 | 662 | 33 | 133 | 88232 | 3.7 | 1.7 | 0.471 | STEEL ACCORDING TO PRESENT INVENTION |
| 144 | 0.14 | 767 | 29 | 106 | 81282 | 3.3 | 1.6 | 0.466 | STEEL ACCORDING TO PRESENT INVENTION |
| 145 | 0.12 | 499 | 38 | 189 | 94496 | 4.8 | 1.8 | 0.476 | STEEL ACCORDING TO PRESENT INVENTION |
| 146 | 0.12 | 883 | 25 | 104 | 91850 | 4.5 | 1.8 | 0.460 | STEEL ACCORDING TO PRESENT INVENTION |
| 147 | 0.14 | 657 | 26 | 145 | 94976 | 4.1 | 1.7 | 0.470 | STEEL ACCORDING TO PRESENT INVENTION |
| 148 | 0.12 | 786 | 22 | 116 | 91176 | 4.0 | 1.9 | 0.466 | STEEL ACCORDING TO PRESENT INVENTION |
| 149 | 0.12 | 615 | 28 | 149 | 91635 | 4.0 | 1.8 | 0.474 | STEEL ACCORDING TO PRESENT INVENTION |
| 150 | | | | CRACKING DURING HOT ROLLING | | | | | COMPARATIVE STEEL |
| 151 | | | | CRACKING DURING HOT ROLLING | | | | | COMPARATIVE STEEL |
| 152 | | | | CRACKING DURING HOT ROLLING | | | | | COMPARATIVE STEEL |

TABLE 18-continued

| EXAMPLE NO. | STANDARD DEVIATION OF HARDNESS/ AVERAGE VALUE OF HARDNESS | TS (Mpa) | El. (%) | λ (%) | TS × λ (MPa · %) | SHEET THICKNESS/ MINIMUM BENDING RADIUS (C BENDING) | RATIO OF BENDING IN 45° DIRECTION/BENDING IN C DIRECTION | FATIGUE LIMIT RATIO | NOTE |
|---|---|---|---|---|---|---|---|---|---|
| 153 | | | | CRACKING DURING HOT ROLLING | | | | | COMPARATIVE STEEL |
| 154 | 0.35 | 806 | 11 | 34 | 27404 | 1.0 | 2.1 | 0.480 | COMPARATIVE STEEL |
| 155 | 0.17 | 941 | 7 | 20 | 18820 | 0.6 | 2.2 | 0.486 | COMPARATIVE STEEL |
| 156 | 0.12 | 492 | 36 | 180 | 88560 | 4.0 | 2.0 | 0.482 | STEEL ACCORDING TO PRESENT INVENTION |
| 157 | 0.14 | 620 | 28 | 161 | 99820 | 3.5 | 1.8 | 0.472 | STEEL ACCORDING TO PRESENT INVENTION |
| 158 | 0.13 | 845 | 19 | 118 | 99710 | 2.9 | 1.8 | 0.463 | STEEL ACCORDING TO PRESENT INVENTION |
| 159 | 0.12 | 956 | 16 | 88 | 84128 | 2.4 | 1.7 | 0.460 | STEEL ACCORDING TO PRESENT INVENTION |
| 160 | 0.12 | 546 | 30 | 148 | 80808 | 3.8 | 1.9 | 0.481 | STEEL ACCORDING TO PRESENT INVENTION |
| 161 | 0.11 | 651 | 29 | 150 | 97650 | 3.4 | 1.8 | 0.467 | STEEL ACCORDING TO PRESENT INVENTION |

The invention claimed is:

1. A method of producing a hot-rolled steel sheet, comprising:

performing a first hot rolling which reduces a steel ingot or a slab including, by mass %, C: a content [C] of 0.0001% to 0.40%, Si: a content [Si] of 0.001% to 2.5%, Mn: a content [Mn] of 0.001% to 4.0%, P: a content [P] of 0.001% to 0.15%, S: a content [S] of 0.0005% to 0.10%, Al: a content [Al] of 0.001% to 2.0%, N: a content [N] of 0.0005% to 0.01%, O: a content [O] of 0.0005% to 0.01%, and a balance consisting of iron and unavoidable impurities, and which includes at least one pass at a rolling reduction of 40% or higher in a temperature range of 1000° C. to 1200° C. so as to control an austenite grain size to be less than or equal to 200 μm;

performing a second hot rolling in which, when a temperature determined by components of the steel sheet according to a following expression 2 is represented by T1° C., a total rolling reduction is larger than or equal to 50% in a temperature range of (T1+30°) C. to (T1+200°) C.;

performing a third hot rolling in which a total rolling reduction is lower than or equal to 30% in a temperature range of T1° C. to less than (T1+30°) C.;

finishing the hot rollings at T1° C. or higher; and performing a primary cooling between rolling stands such that, when a pass of a rolling reduction of 30% or higher in the temperature range of (T1+30°) C. to (T1+200°) C. is defined as a large reduction pass, a waiting time t (second) from a finish of a final pass of a large reduction pass to the start of cooling satisfies a following expression 3, $$T1=850+10\times([C]+[N])\times[Mn]+350\times[Nb]+250\times[Ti]+40\times[B]+10\times[Cr]+100\times[Mo]+100\times[V] \quad \text{(Expression 2)}$$

$$t\leq t1\times 2.5 \quad \text{(Expression 3)}$$

(wherein t1 is represented by a following expression 4)

$$t1=0.001\times((Tf-T1)\times P1/100)^2-0.109\times((Tf-T1)\times P1/100)+3.1 \quad \text{(Expression 4)}$$

(wherein Tf represents the temperature (° C.) of the steel sheet at the time of the finish of the final pass, and P1 represents the rolling reduction (%) during the final pass).

2. The method of producing a hot-rolled steel sheet according to claim 1, wherein the waiting time t (second) further satisfies a following expression 5, $$t<t1 \quad \text{(Expression 5).}$$

3. The method of producing a hot-rolled steel sheet according to claim 1, wherein the waiting time t (second) further satisfies a following expression 6, $$t1\leq t\leq t1\times 2.5 \quad \text{(Expression 6).}$$

4. The method of producing a hot-rolled steel sheet according to claim 1, wherein a cooling temperature change, which is a difference between a steel sheet temperature at a time of a start of the cooling and a steel sheet temperature at the time of the finish of the cooling in the primary cooling, is 40° C. to 140° C., and the steel sheet temperature at the time of the finish of cooling in the primary cooling is lower than or equal to (T1+100°) C.

5. The method of producing a hot-rolled steel sheet according to claim 1, wherein in the second hot rolling of the temperature range of (T1+30°) C. to (T1+200°) C., the reduction is performed at least once in one pass at a rolling reduction of 30% or higher.

6. The method of producing a hot-rolled steel sheet according to claim 1, wherein in the first hot rolling, the reduction is performed at least twice at a rolling reduction of 40% or higher to control an austenite grain size to be less than or equal to 100 μm.

7. The method of producing a hot-rolled steel sheet according to claim 1, wherein a secondary cooling starts after passing through a final rolling stand and within 10 seconds from the finish of the primary cooling.

8. The method of producing a hot-rolled steel sheet according to claim 1, wherein in the second hot rolling, an increase in the temperature of the steel sheet between passes is lower than or equal to 18° C.

9. The method of producing a hot-rolled steel sheet according to claim 1, wherein the steel ingot or the slab further includes one or more selected from, by mass %, Ti: a content [Ti] of 0.001% to 0.20%, Nb: a content [Nb] of 0.001% to 0.20%, V: a content [V] of 0.001% to 1.0%, W: a content [W] of 0.001% to 1.0%, B: a content [B] of 0.0001% to 0.0050%, Mo: a content [Mo] of 0.001% to 2.0%, Cr: a content [Cr] of 0.001% to 2.0%, Cu: a content [Cu] of 0.001% to 2.0%, Ni: a content [Ni] of 0.001% to 2.0%, Co: a content [Co] of 0.0001% to 1.0%, Sn: a content [Sn] of 0.0001% to 0.2%, Zr: a content [Zr] of 0.0001% to 0.2%, As: a content [As] of 0.0001% to 0.50%, Mg: a content [Mg] of 0.0001% to 0.010%, Ca: a content [Ca] of 0.0001% to 0.010%, and REM: a content [REM] of 0.0001% to 0.1%.

* * * * *